US011291305B2

(12) United States Patent
Deevers et al.

(10) Patent No.: US 11,291,305 B2
(45) Date of Patent: Apr. 5, 2022

(54) COMPLIANT BACKREST

(71) Applicant: Steelcase Inc., Grand Rapids, MI (US)

(72) Inventors: Nickolaus William Charles Deevers, Holland, MI (US); Kurt R. Heidmann, Grand Rapids, MI (US); Pascal Rolf Hien, Radebeul (DE); Jeffrey A. Hall, Grand Rapids, MI (US); John Colasanti, Jenison, MI (US); Michael Yancharas, Comstock Park, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 17/035,150

(22) Filed: Sep. 28, 2020

(65) Prior Publication Data

US 2021/0093092 A1 Apr. 1, 2021

Related U.S. Application Data

(63) Continuation of application No. 16/208,206, filed on Dec. 3, 2018, now Pat. No. 10,813,463, which is a (Continued)

(51) Int. Cl.

| | |
|---|---|
| ***A47C 7/44*** | (2006.01) |
| ***A47C 7/46*** | (2006.01) |
| ***A47C 7/40*** | (2006.01) |

(52) U.S. Cl.

CPC ..... *A47C 7/44* (2013.01); *A47C 7/40* (2013.01); *A47C 7/46* (2013.01)

(58) Field of Classification Search

CPC .... A47C 7/44; A47C 7/40; A47C 7/46; A47C 7/002; A47C 7/004; A47C 7/02; (Continued)

(56) References Cited

U.S. PATENT DOCUMENTS

| | | | | |
|---|---|---|---|---|
| 87,184 A | | 2/1869 | Mattson | |
| 241,498 A | * | 5/1881 | Levalley | A01D 67/00 56/215 |

(Continued)

FOREIGN PATENT DOCUMENTS

| | | |
|---|---|---|
| CN | 2256246 | 6/1997 |
| CN | 101049202 | 10/2007 |

(Continued)

OTHER PUBLICATIONS

International Search Report and Written Opinion for International Application No. PCT/US2017/053409 dated Dec. 20, 2017 (9 pgs).

(Continued)

*Primary Examiner* — Mark R Wendell
(74) *Attorney, Agent, or Firm* — Crowell & Moring LLP

(57) ABSTRACT

A backrest includes a frame having a pair of laterally spaced upright members connected with longitudinally spaced upper and lower members. A flexible shell has opposite sides coupled to the upright members and upper and lower portions coupled to the upper and lower members. The shell includes first and second slots extending longitudinally along opposite sides of the shell inboard of locations where the shell is connected to the upright members, and one or more third slots extending laterally along the lower portion of the shell above a location where the shell is connected to the lower member. Terminal ends of the one or more third slots are spaced apart from lower terminal ends of the first and second slots. In other embodiments, the shell is a three-dimensional molded component having a plurality of openings. In various embodiments, the slots and/or openings provide different levels of compliance to the backrest.

21 Claims, 55 Drawing Sheets

Related U.S. Application Data continuation of application No. 29/628,523, filed on Dec. 5, 2017, now Pat. No. Des. 869,872, which is a continuation of application No. 29/628,527, filed on Dec. 5, 2017, now Pat. No. Des. 869,890, which is a continuation of application No. 29/628,528, filed on Dec. 5, 2017, now Pat. No. Des. 870,479, which is a continuation of application No. 29/628,526, filed on Dec. 5, 2017, now Pat. No. Des. 869,889.

(60) Provisional application No. 62/594,885, filed on Dec. 5, 2017.

(58) Field of Classification Search
CPC .. A47C 7/18; A47C 7/24; A47C 7/282; A47C 7/285; A47C 7/54
USPC ..... 297/301.1
See application file for complete search history.

(56) References Cited

U.S. PATENT DOCUMENTS

D149,798 S 6/1948 Crawford
2,678,685 A 5/1954 Volsk
2,726,713 A 12/1955 Turner
2,799,323 A 7/1957 Berg et al.
D188,843 S 9/1960 Kagan
3,162,487 A 12/1964 Trotman
3,233,885 A 2/1966 Propst
3,559,978 A 2/1971 Molt
3,565,482 A 2/1971 Blodee
3,652,809 A 3/1972 Dickopp et al.
3,653,233 A 4/1972 Titone
3,669,499 A 6/1972 Semplonius et al.
3,709,559 A 1/1973 Rowland
3,720,568 A 3/1973 Rowland
3,724,402 A 4/1973 Thyberg et al.
3,767,261 A 10/1973 Rowland
3,774,967 A 11/1973 Rowland
3,843,477 A 10/1974 Rowland
3,877,750 A 4/1975 Scholpp
3,948,558 A 4/1976 Obermeier et al.
4,088,367 A 5/1978 Atkinson et al.
4,205,880 A 6/1980 Trotman et al.
4,337,931 A 7/1982 Mundell et al.
4,368,917 A 1/1983 Urai
4,418,958 A 12/1983 Watkin
4,502,728 A 3/1985 Sheldon et al.
4,502,731 A 3/1985 Snider
D279,244 S 6/1985 Bergquist
4,529,247 A 7/1985 Stumpf et al.
4,567,615 A 2/1986 Fanti
4,574,100 A 3/1986 Mercer
4,585,272 A 4/1986 Ballarini
4,634,178 A 1/1987 Carney
4,647,109 A 3/1987 Christophersen et al.
4,660,887 A 4/1987 Fleming et al.
4,668,557 A 5/1987 Lakes
4,680,215 A 7/1987 Mercer
4,658,807 A 8/1987 Swain
4,718,724 A 1/1988 Quinton et al.
4,856,846 A 8/1989 Lohmeyer
4,892,356 A 1/1990 Pittman et al.
4,895,091 A 1/1990 Emali et al.
4,913,493 A 4/1990 Heidmann
4,962,964 A 10/1990 Snodgrass
5,015,038 A 5/1991 Mrotz, III
5,022,709 A 6/1991 Marchino
5,024,485 A 6/1991 Berg et al.
5,102,196 A 4/1992 Kaneda et al.
5,154,485 A 10/1992 Fleishman
5,269,631 A 12/1993 Mercer et al.
5,282,285 A 2/1994 De Gelis et al.
5,288,127 A 2/1994 Berg et al.
D346,073 S 4/1994 Hamelink
5,314,240 A 5/1994 Ishi et al.
5,320,410 A 6/1994 Faiks et al.
5,326,155 A 7/1994 Wild
5,340,197 A 8/1994 Vogtherr
5,403,067 A 4/1995 Rajaratnam
5,518,294 A 5/1996 Ligon, Sr. et al.
5,664,835 A 9/1997 Desanta
5,711,575 A 1/1998 Hand et al.
5,747,140 A 5/1998 Heerklotz
5,755,467 A 5/1998 Dilluvio et al.
5,774,911 A 7/1998 Stùbe et al.
5,791,933 A 8/1998 Saka et al.
5,863,095 A 1/1999 Rivard et al.
5,871,258 A 2/1999 Battey et al.
5,934,758 A 8/1999 Ritch et al.
5,951,109 A 9/1999 Roslund, Jr. et al.
5,997,094 A 12/1999 Cvek
6,062,649 A 5/2000 Nagel et al.
6,079,785 A 6/2000 Peterson et al.
D437,501 S 2/2001 Rehmert et al.
6,189,972 B1 2/2001 Chu et al.
D438,392 S 3/2001 Lucci et al.
6,286,900 B1 9/2001 Roark
6,299,248 B1 10/2001 Gennaro et al.
D451,293 S 12/2001 Su
6,354,662 B1 3/2002 Su
6,357,826 B1 3/2002 Gabas et al.
6,409,268 B1 6/2002 Cvek
6,412,869 B1 7/2002 Pearce
6,419,318 B1 7/2002 Albright
6,439,661 B1 8/2002 Bräuning
D462,534 S 9/2002 Grazioli
6,471,294 B1 10/2002 Dammermann et al.
6,523,898 B1 2/2003 Ball et al.
D471,042 S 3/2003 Schmitz et al.
6,550,866 B1 4/2003 Su
6,568,760 B2 5/2003 Davis et al.
6,572,190 B2 6/2003 Koepke et al.
6,575,530 B1 6/2003 Fischer et al.
6,626,497 B2 9/2003 Nagamitsu et al.
6,644,752 B2 11/2003 Takata
6,669,292 B2 12/2003 Koepke
6,669,301 B1 12/2003 Funk et al.
6,679,553 B2 1/2004 Battey et al.
6,679,557 B2 1/2004 Craft et al.
6,701,550 B2 3/2004 Baeriswyl
6,709,060 B1 3/2004 Su
6,726,285 B2 4/2004 Caruso et al.
D489,191 S 5/2004 Ma
6,733,080 B2 5/2004 Stumpf et al.
6,755,467 B1 6/2004 Chu
6,767,060 B2 7/2004 Craft et al.
D494,792 S 8/2004 Schmitz et al.
6,793,289 B2 9/2004 Kuster et al.
6,805,405 B2 10/2004 Koo
6,820,933 B2 11/2004 Fereira Da Silva
6,874,852 B2 4/2005 Footitt
6,890,030 B2 5/2005 Wilkerson et al.
6,910,736 B2 6/2005 White
6,957,861 B1 10/2005 Chou et al.
6,981,743 B2 1/2006 Edwards et al.
6,983,997 B2 1/2006 Wilkerson et al.
6,986,549 B2 1/2006 Kniese
7,032,971 B2 4/2006 Williams
D521,755 S 5/2006 Kinoshita et al.
7,059,682 B2 6/2006 Caruso et al.
7,063,384 B2 6/2006 Liu
D527,557 S 9/2006 Reimers
7,165,811 B2 1/2007 Bodnar et al.
7,213,886 B2 5/2007 Schmitz et al.
7,216,933 B2 5/2007 Schmidt et al.
7,234,773 B2 6/2007 Raftery et al.
D546,574 S 7/2007 Kaloustian
7,237,841 B2 7/2007 Norman et al.
7,247,265 B2 7/2007 Alderson et al.
7,252,870 B2 8/2007 Anderson et al.
7,270,378 B2 9/2007 Wilkerson et al.
7,275,793 B2 * 10/2007 Fujita ..... A47C 31/006
297/452.27

(56) References Cited

U.S. PATENT DOCUMENTS 7,303,232 B1 12/2007 Chen
D558,995 S 1/2008 Igarashi
7,320,503 B2 1/2008 Eysing
7,344,194 B2 3/2008 Maier et al.
7,347,495 B2 3/2008 Beyer et al.
D571,568 S 6/2008 Overthun et al.
7,406,733 B2 8/2008 Coffield et al.
7,419,215 B2 9/2008 Wilkerson et al.
7,425,037 B2 9/2008 Schmitz et al.
7,441,758 B2 10/2008 Coffield et al.
7,455,365 B2 11/2008 Caruso et al.
7,472,962 B2 1/2009 Caruso et al.
7,484,802 B2 2/2009 Beyer et al.
D591,969 S 5/2009 Overthun et al.
D594,669 S 6/2009 Asano
D595,072 S 6/2009 Su
7,568,768 B1 8/2009 Tsai
7,604,298 B2 * 10/2009 Peterson ..... A47C 7/462 297/353
7,604,299 B2 10/2009 Su
7,647,714 B2 1/2010 Coffield et al.
7,648,201 B2 1/2010 Eysing
D612,642 S 3/2010 Cassaday
7,686,395 B2 3/2010 Piretti
7,712,834 B2 5/2010 Knoblock et al.
7,726,740 B2 6/2010 Masunaga
7,731,295 B2 6/2010 Lin
7,740,321 B2 6/2010 Brill et al.
7,748,783 B2 * 7/2010 Kinoshita ..... A47C 7/46 297/284.4
7,794,017 B2 9/2010 Kan et al.
7,794,022 B2 9/2010 Caruso et al.
7,857,388 B2 12/2010 Bedford et al.
7,874,619 B2 1/2011 Harley
7,878,591 B2 2/2011 Walker
7,878,598 B2 2/2011 Oda
7,887,131 B2 2/2011 Chadwick et al.
7,896,438 B2 3/2011 Whelan et al.
7,909,402 B2 3/2011 Chu et al.
7,926,879 B2 4/2011 Schmitz et al.
7,931,257 B2 4/2011 Vanderiet et al.
D637,839 S 5/2011 Piretti
D638,641 S 5/2011 Piretti
D642,819 S 8/2011 Piretti
D643,654 S 8/2011 Piretti
D649,804 S 12/2011 Keller et al.
D650,616 S 12/2011 Piretti
D652,224 S 1/2012 Ferrier
D655,522 S 3/2012 Czumaj-Bront et al.
8,157,329 B2 4/2012 Masoud
D660,611 S 5/2012 Barile
8,172,332 B2 5/2012 Masunaga et al.
8,186,761 B2 5/2012 Brill et al.
8,191,970 B2 6/2012 Igarashi et al.
8,251,448 B2 8/2012 Machael
8,272,691 B2 9/2012 Hsuan-Chin
8,282,169 B2 10/2012 Schmitz et al.
8,282,172 B2 10/2012 Schmitz et al.
D671,330 S 11/2012 Izawa
D673,394 S 1/2013 Hurford
D673,395 S 1/2013 Piretti
8,414,073 B2 4/2013 Schmitz et al.
8,436,508 B2 5/2013 Kornbluh et al.
8,449,037 B2 5/2013 Behar
D686,833 S 7/2013 Chan
D688,055 S 8/2013 Baldanzi et al.
D688,061 S 8/2013 Giugiaro
8,528,980 B1 9/2013 Hsiao
8,534,648 B2 9/2013 Coffield et al.
8,540,315 B2 9/2013 Piretti
D695,537 S 12/2013 Geelen
8,622,472 B2 1/2014 Rajaratnam
8,652,602 B1 2/2014 Dolla
D701,068 S 3/2014 Usumoto et al.
8,745,783 B2 6/2014 Jansen
D710,640 S 8/2014 Usumoto et al.
8,820,835 B2 9/2014 Minino et al.
8,919,880 B2 12/2014 Bellingar et al.
8,926,016 B2 1/2015 Behar et al.
8,939,507 B2 1/2015 Thomaschewski et al.
8,967,726 B2 3/2015 Schmitz et al.
D726,431 S 4/2015 Ye
8,998,339 B2 4/2015 Peterson et al.
9,010,859 B2 4/2015 Battey et al.
9,022,475 B2 5/2015 Brncick et al.
9,033,421 B2 5/2015 Wilkinson et al.
D731,833 S 6/2015 Fifield et al.
9,114,880 B2 8/2015 Guering
9,144,311 B2 9/2015 Romero
9,155,393 B2 10/2015 Hurford et al.
9,185,985 B2 11/2015 Bellingar et al.
9,186,290 B2 11/2015 Fowler
9,192,237 B2 11/2015 Bachar
9,211,014 B2 12/2015 Schmitz
9,237,811 B1 1/2016 Cho et al.
9,278,634 B2 3/2016 Mathews et al.
9,301,615 B2 4/2016 Behar et al.
9,326,613 B2 5/2016 Cvek
9,332,851 B2 5/2016 Machael et al.
9,414,681 B2 8/2016 Bellingar et al.
9,486,079 B2 11/2016 Romero
9,486,081 B2 11/2016 Sander et al.
D779,251 S 2/2017 Beyer et al.
9,578,968 B2 2/2017 Masunaga et al.
D782,240 S 3/2017 Wada
9,592,757 B2 3/2017 Machael et al.
9,596,941 B1 3/2017 Romero
9,603,451 B2 3/2017 Masunaga et al.
9,913,539 B2 3/2018 Potrykus et al.
10,064,493 B2 9/2018 Machael et al.
2001/0008955 A1 7/2001 Garth
2002/0021040 A1 2/2002 Caruso et al.
2002/0093233 A1 7/2002 Chu
2002/0190564 A1 12/2002 Coffield
2003/0107252 A1 6/2003 Kinoshita et al.
2004/0007910 A1 1/2004 Skelly
2004/0100139 A1 5/2004 Williams
2004/0140701 A1 7/2004 Schmitz et al.
2004/0183348 A1 9/2004 Kniese
2004/0195882 A1 10/2004 White
2004/0256899 A1 12/2004 Moore et al.
2005/0001464 A1 1/2005 Caruso et al.
2005/0025948 A1 2/2005 Johnson et al.
2005/0062323 A1 3/2005 Dicks
2005/0104428 A1 5/2005 Walker et al.
2005/0146193 A1 6/2005 Shieh
2006/0022506 A1 2/2006 Chan
2006/0033369 A1 2/2006 Eysing
2006/0103208 A1 5/2006 Schmitz et al.
2006/0181126 A1 8/2006 Eysing
2006/0255635 A1 11/2006 Iijima et al.
2006/0267258 A1 11/2006 Coffield et al.
2006/0286359 A1 12/2006 Coffield et al.
2007/0031667 A1 2/2007 Hook et al.
2007/0057550 A1 3/2007 Beyer et al.
2007/0262634 A1 11/2007 Brill et al.
2008/0011021 A1 1/2008 Starbuck et al.
2008/0248710 A1 10/2008 Wittner
2009/0020931 A1 1/2009 Coffield et al.
2009/0085388 A1 4/2009 Parker et al.
2009/0239049 A1 9/2009 Hook et al.
2010/0001572 A1 1/2010 Masunaga et al.
2010/0117433 A1 5/2010 Cassaday
2011/0046715 A1 2/2011 Ugbolue et al.
2011/0210593 A1 9/2011 Klaasen et al.
2011/0282452 A1 11/2011 Koerner et al.
2012/0025574 A1 2/2012 Wilkinson et al.
2012/0061988 A1 3/2012 Jaranson et al.
2012/0119551 A1 5/2012 Brncick et al.
2012/0129416 A1 5/2012 Anand et al.
2013/0147252 A1 6/2013 Schmitz et al.
2013/0221724 A1 8/2013 Fowler
2013/0257125 A1 10/2013 Bellingar et al.
2014/0062154 A1 3/2014 Minino et al.

(56) References Cited

U.S. PATENT DOCUMENTS

| | | | |
|---|---|---|---|
| 2014/0070587 | A1 | 3/2014 | Aldricj et al. |
| 2014/0110983 | A1 | 4/2014 | Sander et al. |
| 2014/0117732 | A1 | 5/2014 | Bachar |
| 2014/0152064 | A1 | 6/2014 | Sander et al. |
| 2014/0159450 | A1 | 6/2014 | Guering |
| 2014/0159455 | A1 | 6/2014 | Thomaschewski et al. |
| 2014/0183914 | A1 | 7/2014 | Cvek |
| 2014/0265493 | A1 | 9/2014 | Machael et al. |
| 2015/0265058 | A1 | 9/2015 | Igarashi et al. |
| 2015/0296989 | A1 | 10/2015 | Machael et al. |
| 2015/0320220 | A1 | 11/2015 | Eberlein et al. |
| 2016/0029801 | A1 | 2/2016 | Potrykus et al. |
| 2016/0037931 | A1 | 2/2016 | Wu |
| 2016/0096448 | A1 | 4/2016 | Line et al. |
| 2016/0100691 | A1 | 4/2016 | Masunaga et al. |
| 2016/0135603 | A1 | 5/2016 | Chan et al. |
| 2016/0243967 | A1 | 8/2016 | Seibold |
| 2019/0014268 | A1 | 5/2019 | Liu |

FOREIGN PATENT DOCUMENTS

| | | | |
|---|---|---|---|
| CN | 202932442 | | 5/2013 |
| CN | 203524214 | | 4/2014 |
| DE | 4316057 | A1 | 11/1994 |
| DE | 102007054257 | A1 | 5/2009 |
| DE | 102008009509 | A1 | 8/2009 |
| EP | 1013198 | | 2/2004 |
| EP | 1491395 | | 12/2004 |
| EP | 2110052 | B1 | 10/2009 |
| FR | 2840786 | A1 | 12/2003 |
| GB | 1224810 | | 3/1971 |
| JP | 3974636 | | 9/2007 |
| JP | 2008000364 | | 1/2008 |
| JP | 2008237332 | | 10/2008 |
| JP | 2009268780 | A | 11/2009 |
| JP | 4462227 | | 5/2010 |
| JP | 2014054578 | | 3/2014 |
| KR | 10-1575774 | | 12/2015 |
| KR | 10-1679795 | | 11/2016 |
| WO | WO 1988/00523 | A1 | 1/1988 |
| WO | WO 1991/001210 | A1 | 2/1991 |
| WO | WO 2000/053830 | A1 | 9/2000 |
| WO | WO 01/74199 | A1 | 10/2001 |
| WO | WO 2004/032686 | A1 | 4/2004 |
| WO | WO 2004/088015 | A1 | 10/2004 |
| WO | WO 2004/104315 | A1 | 12/2004 |
| WO | WO 2007/133458 | A1 | 11/2007 |
| WO | WO 01/98105 | A1 | 12/2007 |
| WO | WO 2012/016413 | A1 | 2/2012 |
| WO | WO 2012/171911 | A1 | 12/2012 |
| WO | WO 2014/047242 | A1 | 3/2014 |
| WO | WO 2017/135831 | A1 | 8/2017 |
| WO | WO 2018/064029 | A1 | 4/2018 |

OTHER PUBLICATIONS

International Search Report and Written Opinion for International Application No. PCT/US2018/63632, dated Apr. 30, 2019.

Alderson, Andrew; "A Triumph of Lateral Thought", Chemistry & Industry, May 17, 1999, pp. 384-391.

Boulanger, PH and Hayes, M., "Poisson's Ratio for Orthorhombic Materials", Journal of Elasticity, vol. 50, 1998, (3 pgs).

Clarke, J.F., Duckett, R.A., Hine, P.J., Hutchinson, I.J., and Ward, I.M., "Negative Poisson's Ratios in Angle-Ply Laminates", Theory and Experiment: Composites, vol. 25, No. 9, 1994, (6 pgs).

Dolla, William Jacob S., Fricke, Brian A., and Becker, Bryan R.. "Structural and Drug Diffusion Models of Conventional and Auxetic Drug-Eluting Stents", Journal of Medical Devices, Mar. 2007, vol. 1, (9 pgs).

Dolla, William Jacob Spenner, "Drug Diffusion and Structural Design Criteria for Conventional and Auxetic Drug-Eluting Stents", A Dissertation in Engineering and Chemistry Presented to the Faculty of UMKC, 2006 (149 pgs).

Evans, K.E., Donoghue, J.P., and Alderson, K.L., "The Design, Matching and Manufacture of Auxetic Carbon Fibre Laminates", Journal of Composite Materials, vol. 38, No. 2, 2004 (12 pgs).

Hine, P.J., Duckett, R.A., and Ward, I.M., "Negative Poisson's Ratio in Angle-ply Laminates", Journal of Materials Science Letters, vol. 16, 1997 (4 pgs).

Lakes, Roderic, "Foam Structures with a Negative Poission's Ratio: American Association for the Advancement of Science", Science, New Series, vol. 235, No. 4792, Feb. 27, 2987, pp. 1038-1040.

Lakes, R.S. and Elms, K., "Indentability of Conventional and Negative Poisson's Ratio Foams", Journal of Composite Materials, vol. 27, No. 12., 1993 (10 pgs).

Notice of Publication for International Application No. PCT/US2017/053409 dated Apr. 5, 2018 (1 pg).

Roguin, Ariel and Beyar, Rafael, "BeStent—The Serpentine Balloon Expandable Stent", Review of Mechanical Properties and Clinical Experience, Artificial Organs, vol. 22, No. 3, 1998, pp. 243-249.

Warren, Thomas L., "Negative Poisson's Ratio in a Transversely Isotropic Foam Structure", Journal of Applied Physics, 1990, (5 pgs).

Windecker, Stephan, Roffi, Marco and Meier, Bernhard, Sirolimus Eluting Steng, "A New Era in Interventional Cardialogy?", Current Pharmaceutical Design, 2003, vol. 9, pp. 1077-1094.

Extended European Search Report dated Jul. 22, 2021 for EP Application No. 18886552.1 (8 pgs).

* cited by examiner

COMPLIANT BACKREST

This application is a continuation of U.S. application Ser. No. 16/208,206, filed Dec. 3, 2018, which application claims the benefit of U.S. Provisional Application No. 62/594,885, filed Dec. 5, 2017 and entitled "Compliant Backrest," and the benefit of U.S. Design application Nos. 29/628,523; 29/628,526; 29/628,528; and Ser. No. 29/628,527, each also filed Dec. 5, 2017, including that the entire disclosure of each of the foregoing applications is incorporated herein by reference.

FIELD OF THE INVENTION

The present application relates generally to a backrest, and in particular to a compliant backrest, and various office furniture incorporating the backrest, together with methods for the use and assembly thereof.

BACKGROUND

Chairs, and in particular office chairs, are typically configured with a backrest having one or more body support surfaces. The support surfaces may be made of various materials, including for example and without limitation foam, elastomeric membranes or plastic shells. Foam materials may limit air circulation and often do not provide localized support. Elastomeric membranes, and other similar materials, typically lie flat when not loaded, must be tensioned and do not provide good shear resistance. Conversely, backrests configured with plastic shells, supported for example by peripheral frames, typically do not provide a comfortable body-conforming support surface.

SUMMARY

The present invention is defined by the following claims, and nothing in this section should be considered to be a limitation on those claims.

In one aspect, one embodiment of a backrest includes a peripheral frame defining a central opening. The frame has a pair of laterally spaced upright members connected with longitudinally spaced upper and lower members. A flexible shell has opposite sides coupled to the upright members and upper and lower portions coupled to the upper and lower members. The shell includes first and second slots extending longitudinally along opposite sides of the shell inboard of locations where the shell is connected to the upright members, and one or more third slots extending laterally along the lower portion of the shell above a location where the shell is connected to the lower member. The terminal ends of the one or more third slots are spaced apart from lower terminal ends of the first and second slots, with first and second bridge portions defined between the terminal ends of the third slot and the lower terminal ends of the first and second slots.

In another aspect, one embodiment of a method for supporting the body of a user in a chair includes leaning against a backrest and moving a portion of the shell adjacent the first, second and third slots relative to the frame.

In another aspect, one embodiment of the backrest includes a shell including a molded component having a three-dimensional shape in a non-loaded configuration. The shell has a forwardly facing convex shape along a vertical centerline and a forwardly facing concave shape along a horizontal centerline in the non-loaded configuration. The shell further includes a plurality of openings arranged in an area overlying the central opening. The shell has flush front and rear surfaces in the area overlying the central opening. The plurality of openings is configured in one embodiment as a matrix of openings providing independent lateral and longitudinal expansion of the shell relative to the frame.

In another aspect, one embodiment of a method for supporting the body of a user in a chair includes leaning against a backrest, laterally expanding the shell across the matrix of openings, and longitudinally expanding the shell across the matrix of openings independent of the laterally expanding the shell.

In another aspect, the shell has various structures and devices for providing different levels of compliance, including means for providing macro compliance and means for providing micro compliance.

The various embodiments of the backrest and methods provide significant advantages over other backrests. For example and without limitation, the openings and slots provide compliance in the backrest, allowing it to move and conform to the user during use, even when bounded by a peripheral frame. At the same time, the openings provide excellent air circulation. The slots also serve to guide, and allow pass through of, an auxiliary body support member, for example and without limitation a lumbar support, which may be moved along a forwardly facing body support surface of the shell, but with a user interface disposed along the rear of the backrest In addition, the backrest may be configured with a three-dimensional contour in a non-loaded configuration, while maintaining the ability to move and adapt to the user when loaded.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1A:
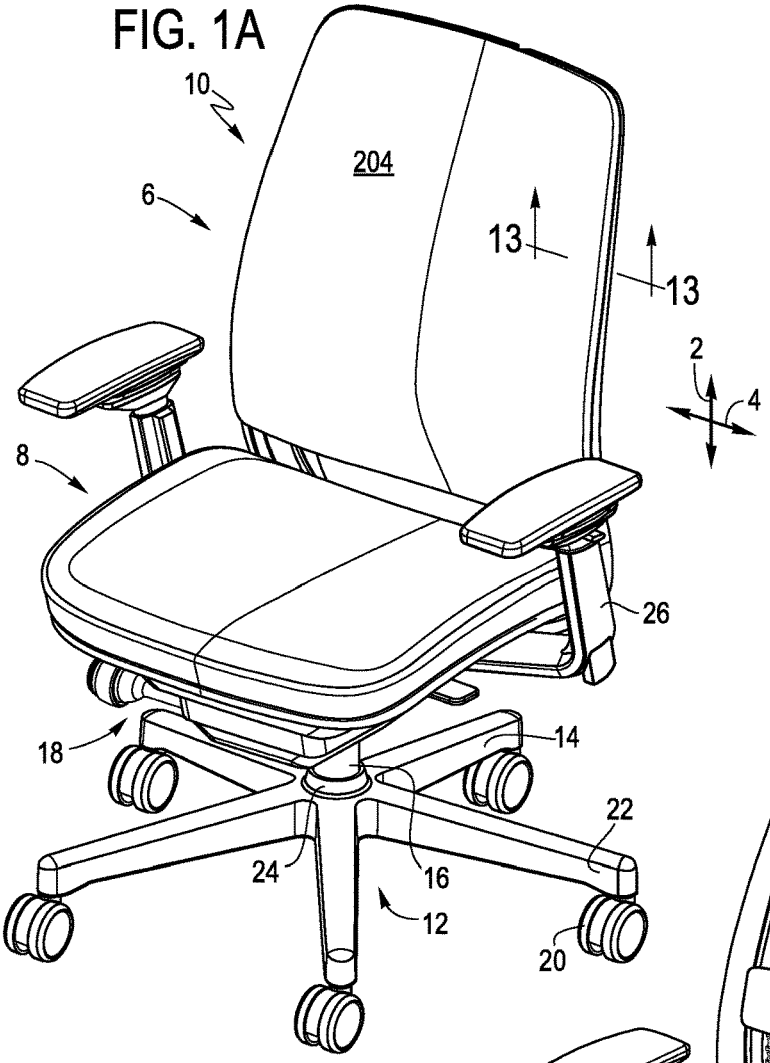
FIGS. 1A-C are front perspective views respectively of a chair having a backrest with an upholstered front surface, a backrest including an auxiliary body support member without an upholstered front surface and a backrest without a lumbar or upholstered front surface.
Figure 1B:
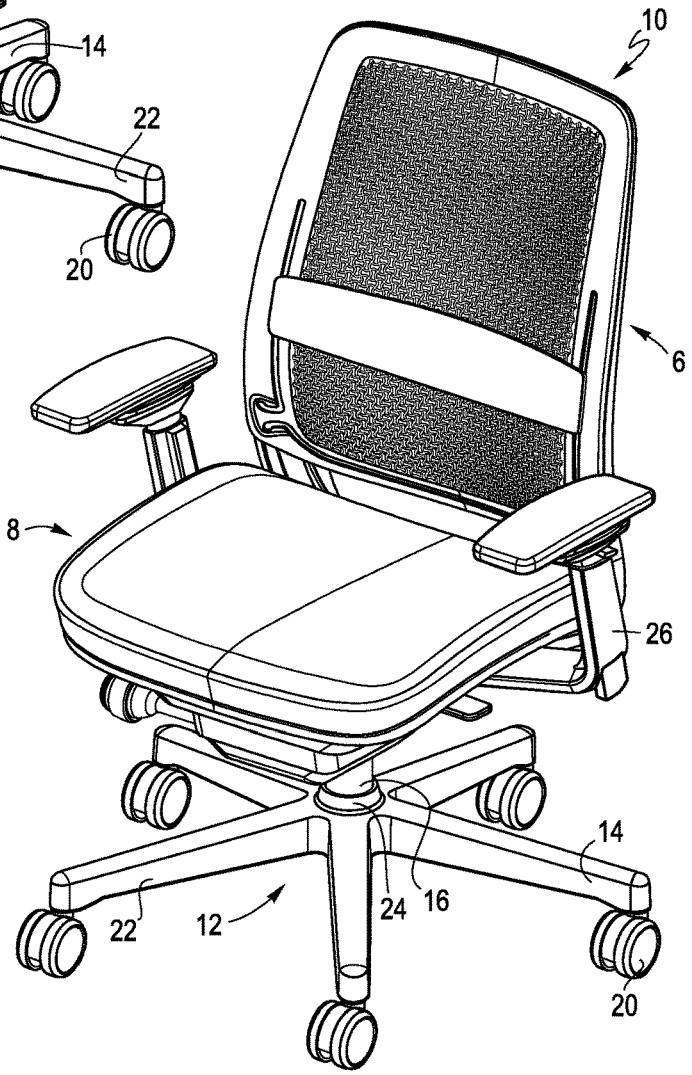
Figure 1C:
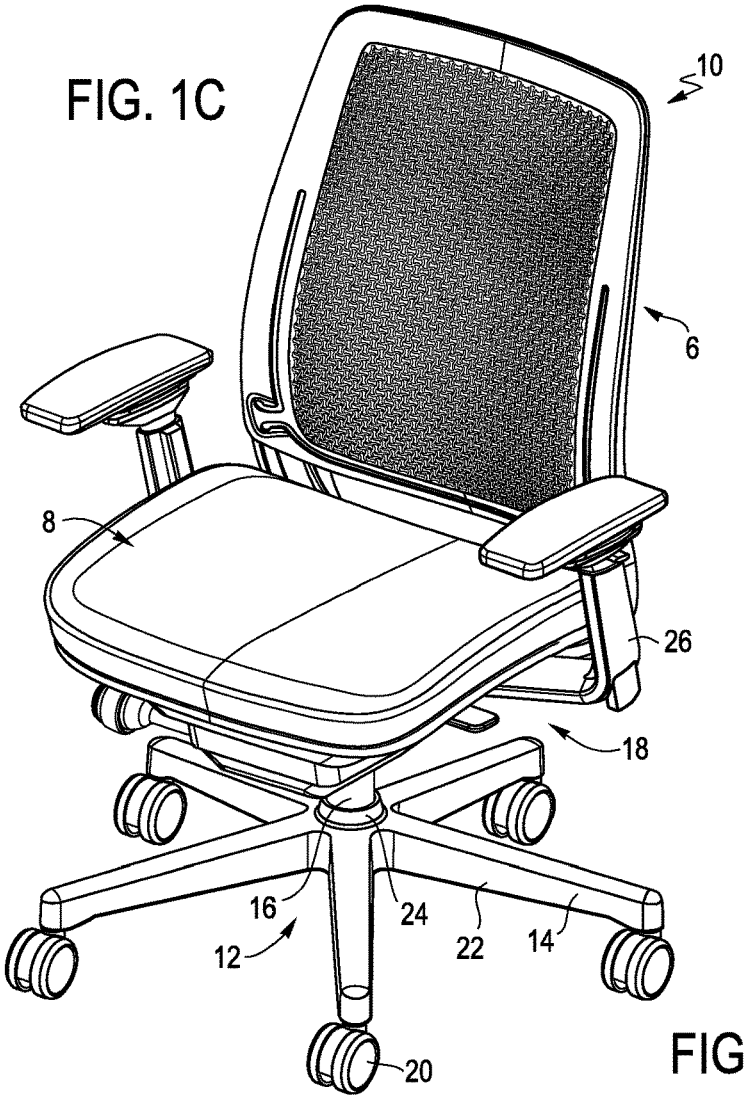
Figure 2:
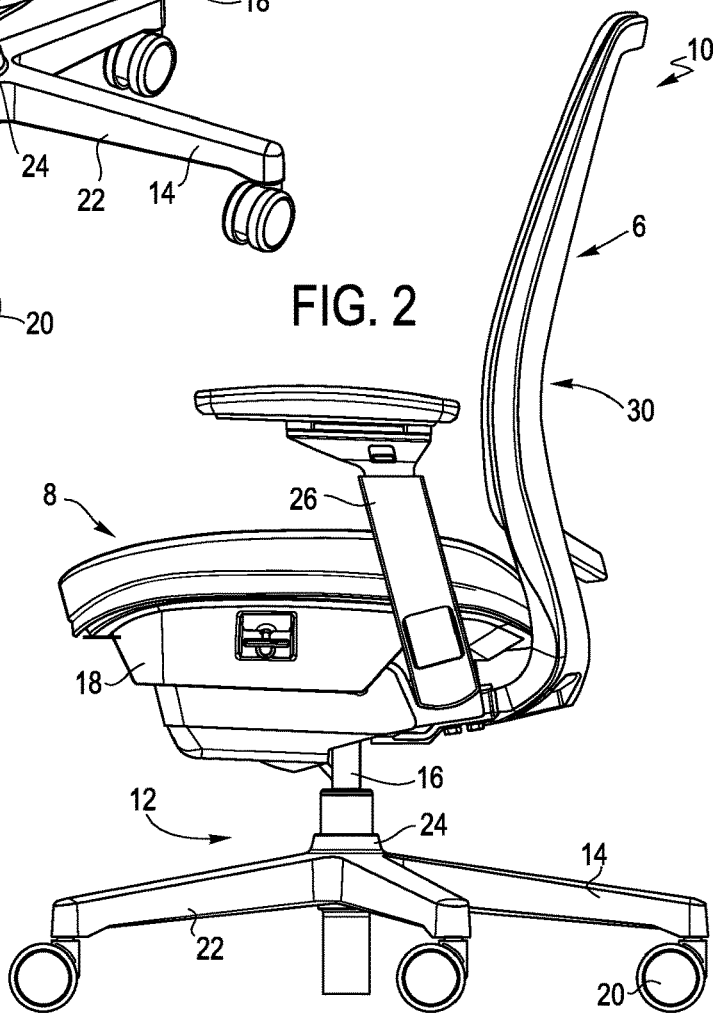
FIG. 2 is a side view of the chair shown in FIGS. 1A-1C.

It should be understood that the term "plurality," as used herein, means two or more. The term "longitudinal," as used herein means of or relating to a length or lengthwise direction 2, for example a direction running from the bottom of a backrest 6 to the top thereof, or vice versa, or from the front of a seat 8 to the rear thereof, or vice versa. The term "lateral," as used herein, means situated on, directed toward or running in a side-to-side direction 4 of a chair 10, backrest 6 or seat 8. In one embodiment of a backrest disclosed below, a lateral direction corresponds to a horizontal direction and a longitudinal direction corresponds to a vertical direction. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of the exemplary chair 10 as shown in FIGS. 1A-6, with a user seated therein. The term "transverse" means non-parallel.

Chair:

Referring to FIGS. 1A-6, a chair 10 is shown as including a backrest 6, a seat 8 and a base structure 12. In one embodiment, the base structure 12 includes a leg assembly 14, a support column 16 coupled to and extending upwardly from the leg assembly and a tilt control 18 supported by the support column. The leg assembly may alternatively be configured as a fixed structure, for example a four legged base, a sled base or other configuration. In one embodiment, the support column may be height adjustable, including for example and without limitation a telescopic column with a pneumatic, hydraulic or electro-mechanical actuator. The leg assembly 14 includes a plurality of support legs 22 extending radially outwardly from a hub 24 surrounding the support column. Ends of each support leg may be outfitted with a caster, glide or other ground interface member 20. The tilt control 18 includes a mechanism for supporting the seat 8 and backrest 6 and allowing for rearward tilting thereof. A pair of armrests 26 are coupled to the tilt control structure, base and/or backrest support structure. It should be understood that the chair may be configured without any armrests on either side. Various user interface controls are provided to actuate and/or adjust the height of the seat, the amount of biasing force applied by the tilt control mechanism and/or other features of the chair. Various features of the chair, including without limitation the base, seat and tilt control are disclosed in U.S. Pat. Nos. 7,604,298 and 6,991,291, both assigned to Steelcase Inc., the entire disclosures of which are hereby incorporated herein by reference.

Figure 4A:
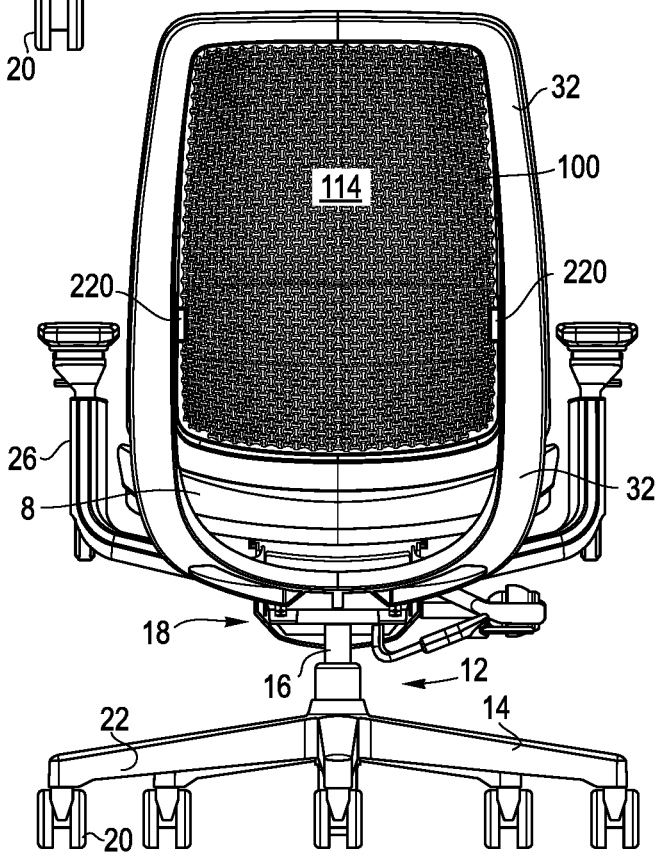
FIGS. 4A-C are rear views respectively of a chair having a backrest with an upholstered front surface, a backrest including an auxiliary body support member without an upholstered front surface and a backrest without a lumbar or upholstered front surface.
Figure 4B:
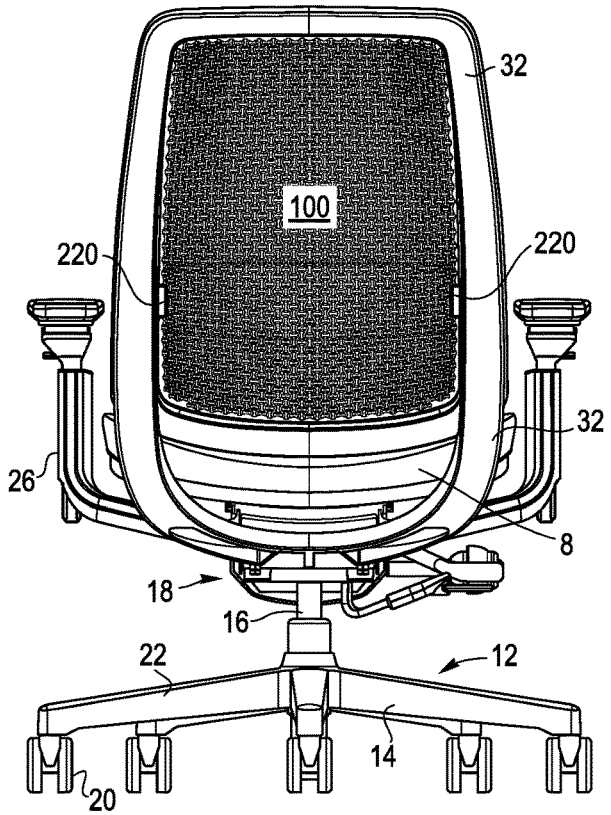
Figure 4C:
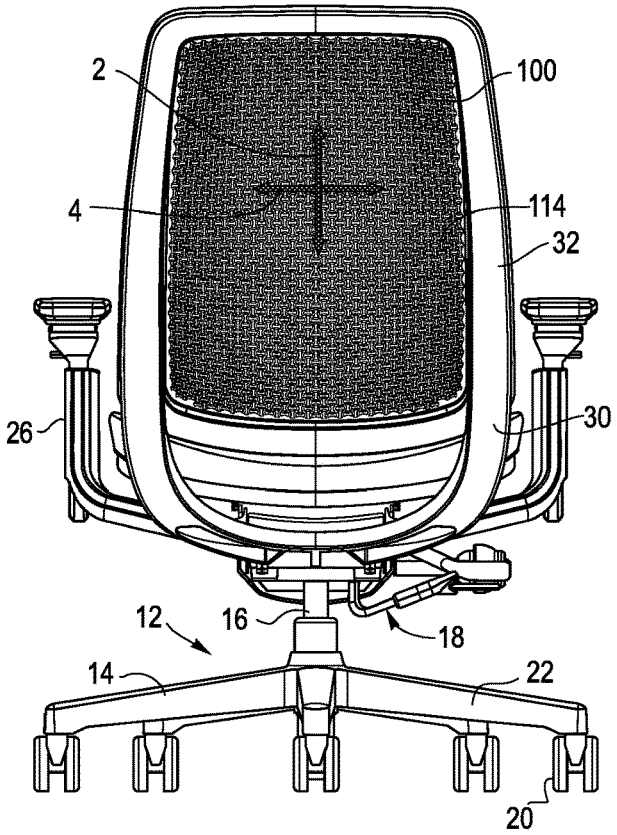
Figure 5A:
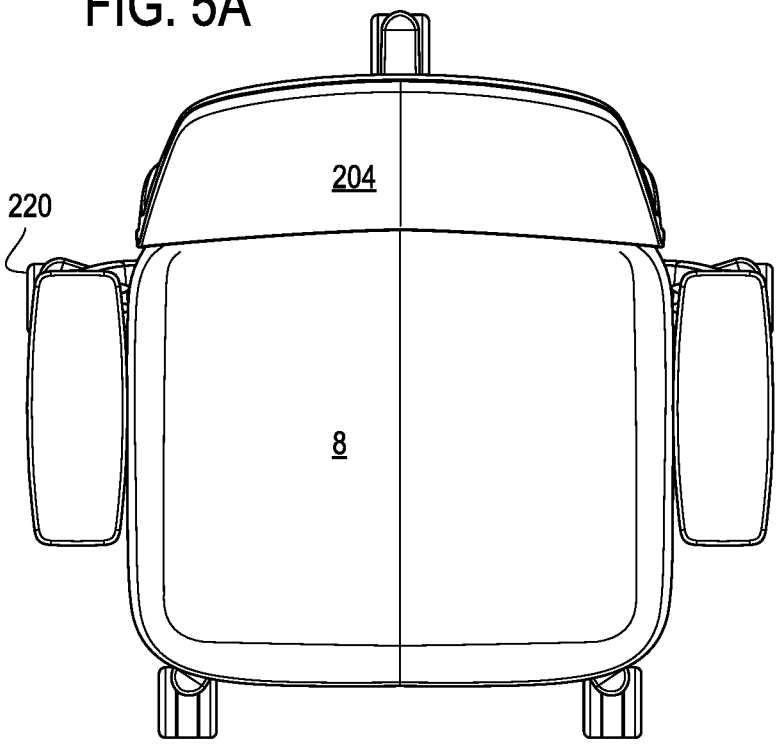
FIGS. 5A and B are top views respectively of a chair having a backrest with and without an upholstered front surface.
Figure 5B:
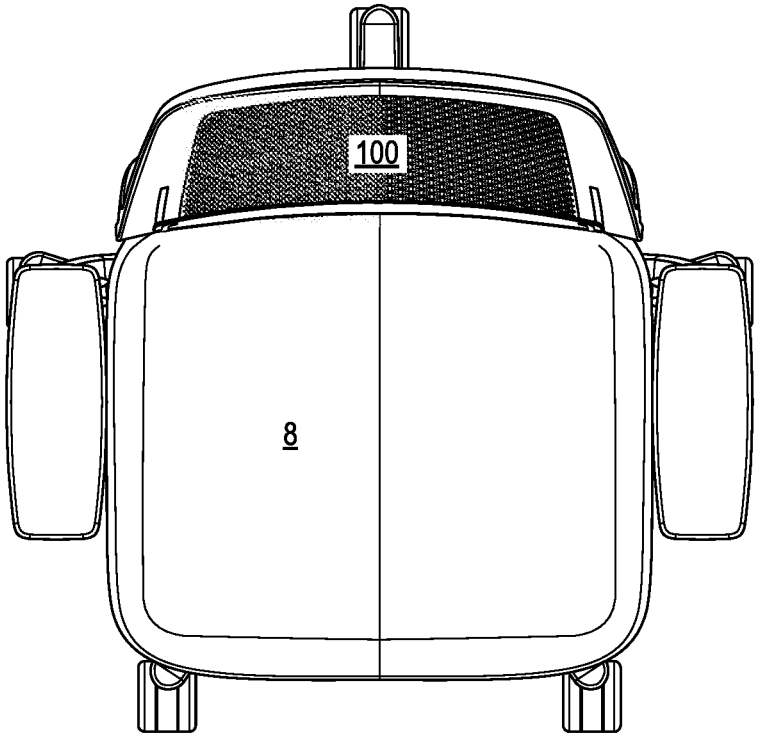
Figure 6:
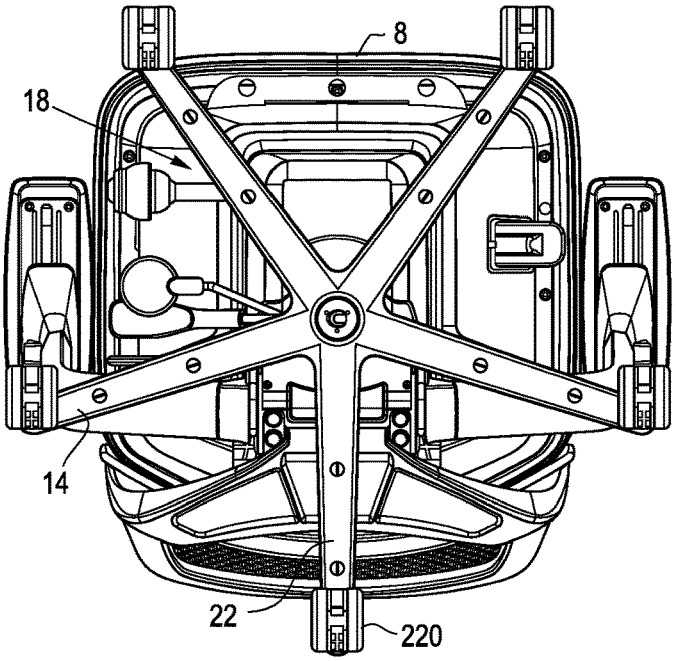
FIG. 6 is a bottom view of the chair shown in FIGS. 1A-C.
Figure 7A:
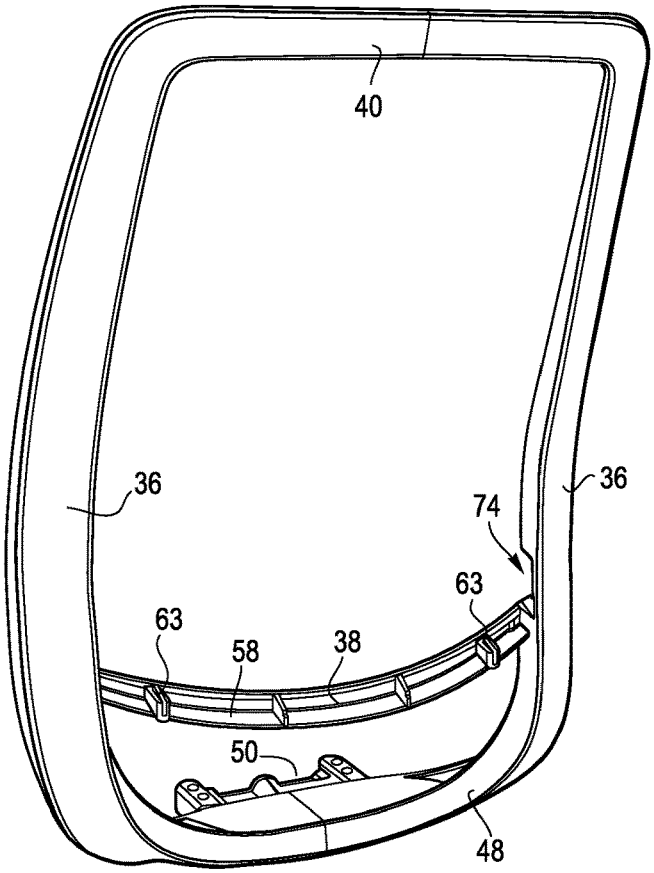
FIGS. 7A and B are rear and front perspective views of a primary frame.
Figure 7B:
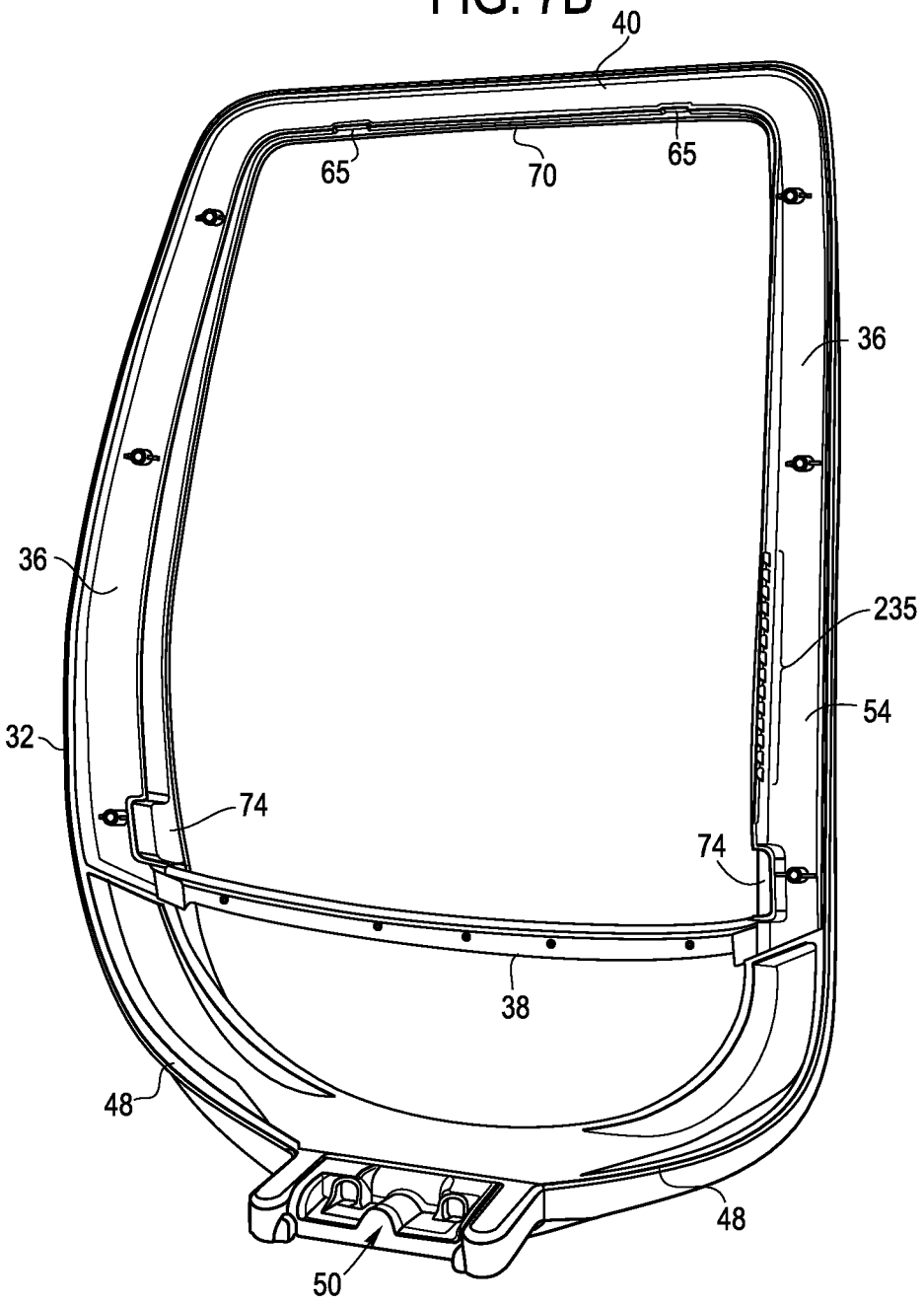
Figure 18:
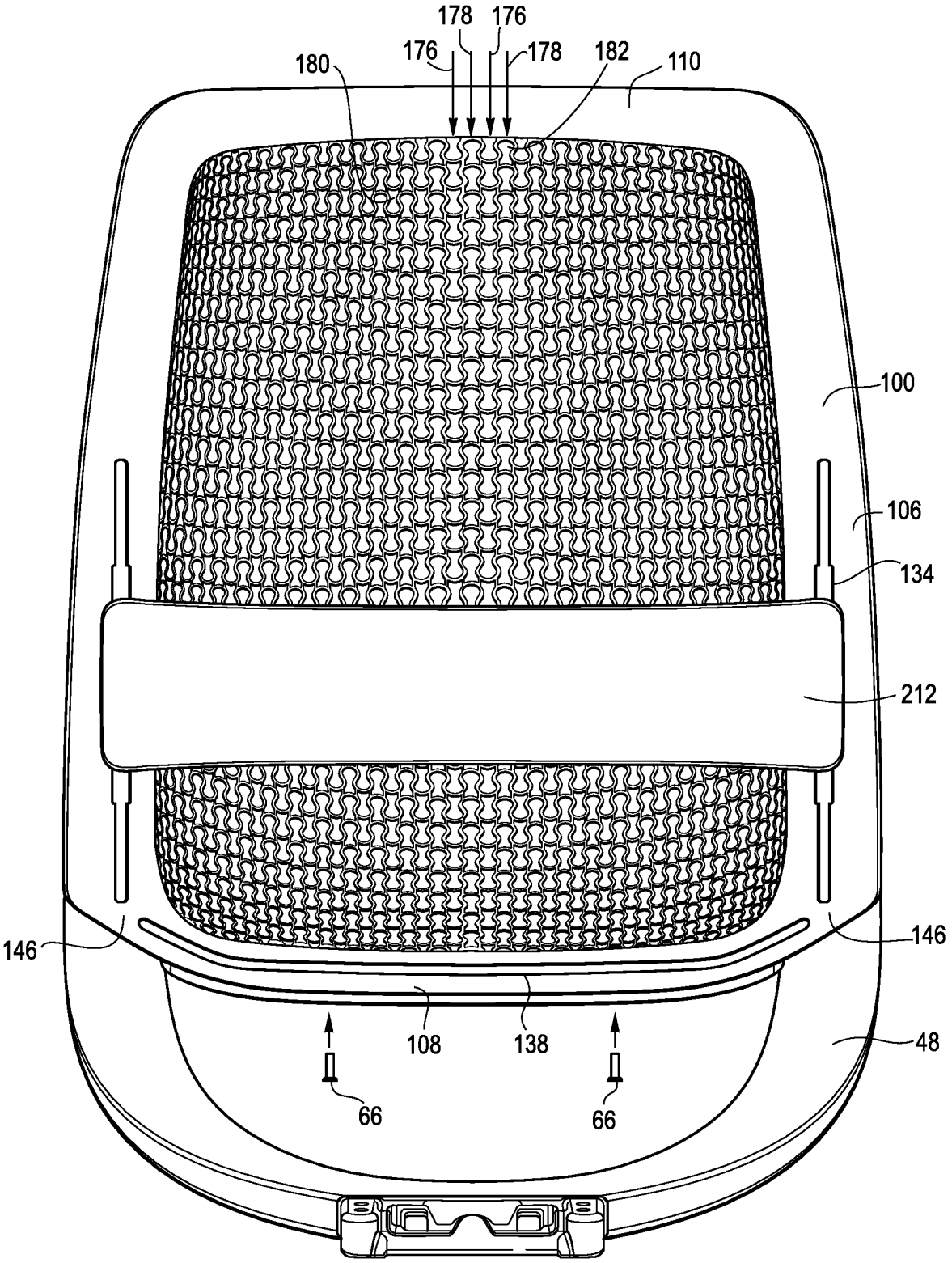
FIG. 18 is a front view of an alternative embodiment of a backrest.

Backrest Frame Assembly:

The backrest 6 includes a frame assembly 30 including a primary frame 32 and a secondary frame 34. Both of the primary and secondary frames are configured as peripheral frames, each having a pair of laterally spaced upright members 36, 42 connected with longitudinally spaced upper members 40, 46 and lower members 38, 44. As shown in FIGS. 4B and 18, the lower member 38 of the primary frame is configured as a cross-piece connecting the two uprights 36. The uprights 36 extend below the cross-piece 38 and transition laterally inwardly and longitudinally forwardly, where end portions 48 thereof are joined at a vertex to define a support member 50, which is coupled to the tilt control 18. It should be understood that, in other embodiments, the frame may be configured as a unitary member, and may configured as a homogenous ring-like frame. It also should be understood that the frame may be connected to a static structure, rather than a tilt control, and may be provided as a component of a chair, sofa, stool, vehicular seat (automobile, train, aircraft, etc.), or other body supporting structure.

Referring to FIGS. 4A-C, 7A-8B, 17A and B, the secondary frame 34 is nested in the primary frame 32 with a rear surface 52 of the upright members 42 and upper member 46 of the secondary frame overlying a front surface 54 of corresponding upright member 36 and upper member 40 of the primary frame. The lower member 44 of the secondary frame has a C-shaped cross section that surrounds the lower member 38 (cross-piece) of the primary frame, with a rear wall 56 of the secondary frame overlying and covering a rear surface 58 of the lower member of the primary frame. The upright members are secured with a plurality of fasteners 60, shown as being positioned at three longitudinally spaced locations 61 along each upright. The fasteners 60 may include for example mechanical fasteners such as screws, snap-fit tabs, Christmas tree fasteners, rivets and other know devices. The lower member 44 of the secondary frame has forwardly extending upper and lower flanges 62, 64. The lower flange 64 is secured to the bottom of the lower member 38 of the primary frame with a plurality of fasteners 66, shown at two laterally spaced locations 63. The fasteners may include for example mechanical fasteners such as screws, snap-fit tabs, Christmas tree fasteners, rivets and other known devices. The upper flange 62 and rear wall 56 have an uninterrupted, smooth surface so as to provide a pleasing and finished aesthetic. Likewise, the uprights 36 and upper member 40 of the primary frame 32 each define channels having forwardly extending flanges coupled to rear walls, all with an uninterrupted, smooth surface so as to provide a pleasing and finished aesthetic. The upper member 46 of the secondary frame has a rearwardly extending flange 68 that overlies a forwardly extending flange 70 of the upper member of the primary frame. The overlying flanges 68, 70 are secured with a plurality of fasteners 72, shown at two laterally spaced locations 65. The fasteners may include for example mechanical fasteners such as screws, snap-fit tabs, Christmas tree fasteners, rivets and other known devices. In other embodiments, the frames 32, 34 may be bonded, for example with adhesives, may be secured with a combination of adhesives and mechanical fasteners, may be over molded, or co-molded as a single component. The uprights of the primary frame have a pair of cutouts, or relief spaces 74, formed immediately above the cross-piece, with the secondary frame having opposite boss structures 76, which are received in the cutouts and help locate and stabilize the frame members relative to each other.

The secondary frame 34 has three key-hole slots 78 arranged along each of the uprights. In one embodiment, the key-hole slots are positioned adjacent to, but spaced from, the locations 61 receiving fasteners securing the frames 32, 34. Each key-hole slot is configured with an enlarged opening 80, having a generally rectangular shape, and a finger opening 82 extending downwardly from the enlarged opening. The finger opening is narrower in width than the enlarged opening but shares and defines a common side edge 84. The key-hole slot defines a corner flange 86, which interfaces with a shell connector as explained in more detail below.

Figure 8A:
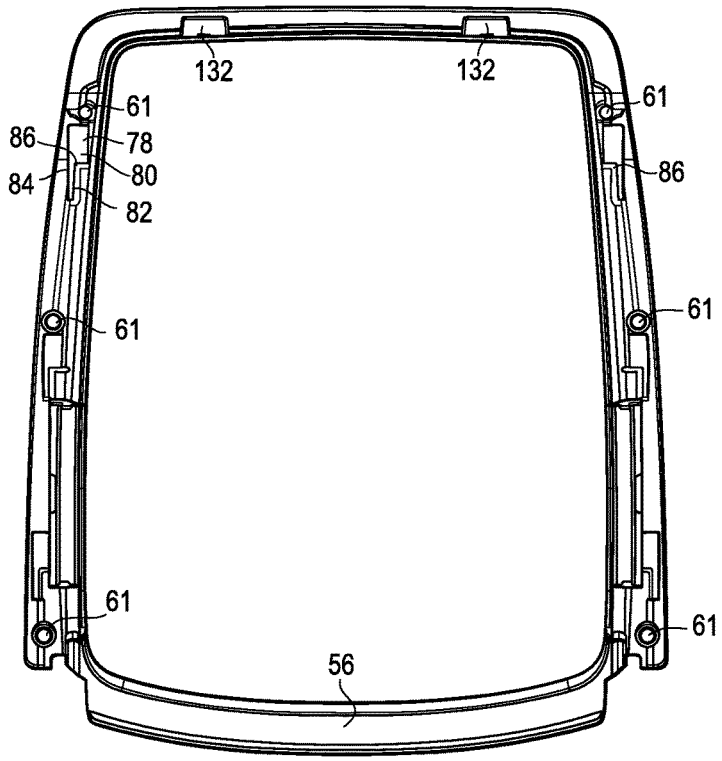
FIGS. 8A and B are rear and front perspective views of a secondary frame.
Figure 8B:
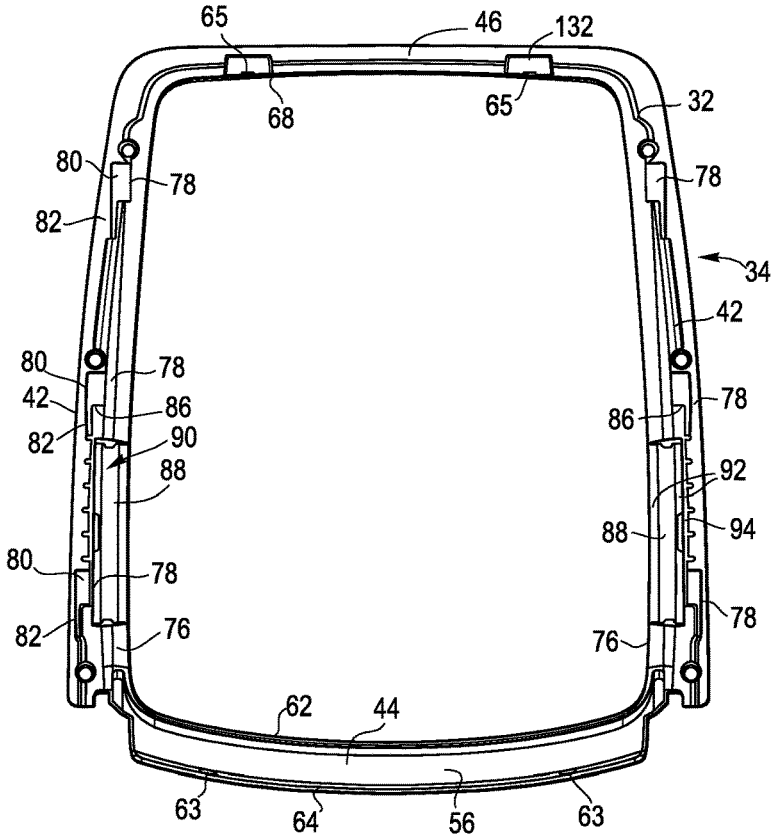
Figure 9:
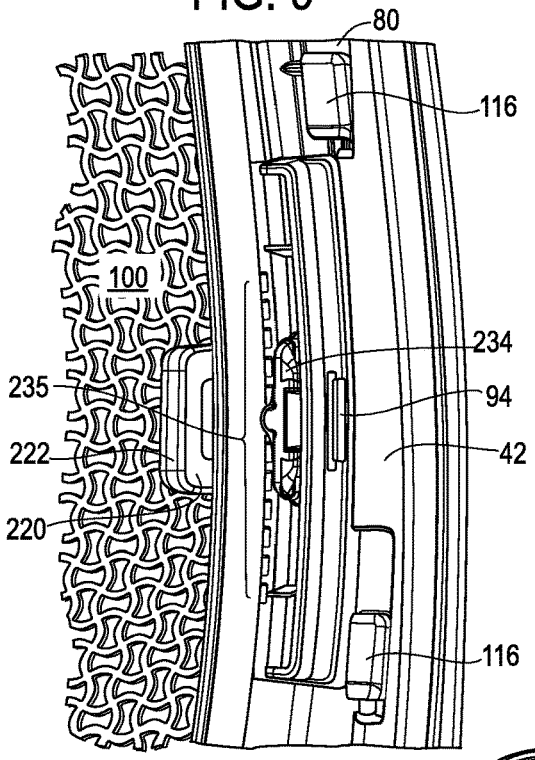
FIG. 9 is an enlarged partial view of an interface between a backrest shell, secondary frame and auxiliary body support member.

Referring to FIG. 8B, the secondary frame 34 has a longitudinally extending through slot 88 formed along a portion of each upright thereof. In one embodiment, the through slots are positioned in a lower half of each upright. A cavity 90 is formed on the front side of the through slots, with a pair of slide surfaces 92 formed on each side of the slot. In addition, a longitudinally extending slot 94 is disposed through an outboard one of the slide surfaces adjacent the slots 88. The slot 94 is shorter in length than the slots 88.

In an alternative embodiment, the frame, including one or both of the primary and secondary frame members, may be configured with only a pair of laterally spaced uprights, for example without an upper or lower member, or with only a lower member, or alternatively with a pair of uprights connected with a laterally extending cross brace that may not define a corresponding member that is secured to a shell as further explained below.

Shell:

Referring to FIGS. 3C, 4C, 10-14, a flexible shell 100 is shown as including a molded component having and maintaining a three-dimensional shape in a non-loaded configuration. A "non-loaded" configuration is defined as a configuration where no external loads are being applied to the shell other than gravity. In one embodiment, the three-dimensional shape includes the shell having a forwardly facing convex shape taken along a vertically or longitudinally extending centerline $V_{cl}$ of the shell, and a forwardly facing concave shape taken along a horizontally or laterally extending centerline $H_{cl}$. In one embodiment, the shell is preferably made of polypropylene. In other embodiments, the shell may be made of nylon, ABS, PET or combinations thereof. The shell may have a variable thickness (front to back), for example including and between 1.50 mm and 6.00 mm, or more preferably including and between 2.5 mm and 4.5 mm, which results in various regions of the shell being stiffer than others. In one embodiment, the shell has a thickness of about 4.5 mm along the apex of the lumbar region, and a thickness of about 2.5 mm along the outer edges of a central region. The stiffer a region is the less it deflects in response to a load being applied thereto, for example with a pusher pad or block (e.g., 1 square inch in surface area) applying a load (e.g., 30 to 40 lbf) against a front surface of the shell.

The shell has a central region 102 configured with a plurality of openings 150 and a ring-like peripheral edge portion 104, including opposite side portions 106 and lower and upper portions 108, 110, surrounding the central region. While the shell has a three-dimensional curved configuration defining the central region, the central region has flush front and rear surfaces 112, 114, meaning the region is generally curvi-planar, or defined by a plurality of smooth curves, but is free of any local protuberances and is smooth or uniform across the length or height thereof. Put another way, the shell does not have any discrete or local structures that extend transfer to a tangent taken at any point of the curved surface. The surfaces are also free of any repetitive oscillations or undulations, with a single concave and/or convex curve contained within the width and height of the central region, configured for example as a ½ cycle sinusoidal wave. It should be understood that the surface may have a compound convex and concave shape, but will not contain more than one of either shape in a preferred embodiment.

Figure 10:
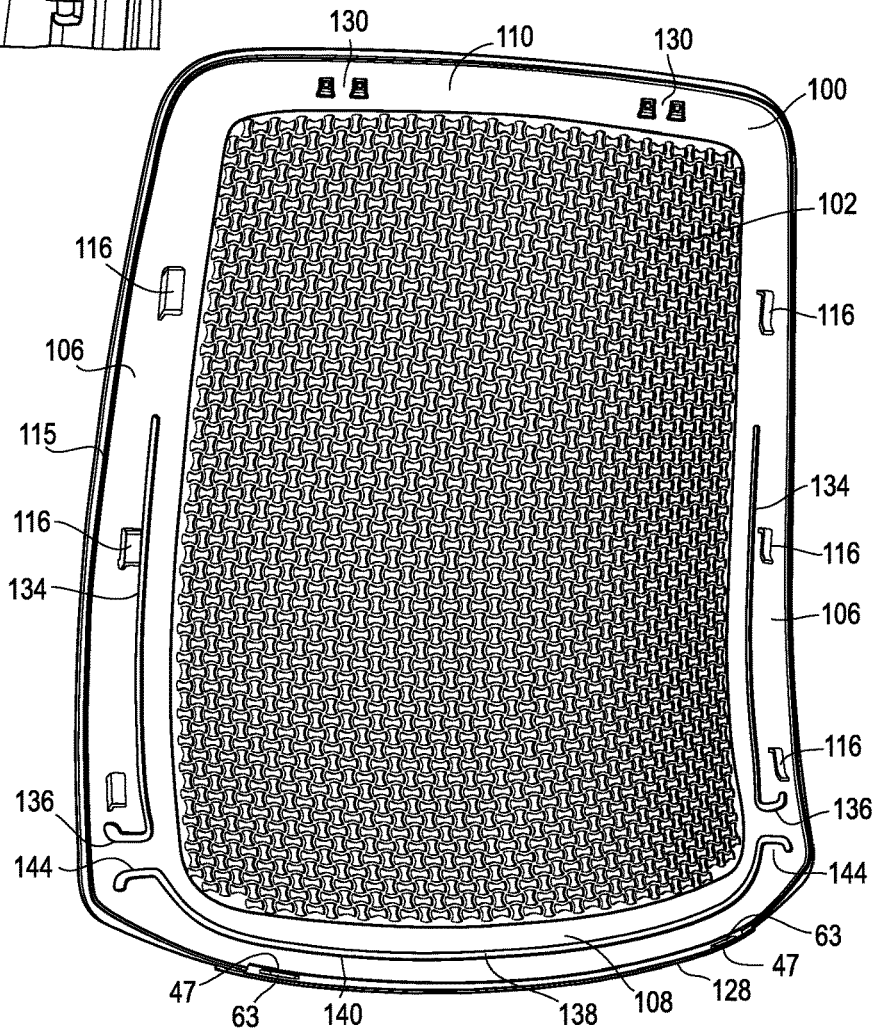
FIG. 10 is a perspective view of one embodiment of a flexible shell.
Figure 11:
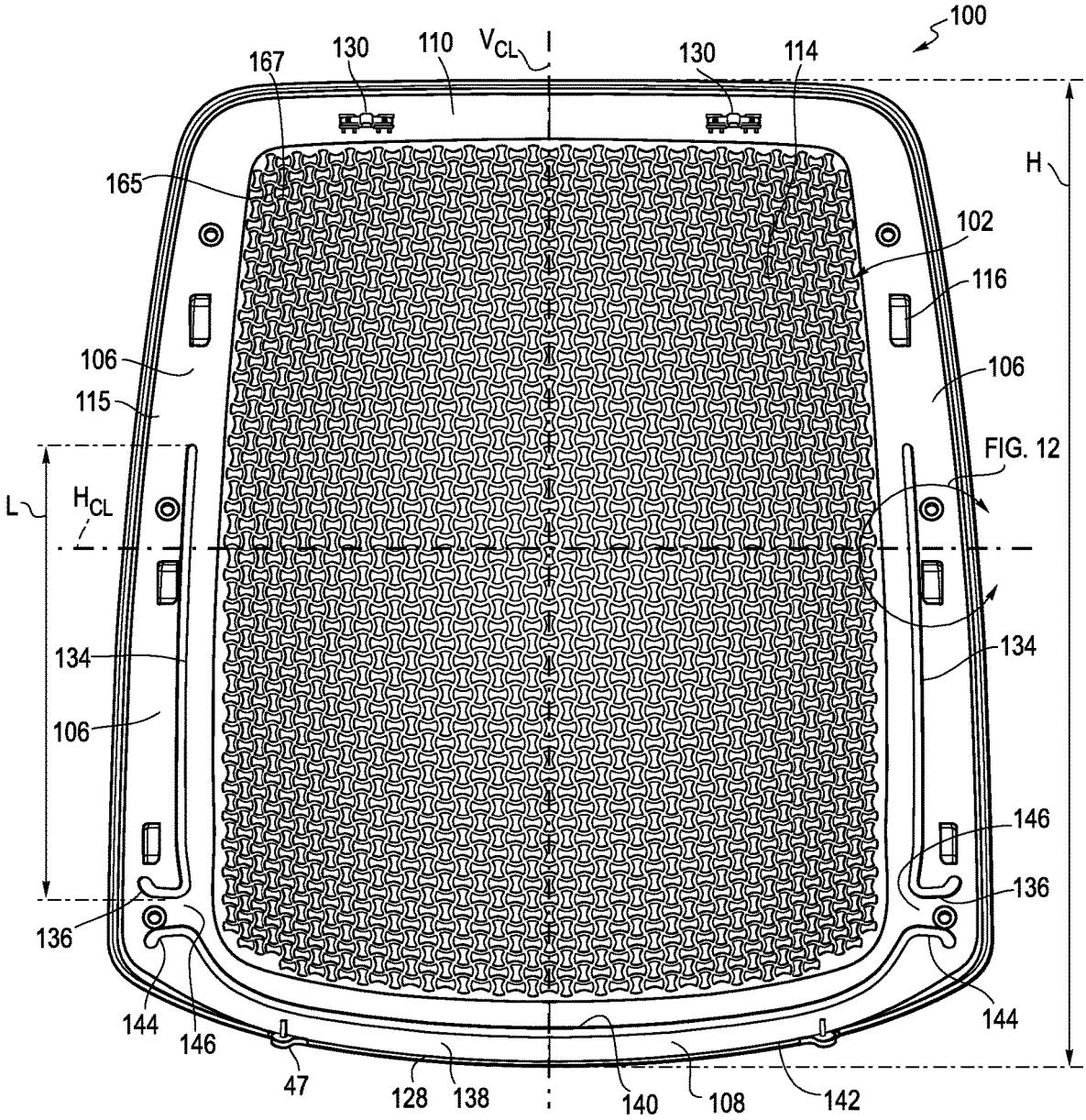
FIG. 11 is a rear view of the shell shown in FIG. 10.
Figure 12:
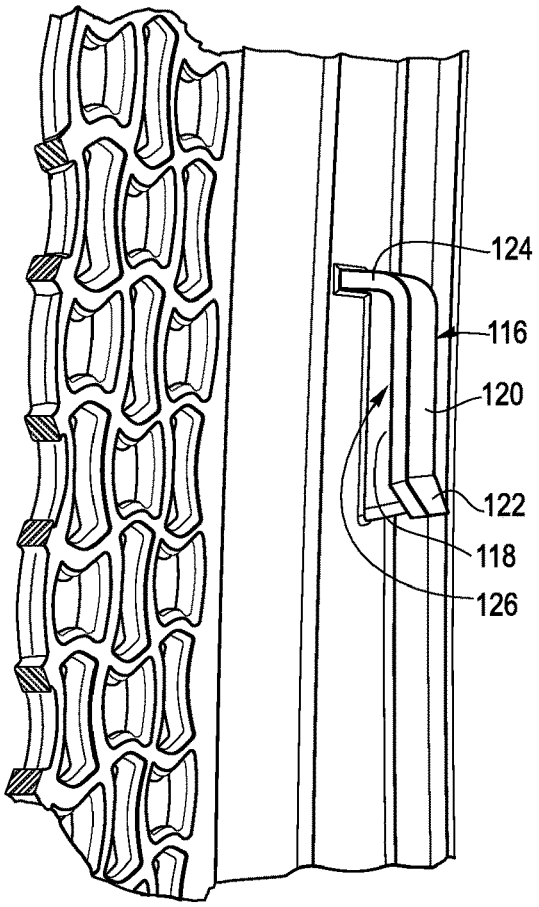
FIG. 12 is an enlarged perspective view taken along line 12 of FIG. 11 and showing a shell connector.
Figure 15:
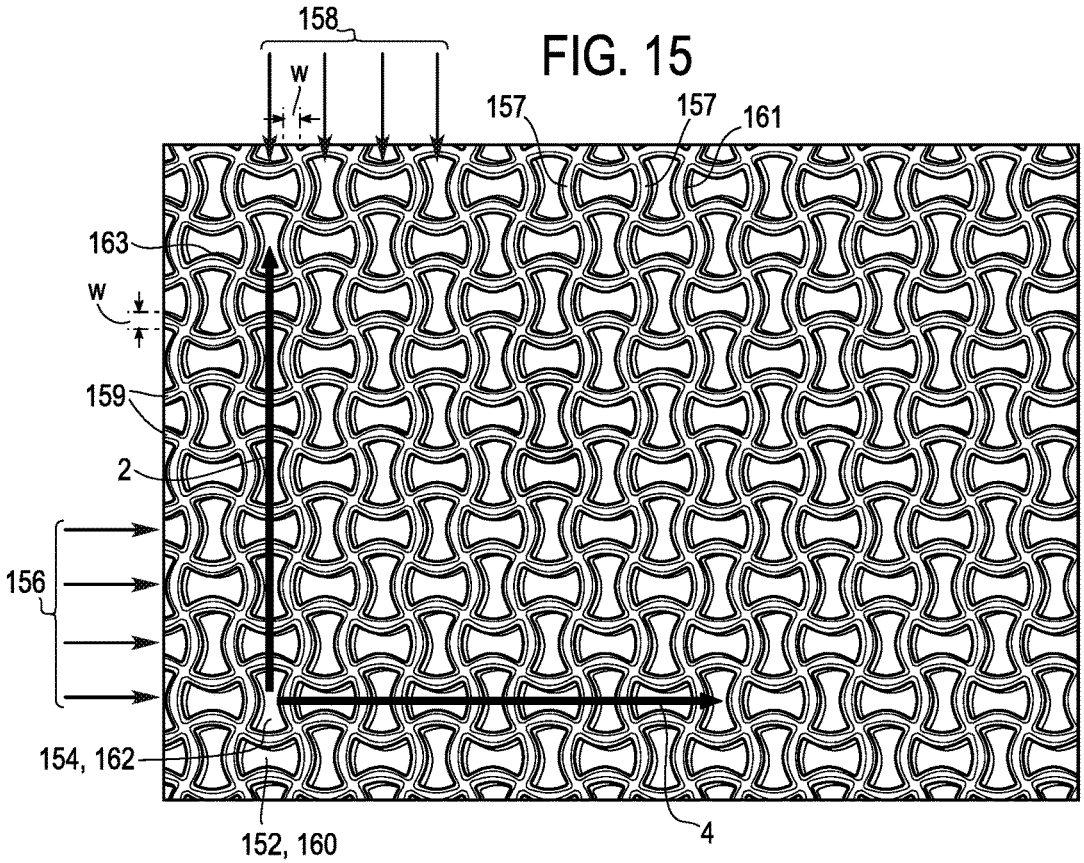
FIG. 15 is an enlarged partial view of one embodiment of a matrix of openings incorporated into the flexible shell.

Referring to FIGS. 10, 11 and 15, the shell, and in particular the central region, is configured with a network of webs or strips 157, 159 that define the openings there between. For example, as shown in FIG. 15, the network includes a plurality of longitudinally extending strips 157 that intersect a plurality of laterally extending strips 159 and define the openings 150 there between. In one embodiment, the strips 157, 159 are each configured as sinusoidal or undulating waves formed within the curviplanar/curved surface of the shell, which is the cross-section of the shell defined by and including all midpoints of the thickness of the shell. In one embodiment, the strips 157, 159 are arranged such that adjacent longitudinal strips 157 and adjacent lateral strips 159 are offset ½ wave length, such that the adjacent longitudinal strips, and adjacent lateral strips, undulate toward and away from each other to define the openings 150 as further described below.

In this way, the strips 157 are non-linear between the lower and upper portions 108, 110, and the strips 159 are non-linear between the opposite side portions 106. Under a load, the non-linear strips tend to straighten, allowing for the shell to expand when the load (e.g. normal) is applied to the front surface thereof. In contrast to linear strips, which need to stretch to provide such expansion, the non-linear strips achieve this expansion through a geometric arrangement. It should be understood that the phase "non-linear" refers to the overall configuration of the strips between the upper and lower portions, or between the side portions. As such, a strip may be non-linear even though it is made up of a one or more linear segments, as shown for example in FIG. 14.

Front surfaces 161, 163 and rear surfaces 165, 167 of the strips define the front and rear surfaces 112, 114 of the shell. In various embodiments, as noted above, the strips have a thickness including and between 1.50 mm and 6.00 mm, or more preferably including and between 2.5 mm and 4.5 mm defined between the front and rear surfaces 112, 114. The strips have a width W (see FIG. 15) including and between 1.00 mm and 4.00 mm, and in one embodiment a width of 2.5 mm. In one embodiment, the webs or strips each have the same width W. In other embodiments, the webs or strips have different widths. In either case, the webs or strips may have a uniform thickness, or may have variable thicknesses.

The shell 100 is shear resistant, meaning it does not deform locally in response to the application of shear forces applied over a distance, as would a fabric or elastomeric membrane. In one embodiment, the Young's Modulus of the shell material is E≥100,000 PSI.

As shown in FIGS. 9-12, a plurality of connectors 116, shown as three, are formed on the rear surface of the side portions 106. The connectors are configured with a side wall 118, a longitudinally extending flange 120 having an outwardly turned lip 122 and an end wall or stop member 124 connecting the side wall and flange so as to define a three-sided cavity 126. The connectors interface with the key-hole slots on the secondary frame to secure the shell to the secondary frame. Specifically, the connectors are inserted through the enlarged opening 80, with the secondary frame and shell then being moved longitudinally relative to each other such that the lip 122 first engages and rides over the corner flange 86 until the flanges 120, 86 are overlying and the side wall 118 is disposed in the finger opening 82 and engages an edge of the corner flange 86. The interface between the connector 116 and corner flange 86 connects the shell and secondary frame in a non-rotationally fixed relationship, meaning the peripheral edges of the shell and secondary frame are prevented from being rotated relative to each other, for example about a longitudinally extending axis. It should be understood that in one embodiment, the shell may only be attached to the uprights of the frame, meaning the upper and lower portions of the shell remain free of any connection to the frame.

Figure 13:
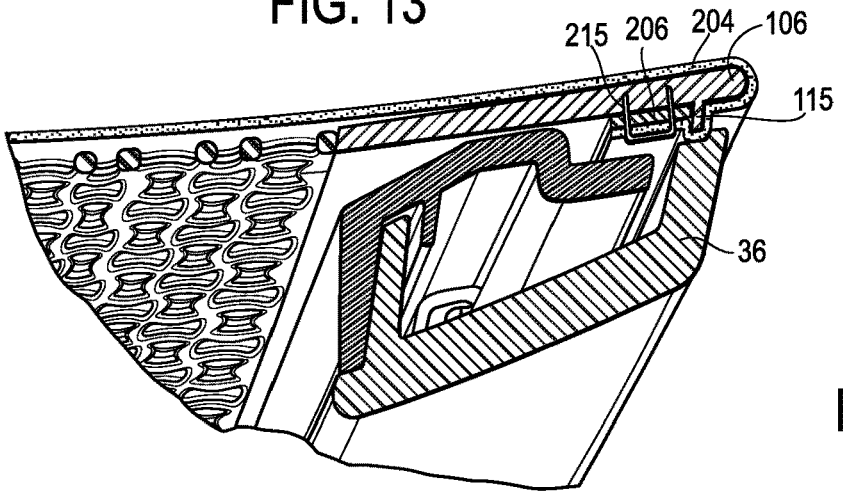
FIG. 13 is a partial cross-sectional view of the shell, secondary frame and upholstery.
Figure 20:
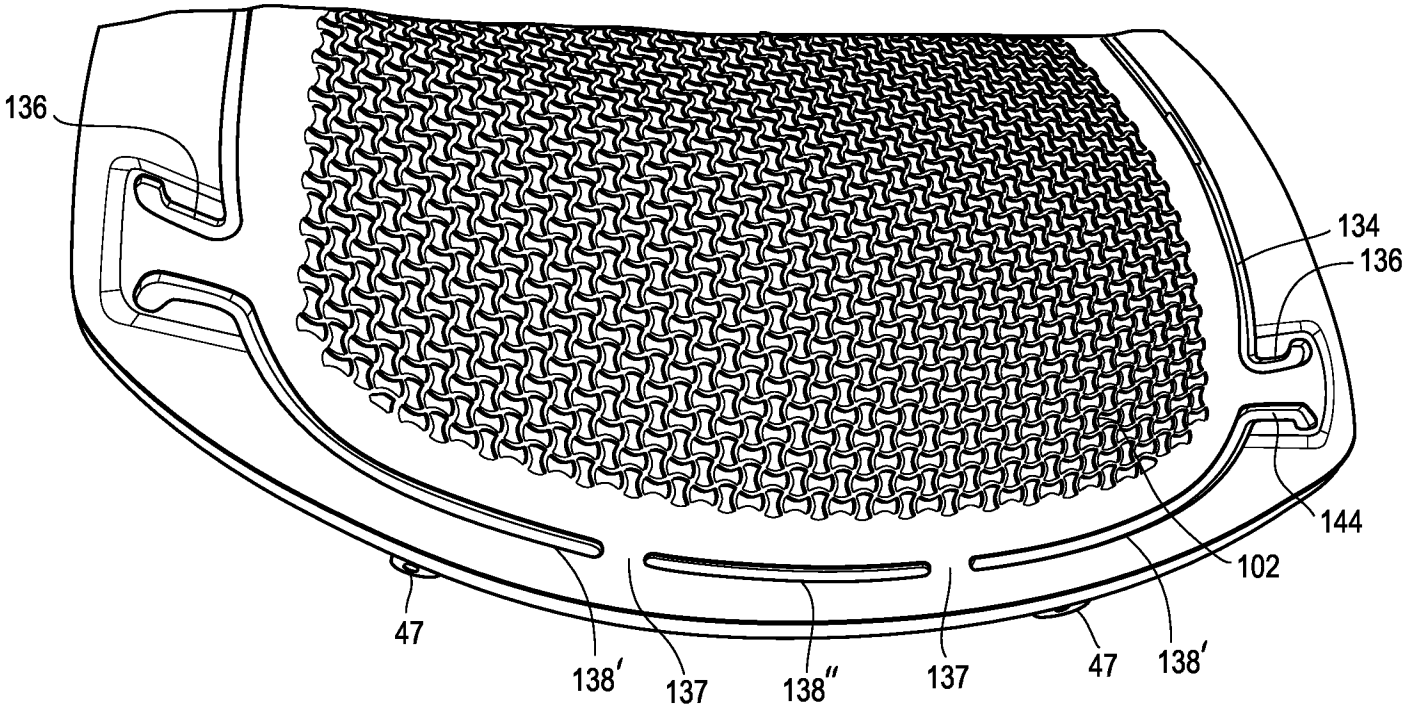
FIG. 20 is a partial front view of one embodiment of the shell.

In one embodiment, the shell 100 also includes a flange 128 extending rearwardly from the lower portion 108 and a pair of bosses 130 arranged on the upper portion 110. The flange 128 of the lower portion overlies and is secured to the flange 64 of the lower member secondary frame and the lower member 38 of the primary frame with the fasteners 66 at locations 63. The flange includes a pair of tabs 47 (see FIGS. 10 and 27) that overlie the flange 64. Likewise, the pair of bosses 130 extend through openings 132 in the upper member 46 of the secondary frame and are engaged by the same plurality of fasteners 72 securing the flanges 68, 70 of the primary and secondary frames as described above. In this way, the upper and lower portions 110, 108 of the shell are non-rotationally fixed to the upper and lower members 46, 40, 44, 38 of the secondary and primary frames. It should be understood that in an alternative embodiment, the shell may only be attached to the uprights of the frame, meaning the upper and lower portions of the shell remain free of any connection to the frame. The shell also includes a rib 115 that extends rearwardly around the periphery of the rear surface as shown in FIGS. 10, 13 and 20. The rib 115 helps mask the gap between an edge of the shell and the frame uprights 36, for example in an embodiment where a cover is not disposed around the shell (see, e.g., FIG. 13 but without the cover 204).

Figure 3A:
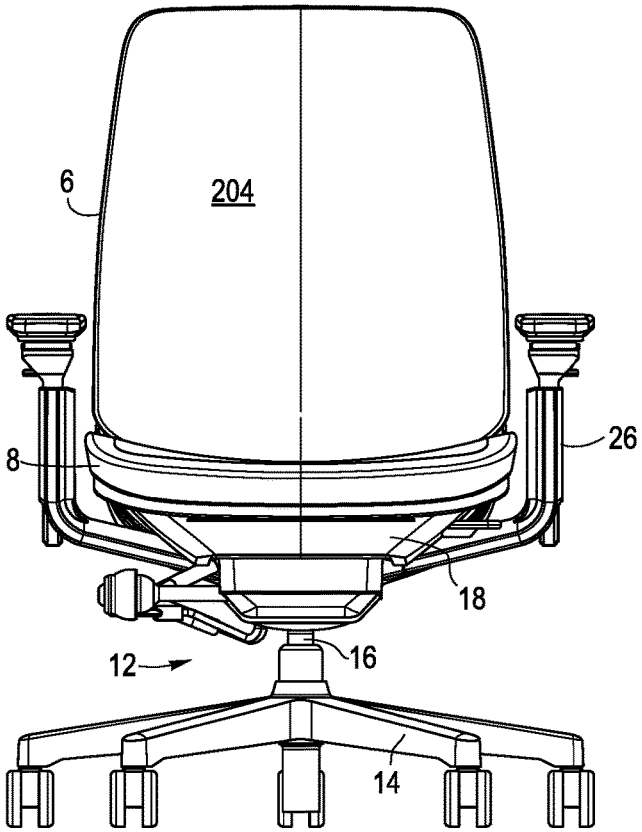
FIGS. 3A-C are front views respectively of a chair having a backrest with an upholstered front surface, a backrest including an auxiliary body support member without an upholstered front surface and a backrest without a lumbar or upholstered front surface.
Figure 3B:
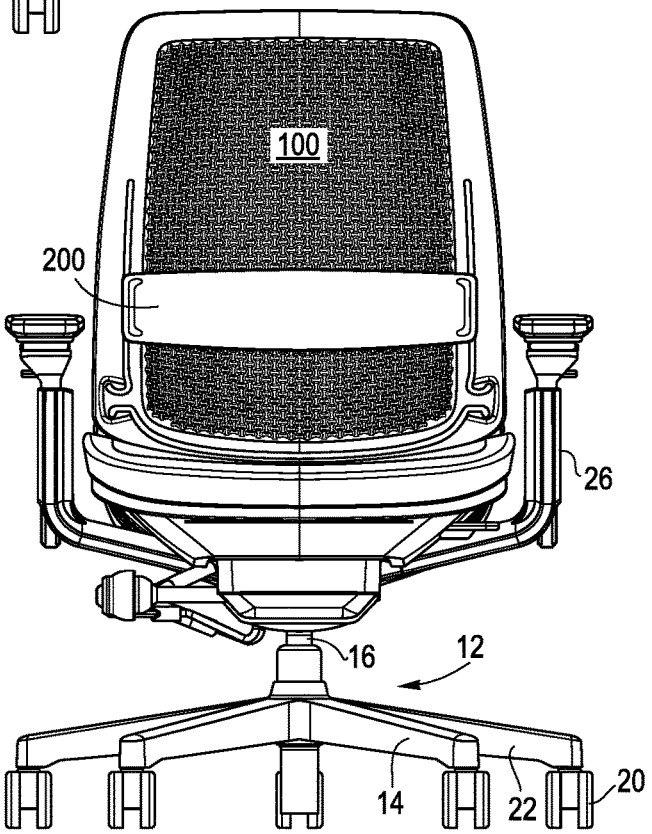
Figure 3C:
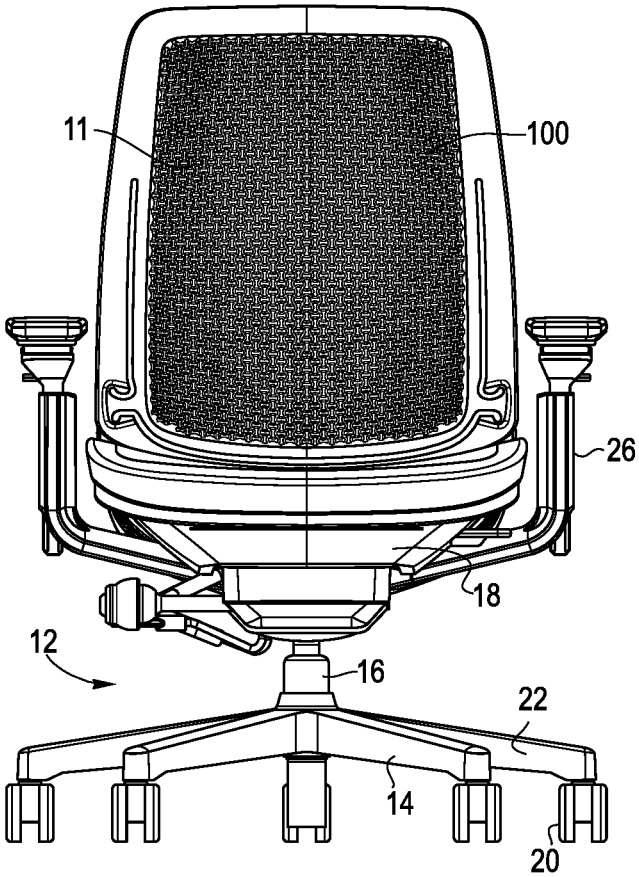

As shown in FIGS. 3C, 11 and 18, the shell has first and second slots 134 extending longitudinally along opposite sides of the sides 106 of the peripheral edge portions inboard of the locations where the shell is connected to the upright members of the secondary frame, i.e., laterally inboard of the connectors 116. The first and second slots 134 have a length (L) greater than ⅓ of the overall length (e.g., height (H)) of the shell, with at least ½ of the length of each of the first and second slots being disposed beneath a laterally extending centerline ($H_{cl}$) of the shell. The slots have a width of about 3-20 mm, and preferably 4 mm. In one embodiment, one or more of the slots may be configured as a thin slit, which may appear closed. In one embodiment, lower terminal end portions 136 of the first and second slots extend laterally outwardly from the first and second slots 134, and have a curved shape, shown as an upwardly facing concave shape. In other embodiments, shown in FIG. 18, the slots are substantially liner and do not include any laterally extending portion. The slots may have a variable width, as shown for example in FIG. 18, with a wider portion, shown at an intermediate location, accommodating the pass through of a portion of an auxiliary body support member. Upper and lower portions of the slot have a narrower width.

The shell has one or more third slots 138, 138', 138" extending laterally along the lower portion of the shell above a location where the shell is connected to the lower member of the secondary and/or primary frames, or above the rearwardly extending flange 128. In an alternative embodiment, the third slot may be located, and extend laterally along, the upper portion of the shell below the location where the shell is connected to the upper member of the secondary and/or primary frames. In yet another embodiment, the shell may include third and fourth slots in the lower and upper portions respectively. Or, in the embodiment where the shell is attached only to the uprights, the third (and fourth) slots may be omitted.

In one embodiment, shown in FIG. 11, the third slot 138 extends continuously across the width of the lower portion of the shell between the slots 134. Alternatively, as shown in FIG. 20, the third slot includes two outer slots 138' and an intermediate slot 138", separated by bridge portions 137. The bridge portions increase the stiffness of the lower portion. As such, it should be understood that the third slot may be formed from a plurality of discrete slots positioned end-to-end, with landing or bridge portions separating the slots. The lateral outermost discrete slots, making up the third slot, have terminal ends 144.

In the embodiment of FIG. 11, the third slot has an intermediate portion 140 extending across a width of the shell beneath the central region 102 and between opposite side portions 106 of the peripheral edge portion. In one embodiment, the third slot, whether a continuous slot or formed with a plurality of discrete slots, has the same curvature as the bottom edge 142 of the shell, with the third slot having an upwardly oriented concave curvature. The third slot may have other configurations, and may be linear for example. The third slot, whether a continuous slot or a plurality of end-to-end discrete slots, has opposite terminal ends 144 that are spaced apart from, and in one embodiment positioned below, the lower terminal ends 136 of the first and second slots, with the shell having first and second bridge portions 146 defined between the terminal ends of the third slot and the terminal ends of the first and second slots. As shown in FIG. 18, the terminal ends of the third slot 138 are positioned below, but slightly laterally inboard of the first and second slots 134 to define the bridge portions 146. The first and second bridge portions 146 extend between the central region 102 and the portions of the outer peripheral edge portions that are anchored to the frame. The first and second bridge portions 146 function as hinges, permitting the central region 102 to rotate relative to the portion of the peripheral edge portion anchored to the frame.

Referring to FIGS. 9, 10, 11, 14 and 15, the plurality of openings 150 in the central region 102 are arranged between the first and second slots 134 and above the third slot 138. The plurality of openings are arranged in a matrix of openings in one embodiment that permits or provides lateral and longitudinal expansion of the backrest. In one embodiment, and best shown in FIG. 15, the plurality of openings includes a plurality of first openings 152 having a first shape 160 and a plurality of second openings 154 having a second shape 162 different than the first shape, with the openings 152, 154 and shapes 160, 162 defined by the offset strips 157, 159. It should be understood that two openings having the same configuration, but which are rotated relative to each other, or are arranged in different orientations, are considered to have "different" shapes. Conversely, openings of proportionally different sizes, but with the same configuration and orientation are considered to be the "same" shape.

Figure 19:
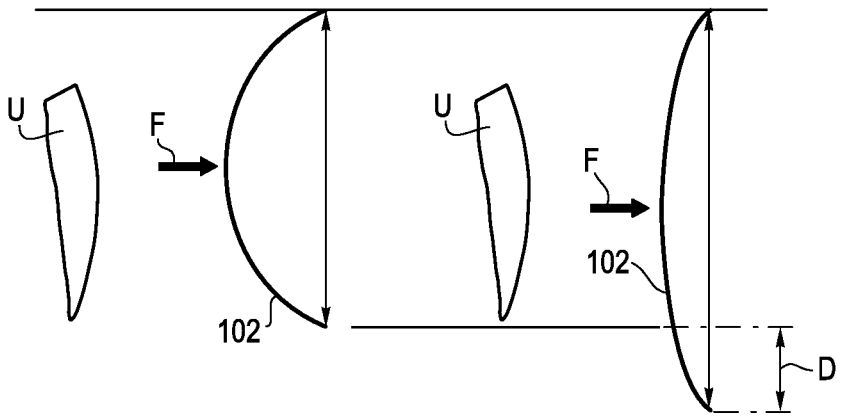
FIG. 19 is a schematic side view of the shell deflecting in response to a load (F) being applied to a body support surface thereof.
Figure 21:
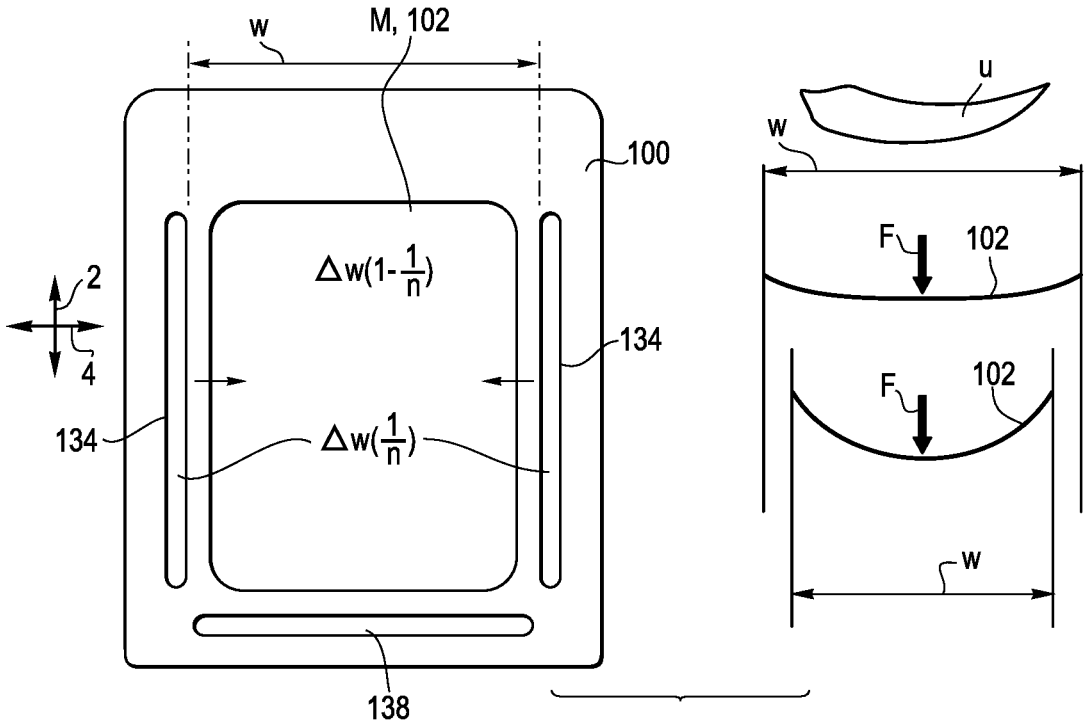
FIG. 21 shows schematic rear and cross-sectional views of the shell deflecting in response to a load (F) being applied to a body support surface thereof.

The first and second openings 152, 154 are arranged in an alternating pattern in both a lateral direction (rows 156) and a longitudinal direction (Columns 158). In one embodiment, the first shape 160 is a laterally oriented dog-bone shape and the second shape is a longitudinally oriented dog-bone shape, both defined with enlarged end portions and a constricted mid portion, with the end portions having concave boundaries, or end surfaces, facing one another. In this way, the first openings 152, and interaction between the webs or strips 157, 159, allow for longitudinal expansion of the central region in response to a load (F) being applied, for example by a user (U), while the second openings 154, and interaction between the webs or strips 157, 159, allow for lateral expansion of the central region, as shown in FIGS. 19 and 21, for example moving inwardly. In particular, the strips 157, 159 may straighten slightly to allow for the expansion. The dog-bone configuration of the first and second shapes may be identical, but with different orientations. In one embodiment, the size of the first and second shapes may vary across the width and height, or lateral and longitudinal directions, of the central region. It should be understood that while the overall three-dimensional shape of the shell, and in particular the central region, changes in response to the load applied by the user, the longitudinal and lateral expansion of the central region occurs within the curvi-planar surface defined by the central region.

Figure 14:
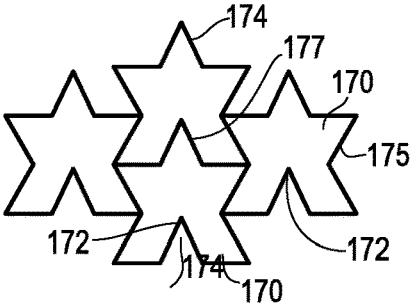
FIG. 14 is a schematic drawing of one embodiment of a matrix of openings incorporated into flexible shell.

Referring to FIG. 14, an alternative embodiment of a matrix of openings includes a plurality of nested star shaped openings 170 defined by webs or strips of material. In one embodiment, the opening is a hexagram star shape, with the bottom vertex 172 of each opening being inverted so as to nest with (or define) the top vertex 174 of an underlying opening. The matrix of openings also provides for independent lateral and longitudinal expansion. The longitudinal strips defining the openings 170, including non-linear side portions 175 formed from a pair of linear segments having a concave configuration, may be continuous. Non-linear lateral strips 177, defining the top and bottom of the openings 170, also are formed from linear segments (shown as four) defining the top and bottom vertices 174, 172 and horizontal legs. The lateral strips arranged between the longitudinal strips are vertically offset and may be defined as not continuous, or may share a leg of the longitudinal strips and be defined as continuous. The longitudinal and lateral strips, while non-linear, are made up of linear segments.

Referring to FIG. 18, in yet another embodiment, the matrix is configured with alternating columns 176, 178 of openings having first and second shapes 180, 182 defined by non-linear webs or strips of material, with the first shape 180 being a hybrid hour-glass or dog bone shape having upper and lower upwardly opening concave boundaries, and the second shape 182 being a hybrid hour-glass or dog bone shape with an upper and lower downwardly opening concave boundaries. Expressed another way, the openings have the same configuration, but are rotated 180° relative to each other. The longitudinal strips may be continuous, while lateral strips arranged between the longitudinal strips are vertically offset and not continuous, or defined another way, share portions of the longitudinal strips and are continuous.

Figure 26:
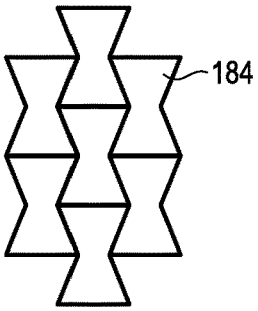
FIG. 26 is a view of an alternative hole pattern incorporated into the central region of the shell.

In yet another embodiment, shown in FIG. 26, a plurality of openings 184 have the same shape, shown as an hour-glass shape, as opposed to alternating first and second shapes. Various structures configured with such a pattern of openings is further disclosed in U.S. Publication No. 2015/0320220 to Eberlein, assigned to Steelcase Inc., the entire disclosure of which, including the various patterns of openings, is hereby incorporated herein by reference. Again, the longitudinal strips may be continuous, while lateral strips arranged between the longitudinal strips are offset and not continuous, or are continuous while including portions of the longitudinal strips.

Referring to FIGS. 19 and 21, the shell 100 is configured with spaced apart first and second slots 134 defining a structure that provides macro-compliance in a lateral direction 4, while the shell configured with a third slot 138 (and/or fourth slot) defines a structure for providing macro-compliance in a longitudinal direction 2. Moreover, the shell is configured with a matrix M of first and second openings having different shapes providing for micro-compliance in the longitudinal and lateral directions respectively. The terms macro and micro convey relative amounts of compliance, with the structures providing macro compliance allowing for a greater amount of expansion than the structures providing micro compliance. For example and without limitation, the third slot 138 provides or allows for some amount of longitudinal expansion EL1>½D, while the matrix of openings provides or allows for some amount of longitudinal expansion EL2<½D. Likewise, the first and second slots in combination provide or allow for some amount of lateral expansion $E_{LT1}=\Delta W(1/n)$ where n<2, and the matrix of openings M provides or allows for some amount of lateral expansion $E_{LT12}=\Delta W(1-1/n)$.

Auxiliary Support Member:

Referring to FIGS. 1B, 3B, 4B, 9, 16, 17A and B, an auxiliary support assembly 200 is shown as being moveable along the front, body facing surface 112 of the shell. The assembly includes a laterally extending support member, which may contact the front surface directly, or may have a substrate dispose there between. The auxiliary support member, which may be located in the lumbar region of the backrest and serve as a lumbar member, includes a laterally extending belt 202, which may be padded.

Figure 27:
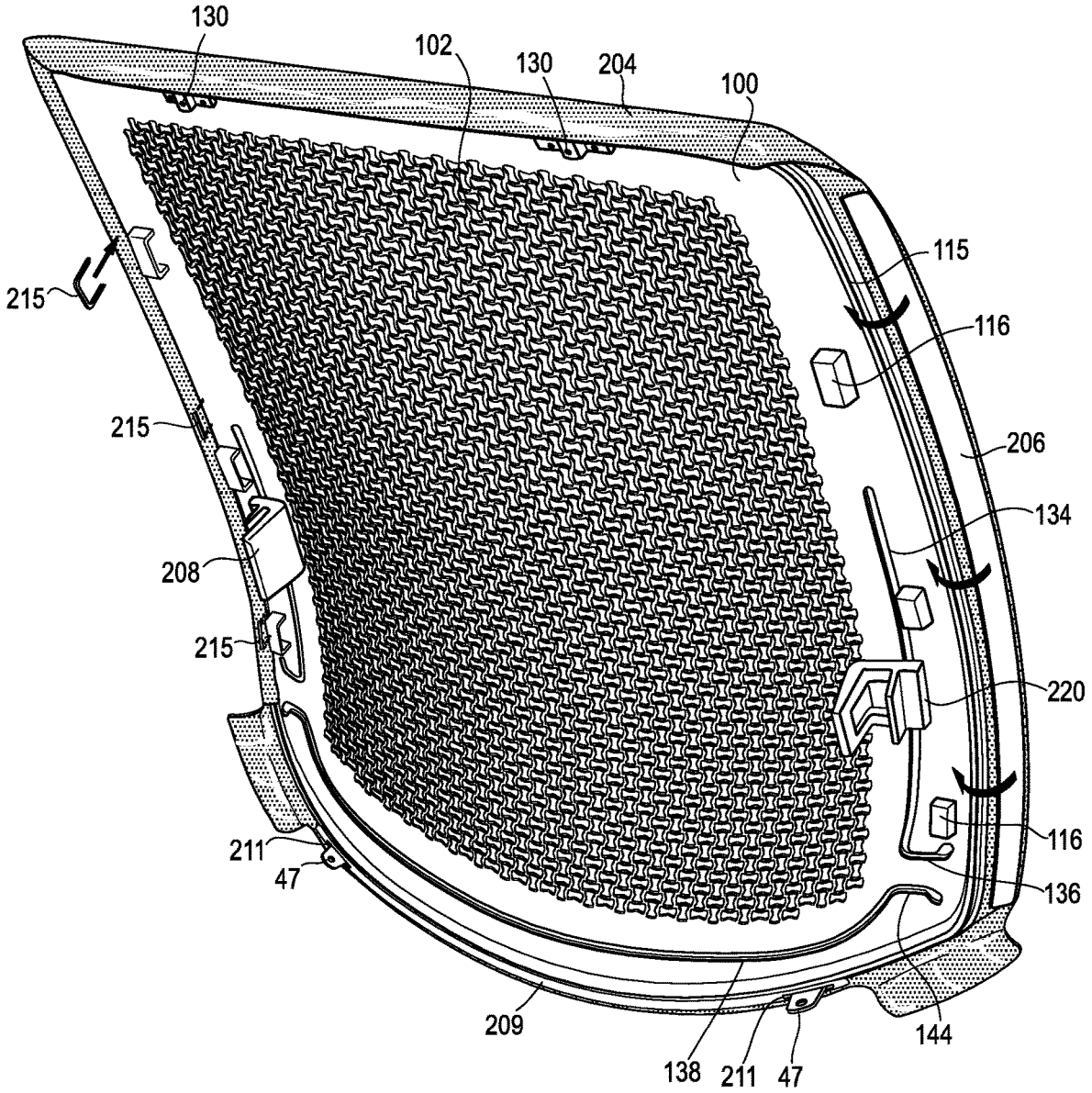
FIG. 27 is a perspective view showing a cover being applied to a shell having an auxiliary body support assembly coupled thereto.
Figure 28:
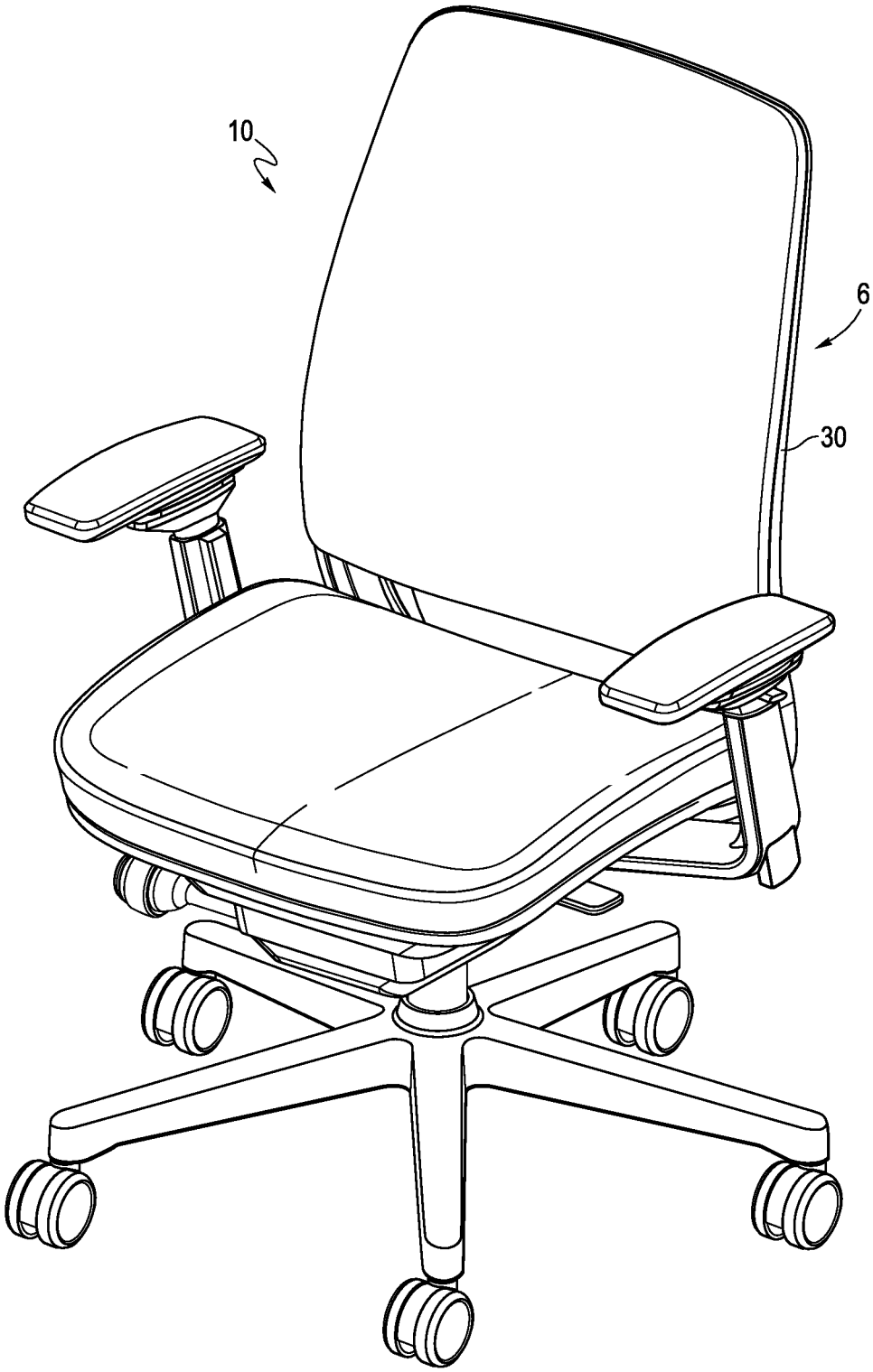
FIG. 28 is a top upper perspective view of a chair, displaying its ornamental design features.
Figure 29:
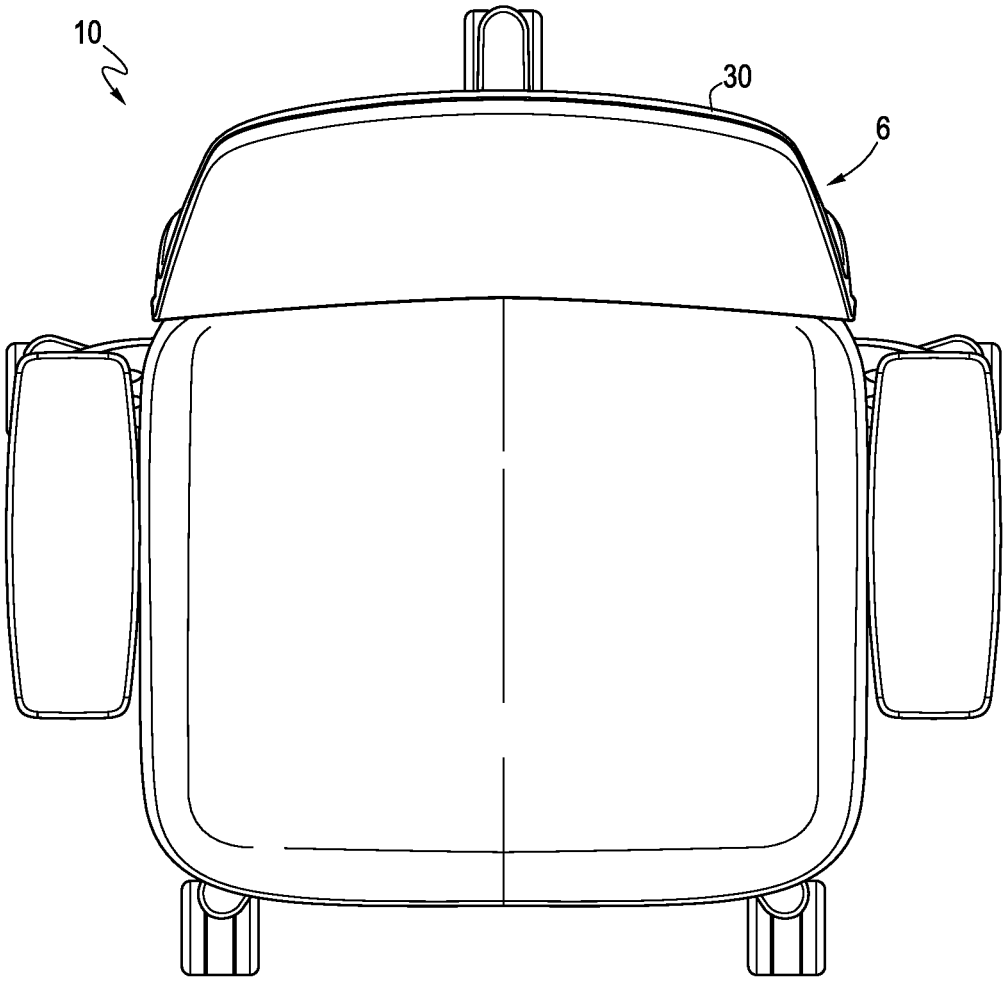
FIG. 29 is a top plan view thereof.
Figure 30:
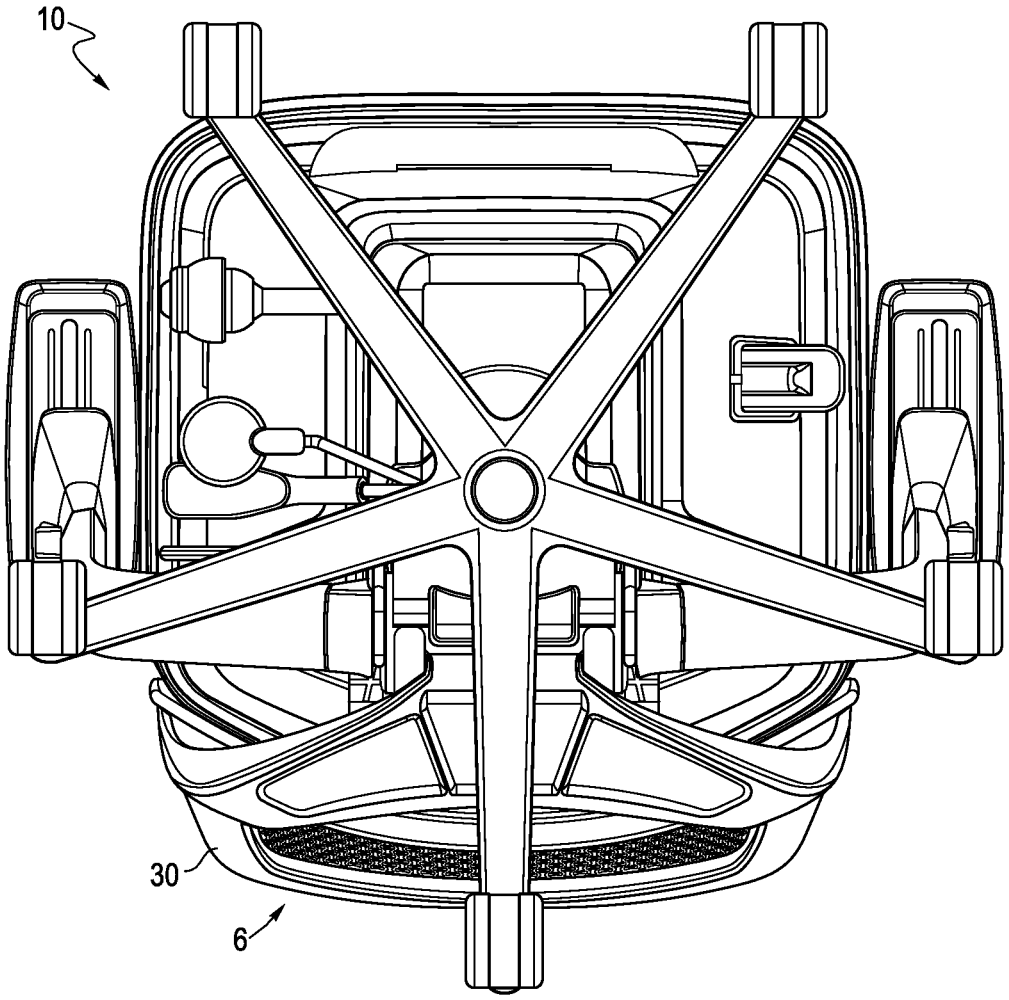
FIG. 30 is a bottom plan view thereof.
Figure 31:
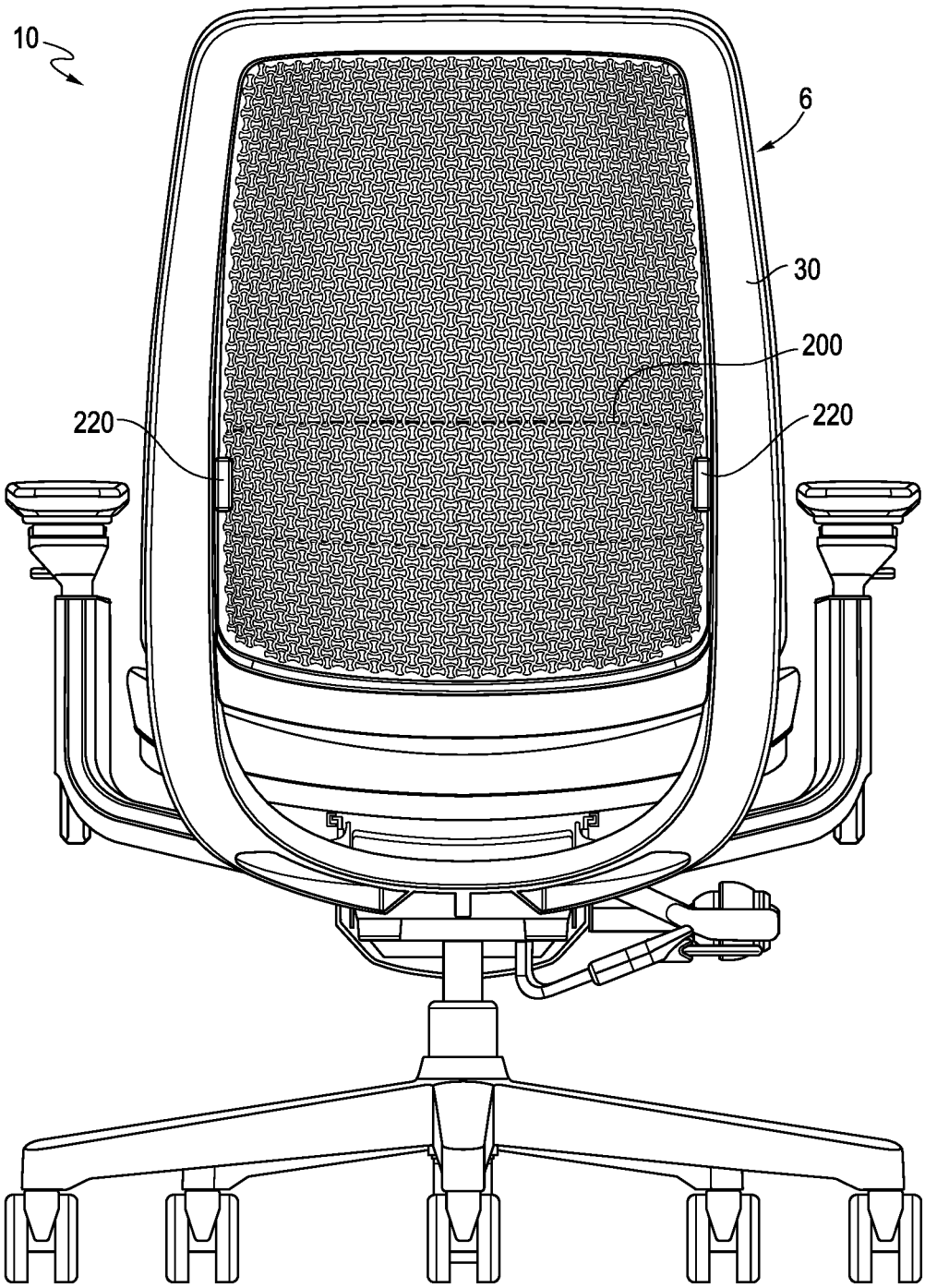
FIG. 31 is a rear elevation view thereof.
Figure 32:
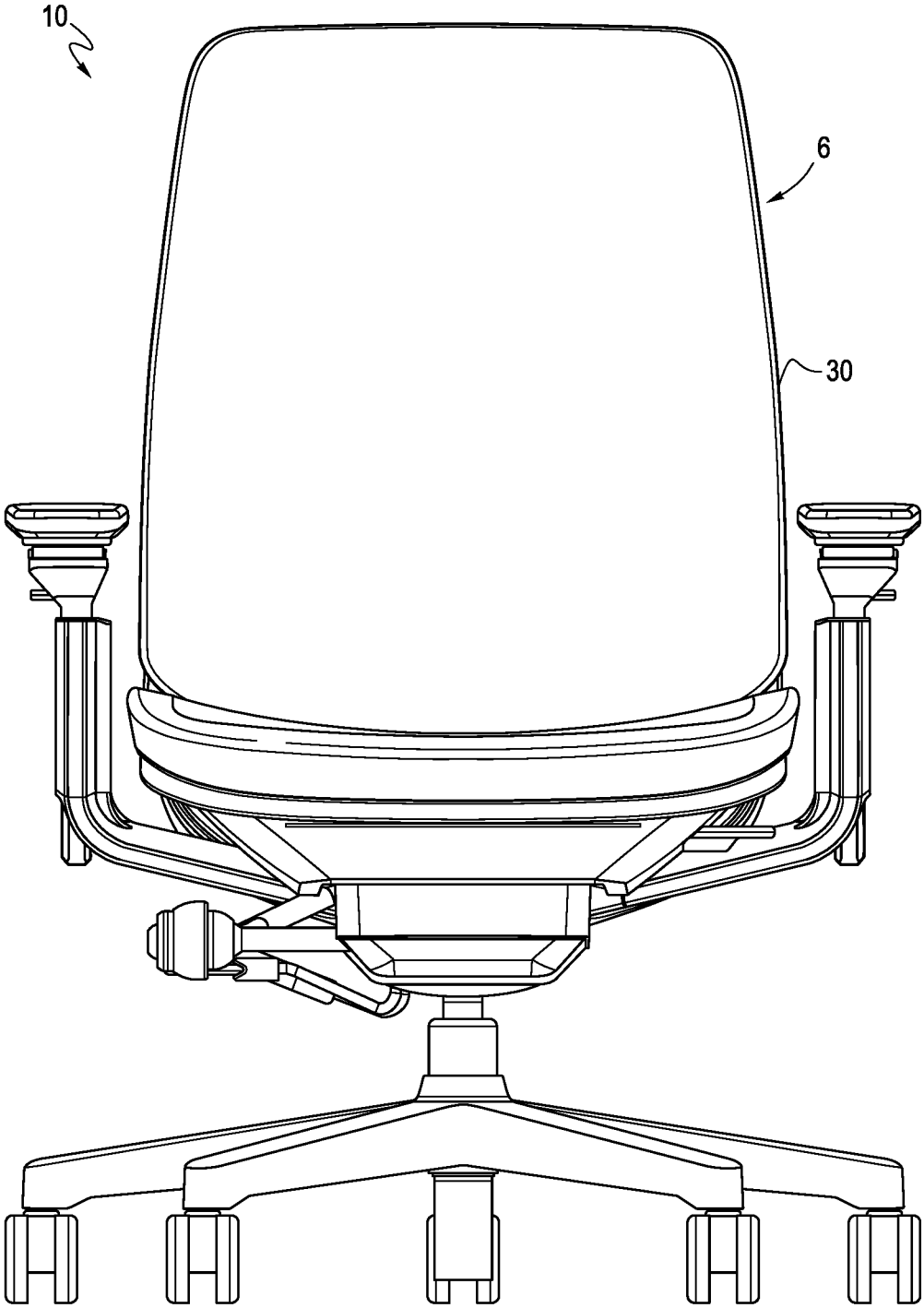
FIG. 32 is a front elevation view thereof.
Figure 33:
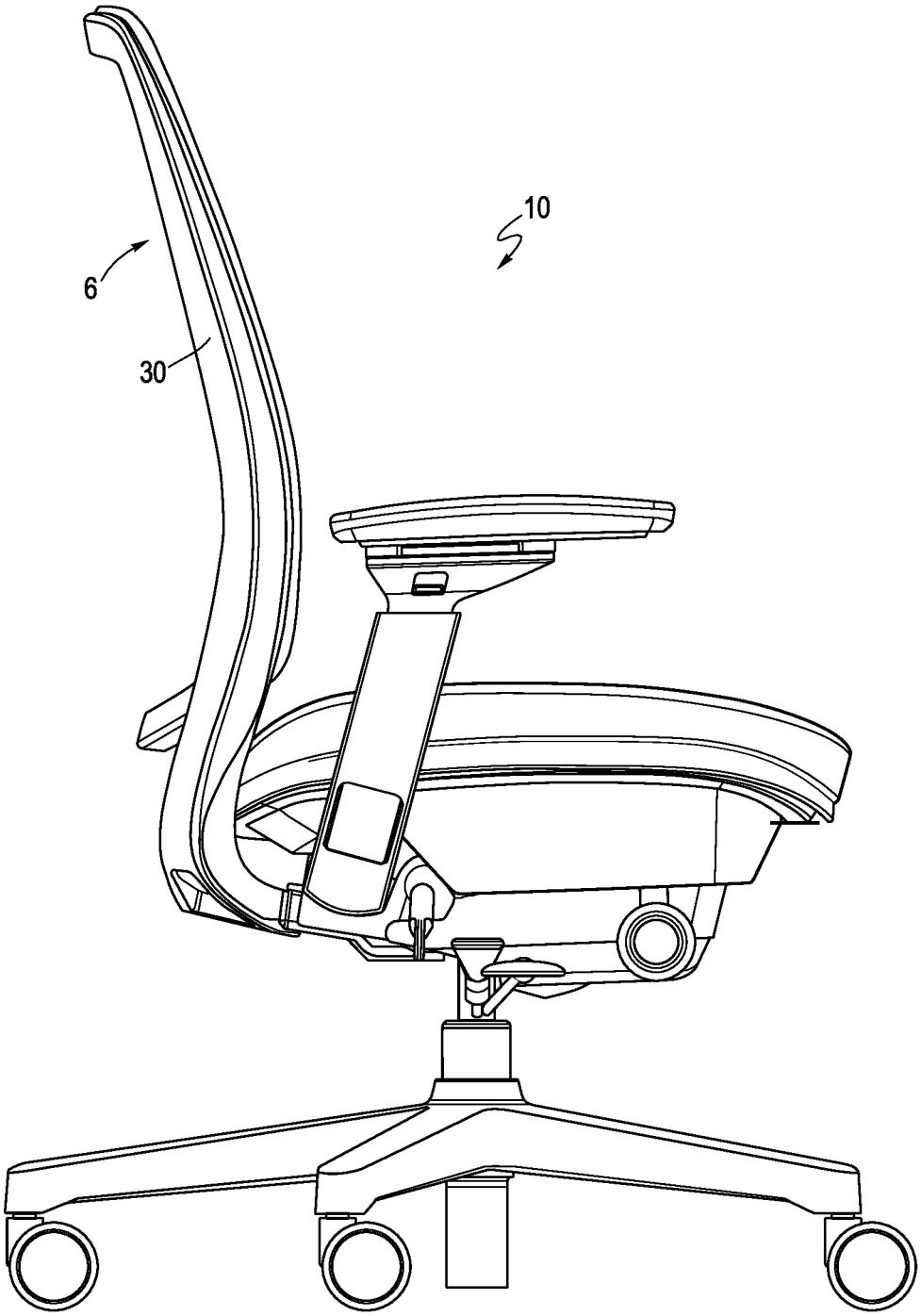
FIG. 33 is a right side elevation view thereof.
Figure 34:
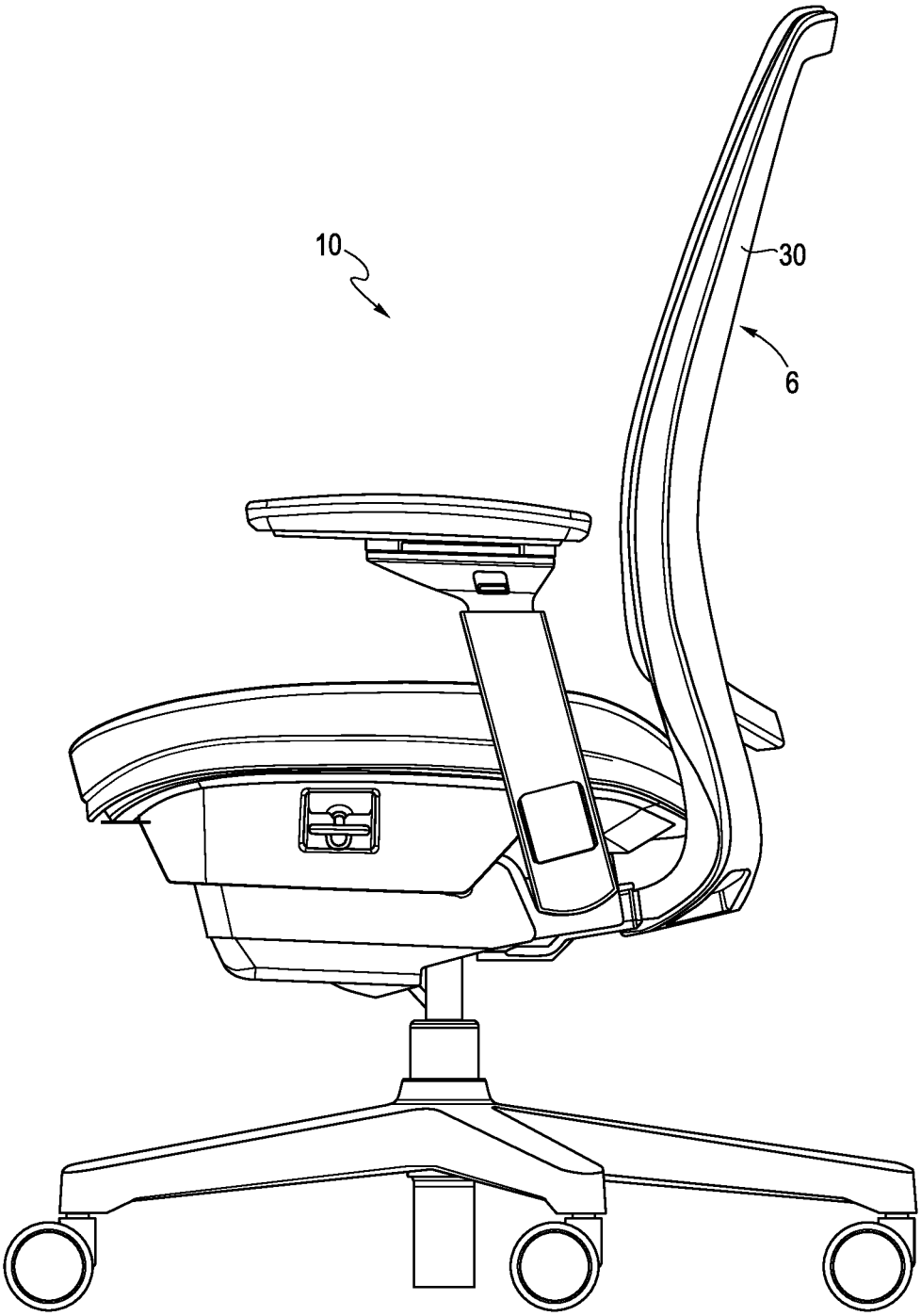
FIG. 34 is a left side elevation view thereof.
Figure 35:
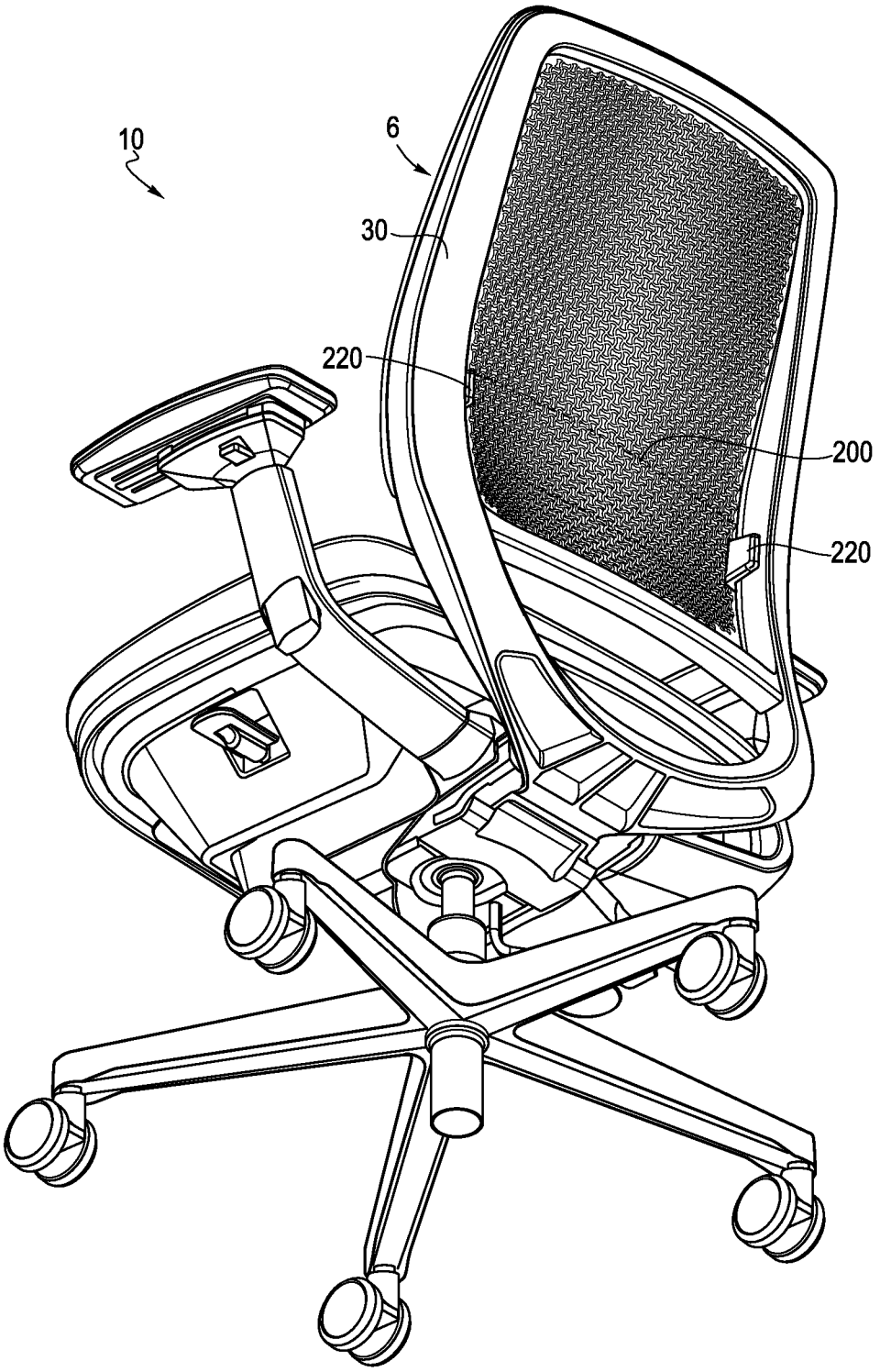
FIG. 35 is a rear lower perspective view thereof.
Figure 36:
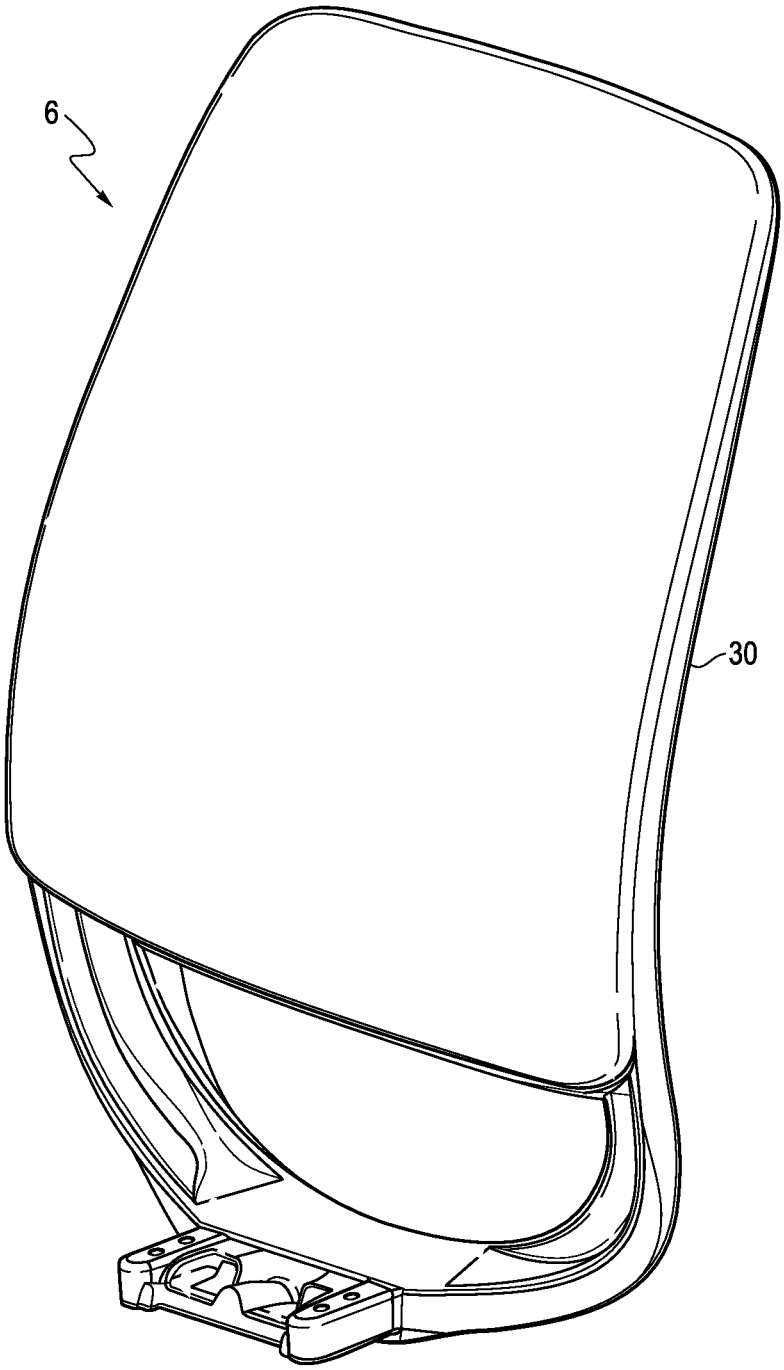
FIG. 36 is a top upper perspective view of a backrest, displaying its ornamental design features.
Figure 37:
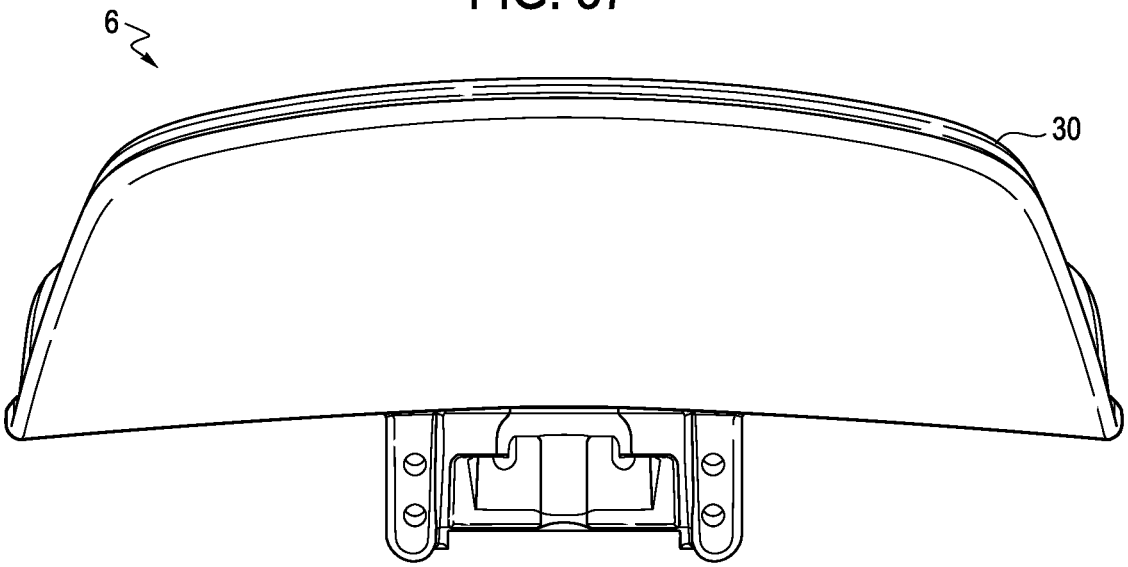
FIG. 37 is a top plan view thereof.
Figure 38:
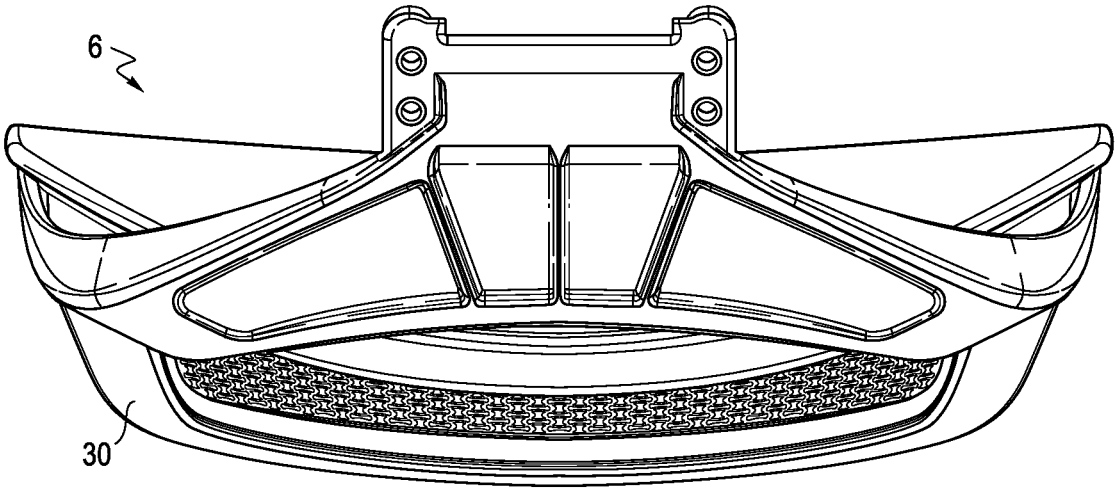
FIG. 38 is a bottom plan view thereof.
Figure 39:
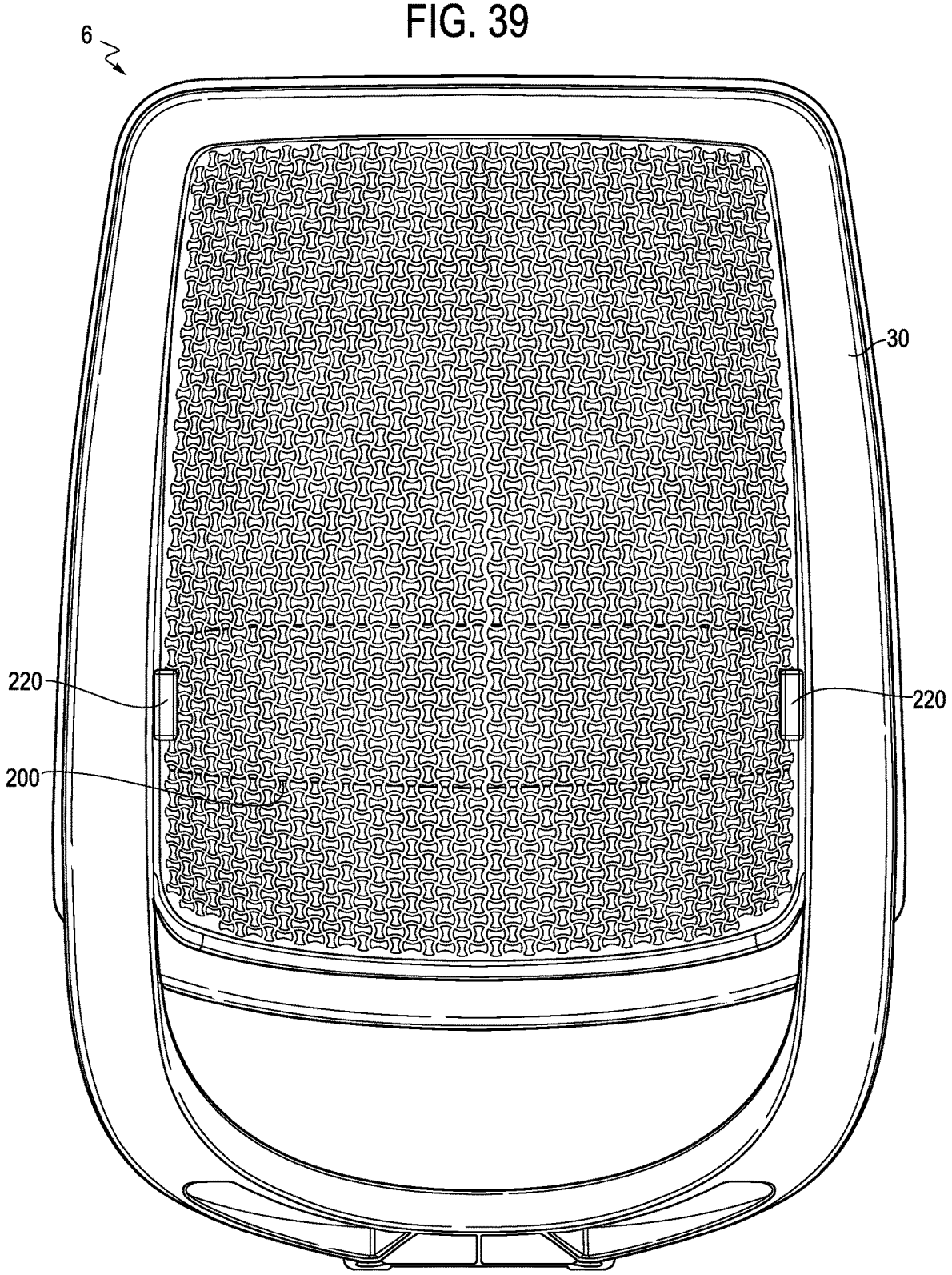
FIG. 39 is a rear elevation view thereof.
Figure 40:
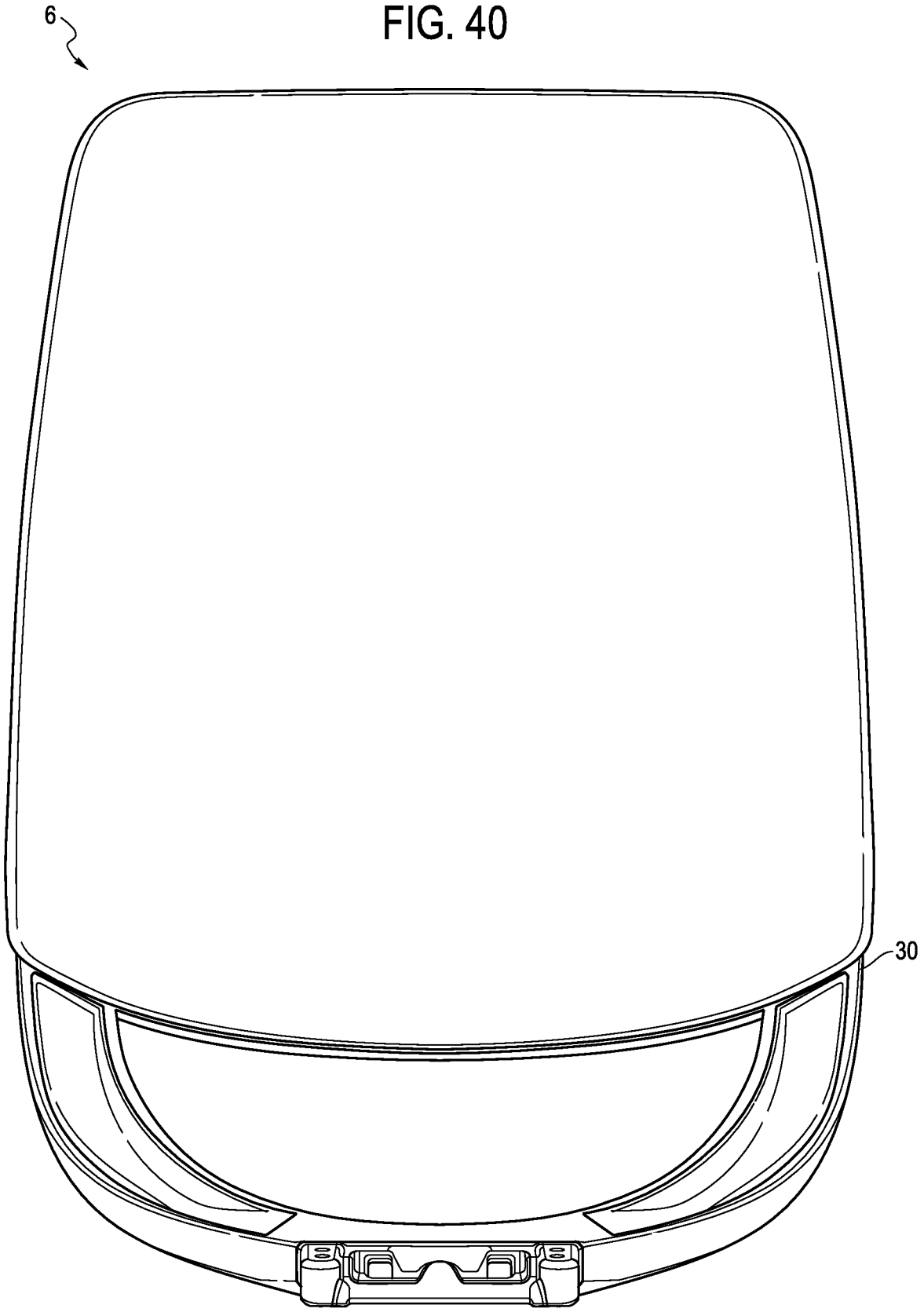
FIG. 40 is a front elevation view thereof.
Figure 41:
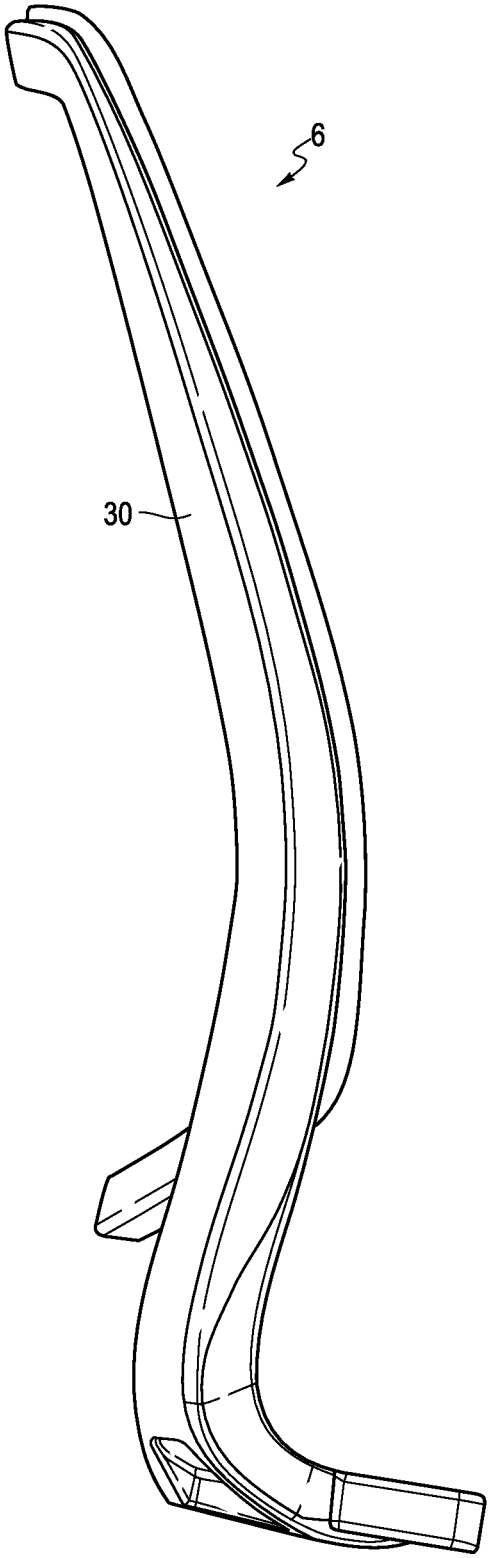
FIG. 41 is a right side elevation view thereof.
Figure 42:
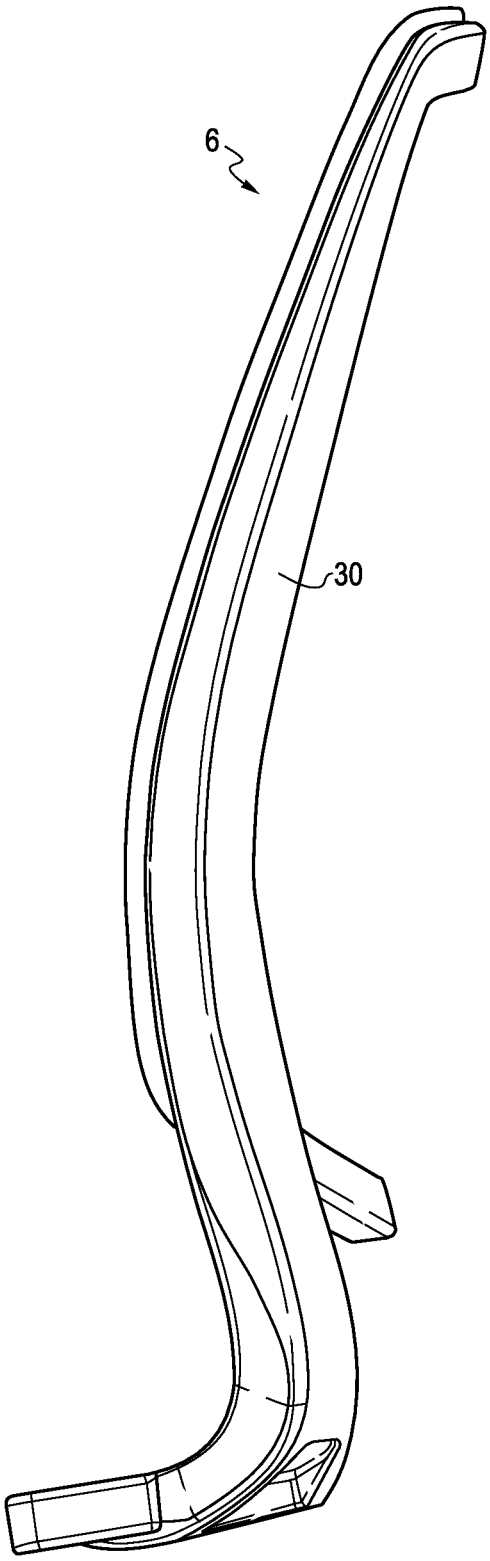
FIG. 42 is a left side elevation view thereof.
Figure 43:
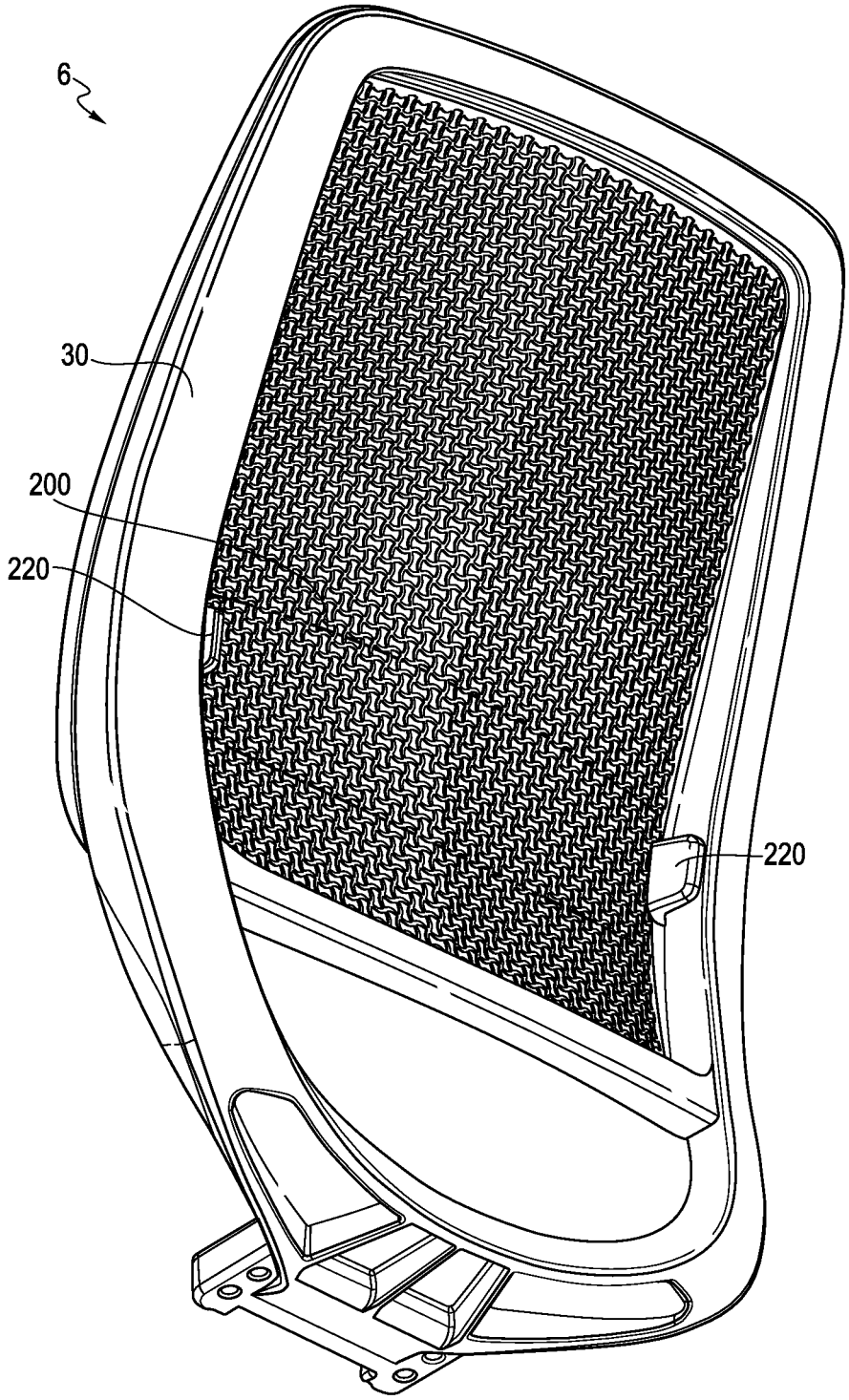
FIG. 43 is a rear lower perspective view thereof.
Figure 44:
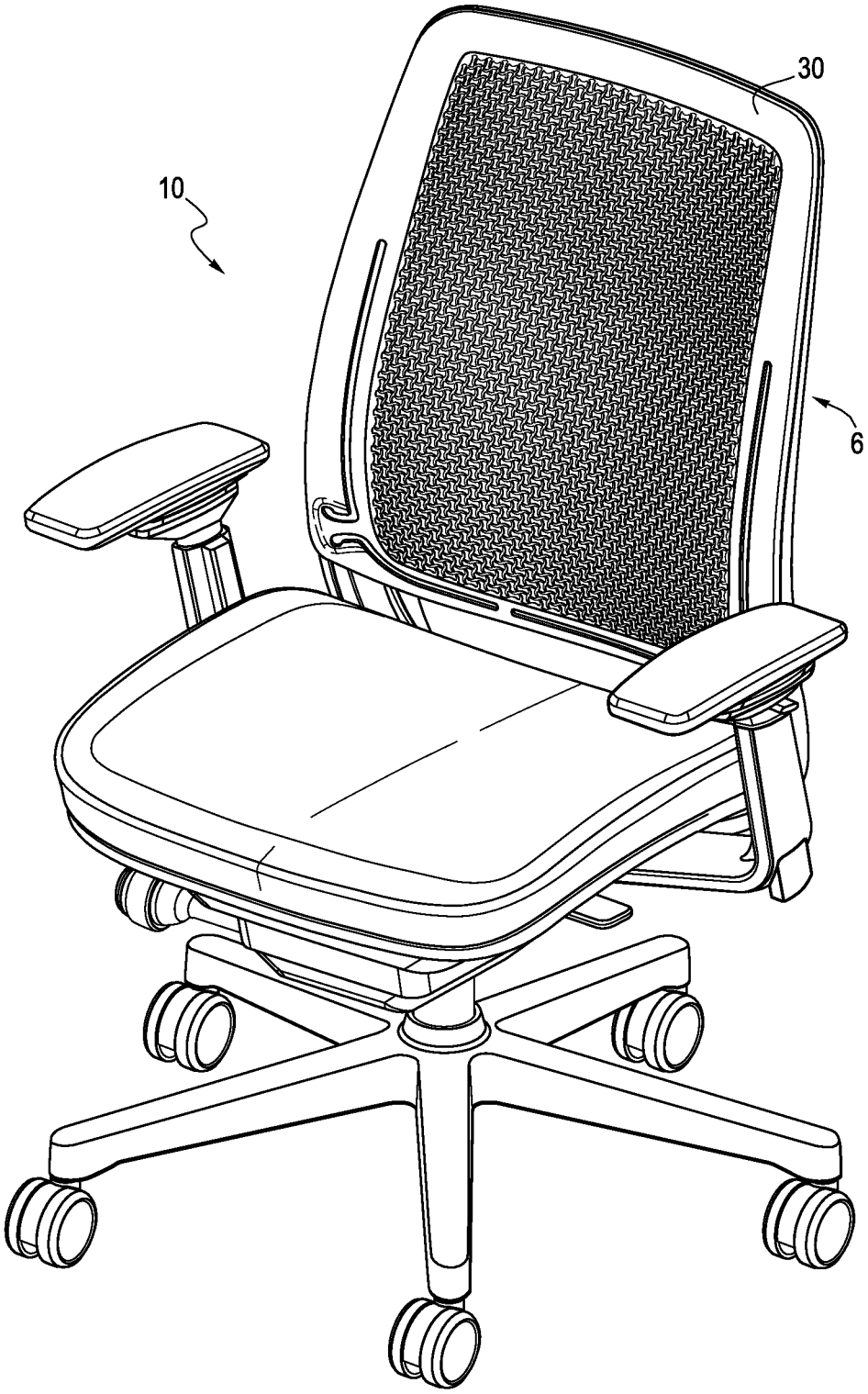
FIG. 44 is a top upper perspective view of a chair, displaying its ornamental design features.
Figure 45:
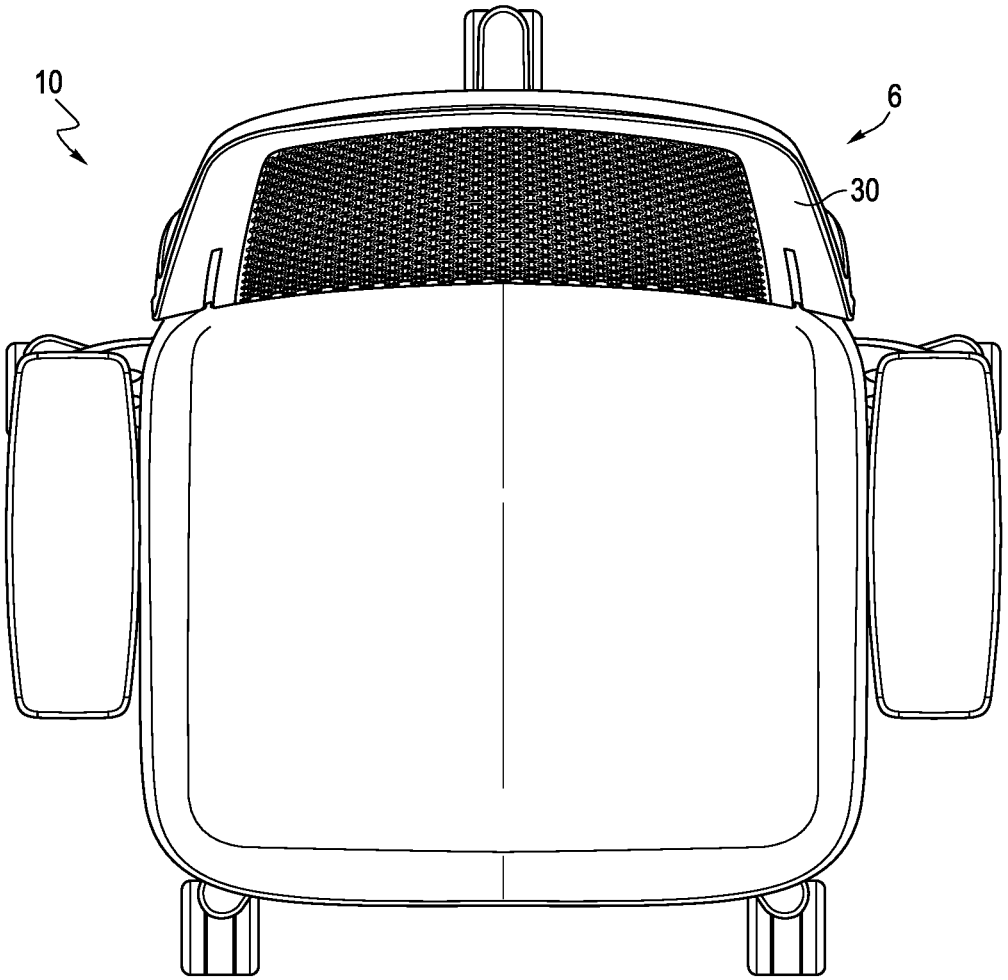
FIG. 45 is a top plan view thereof.
Figure 46:
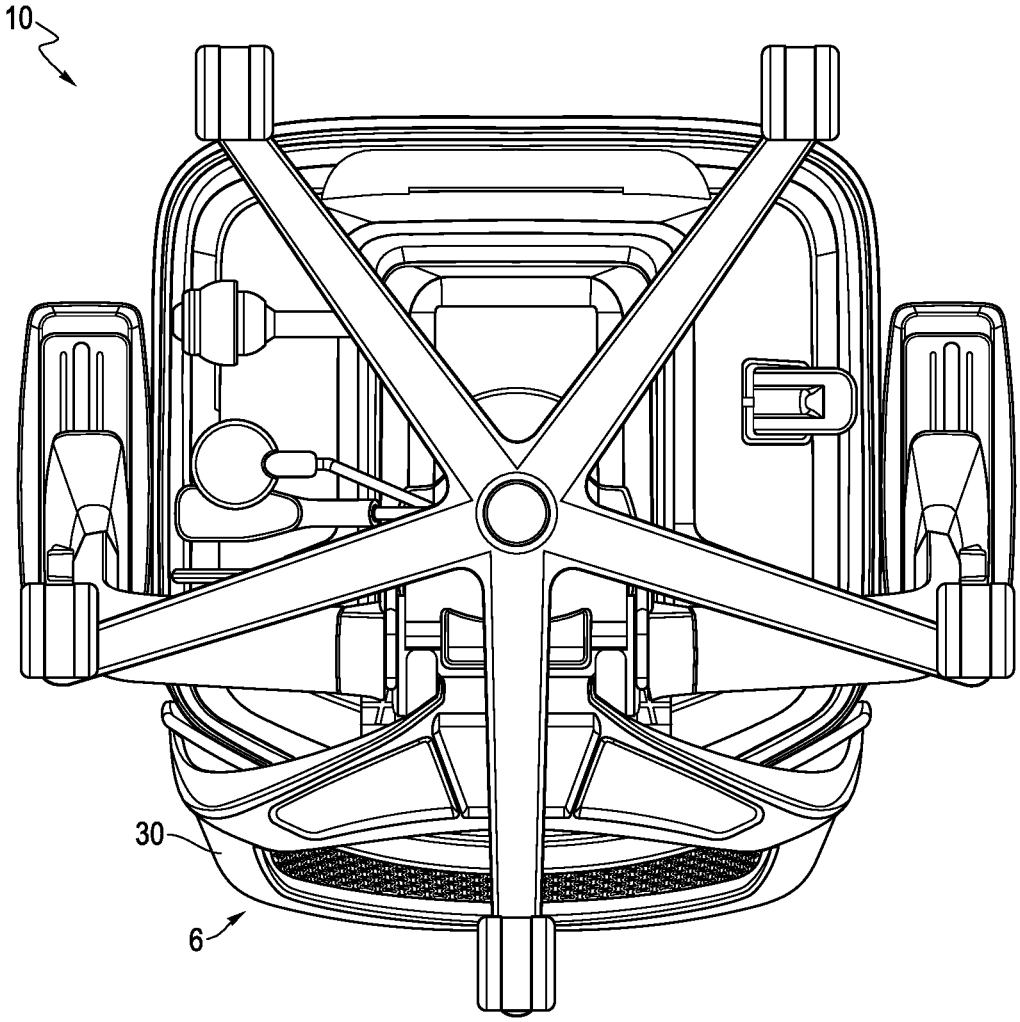
FIG. 46 is a bottom plan view thereof.
Figure 47:
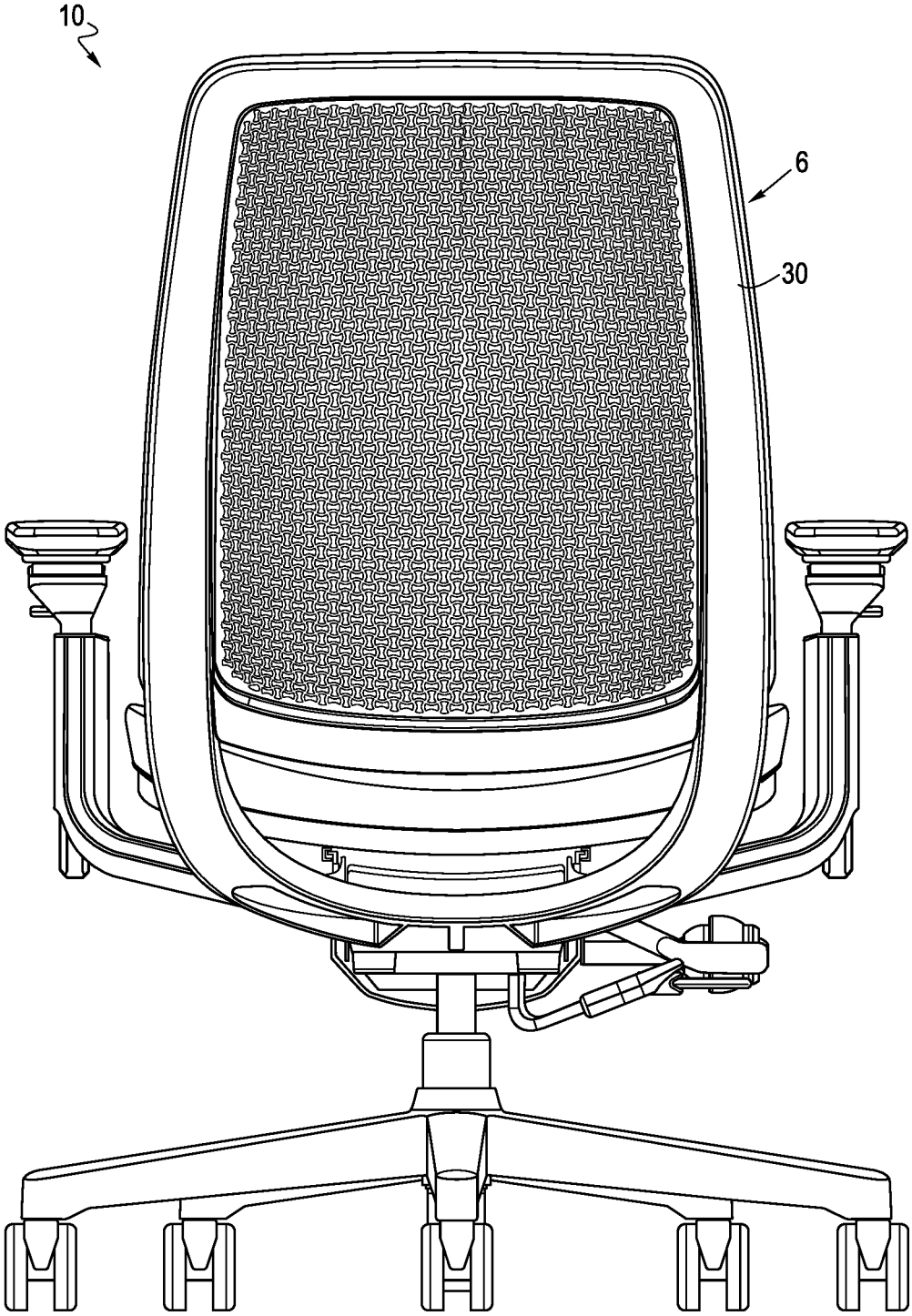
FIG. 47 is a rear elevation view thereof.
Figure 48:
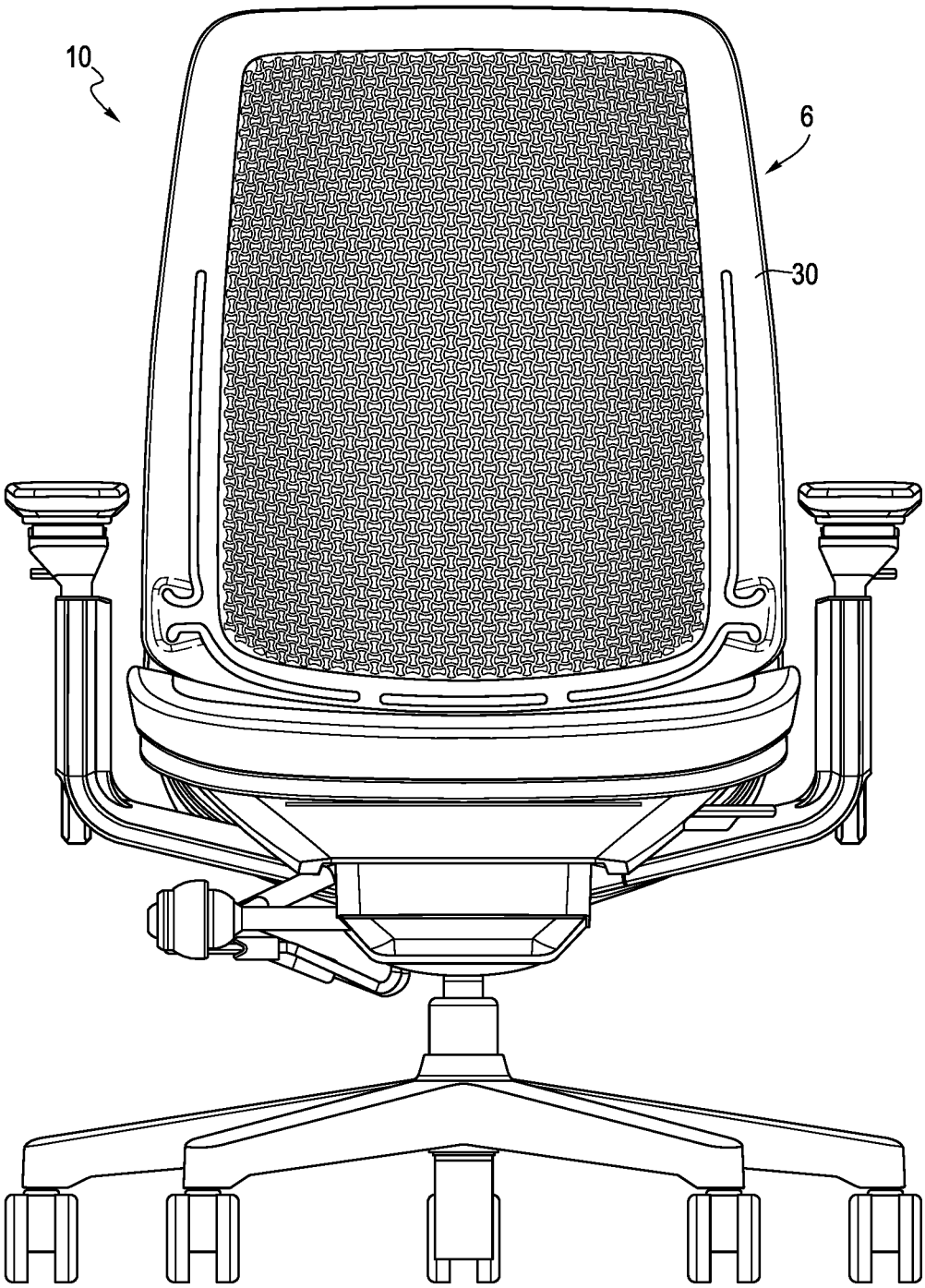
FIG. 48 is a front elevation view thereof.
Figure 49:
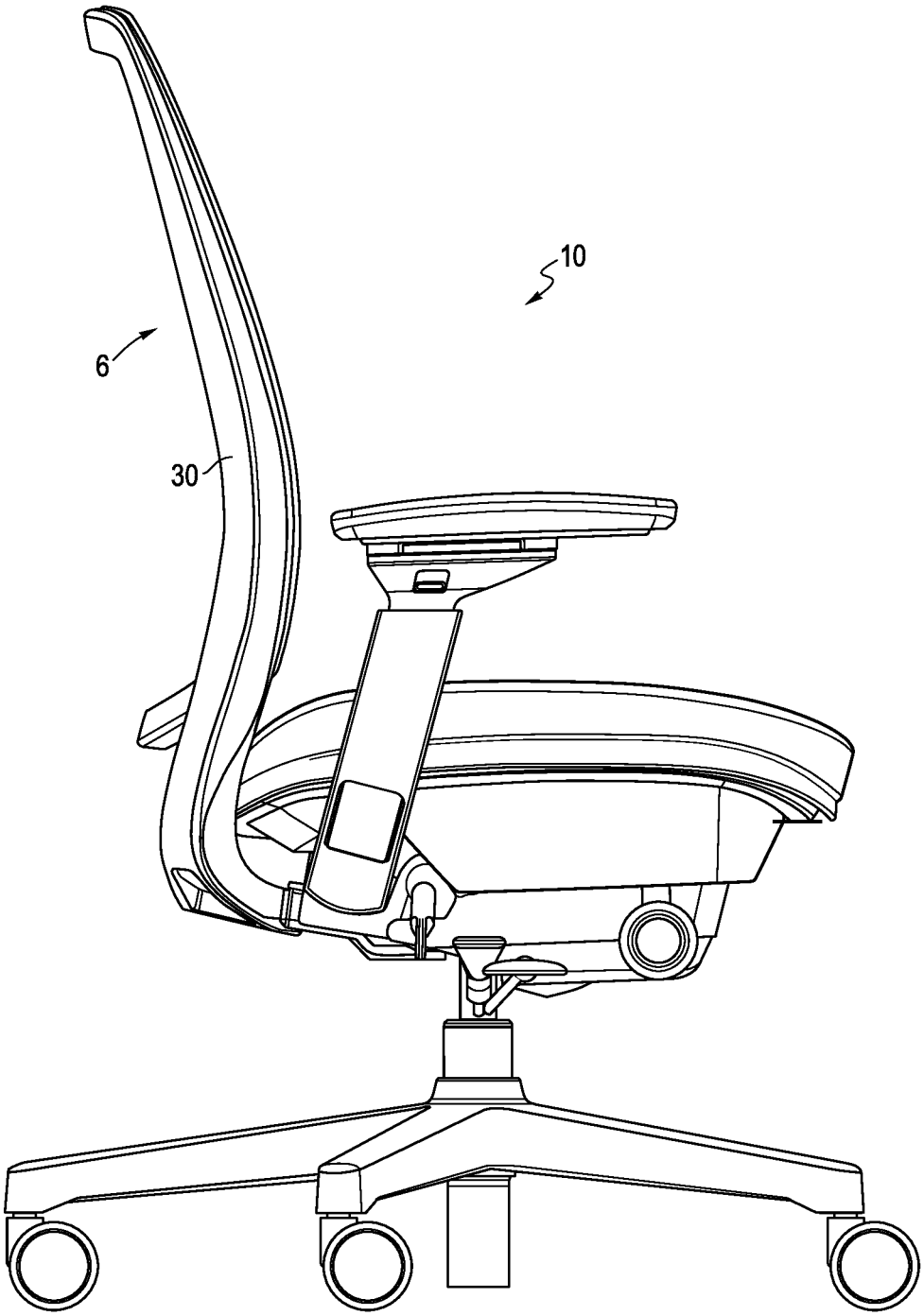
FIG. 49 is a right side elevation view thereof.
Figure 50:
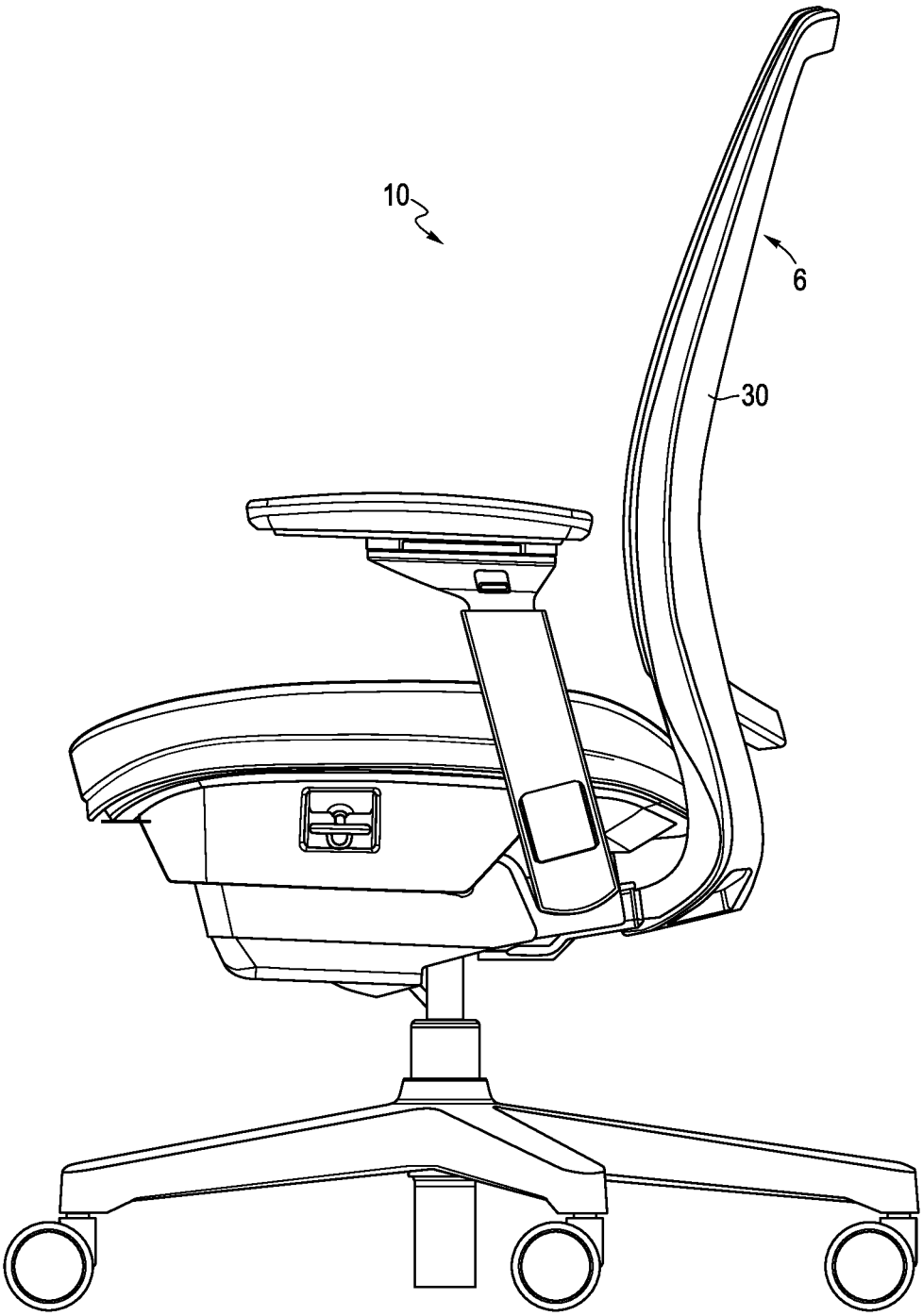
FIG. 50 is a left side elevation view thereof.
Figure 51:
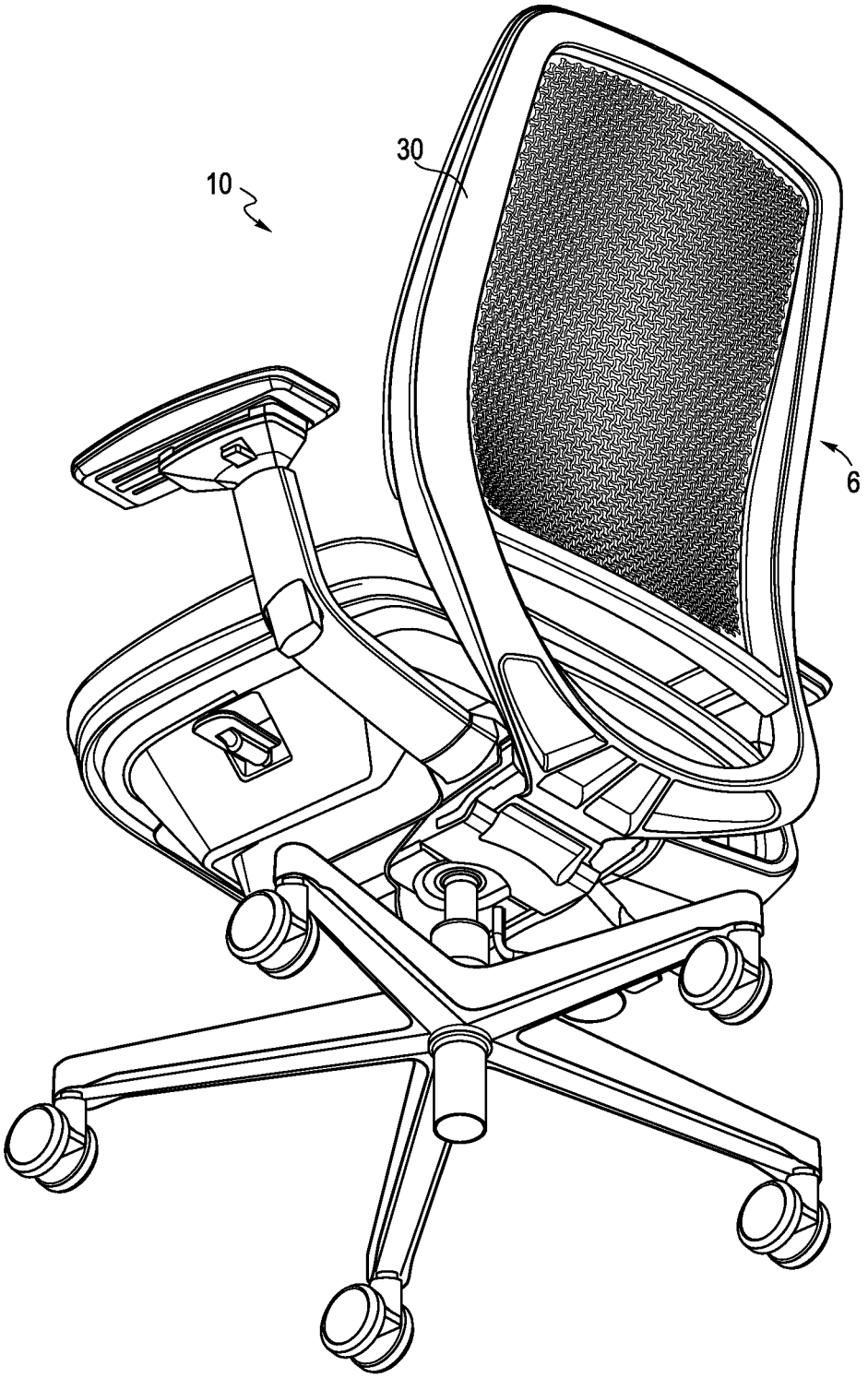
FIG. 51 is a rear lower perspective view thereof.
Figure 52:
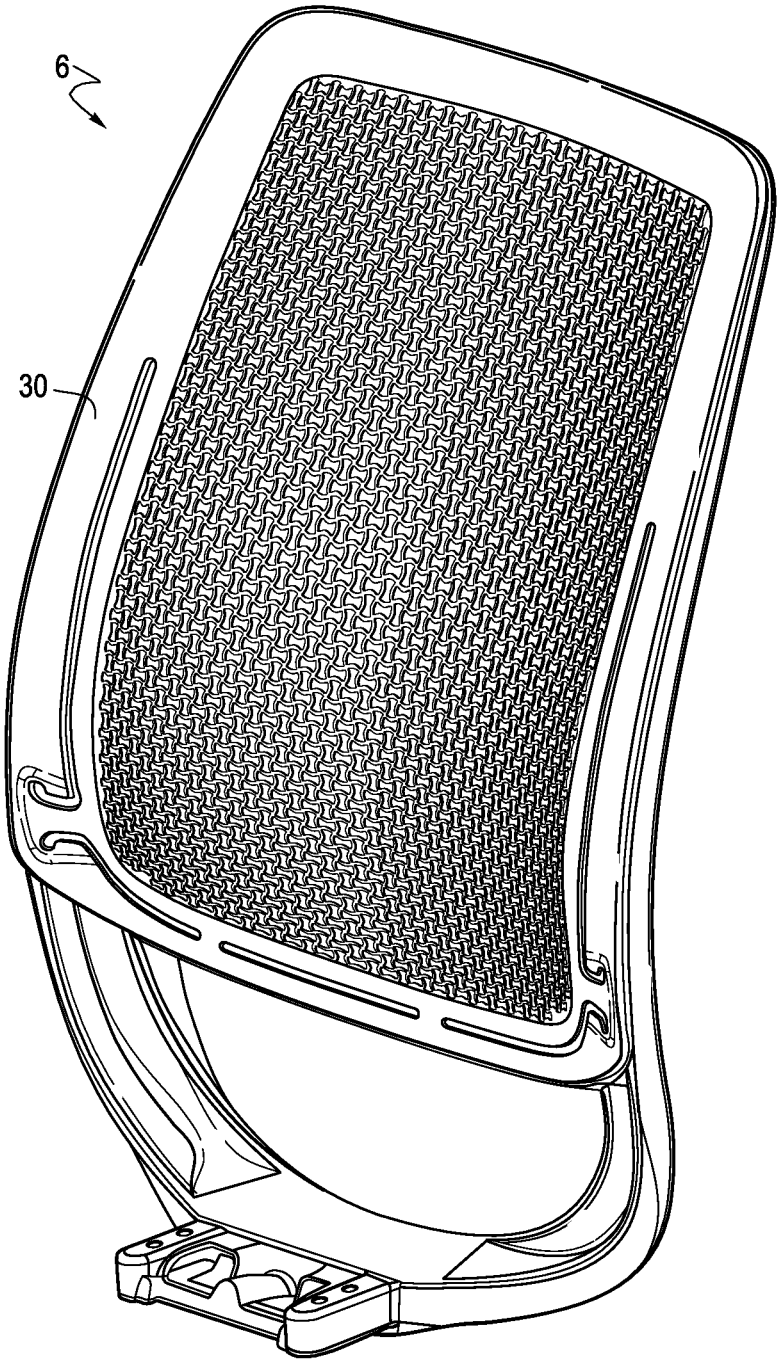
FIG. 52 is a top upper perspective view of another backrest, displaying its ornamental design features.
Figure 53:
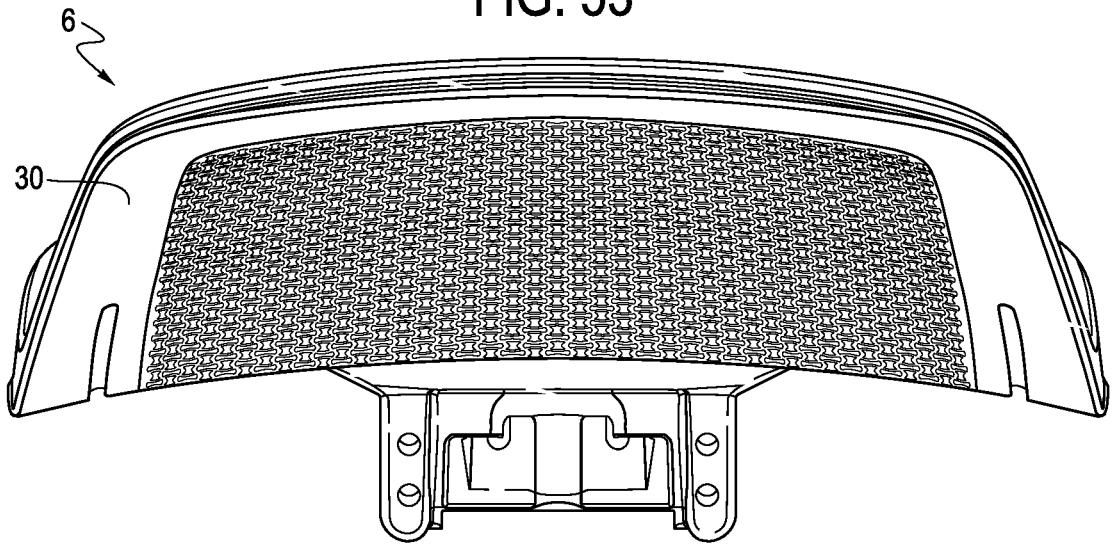
FIG. 53 is a top plan view thereof.
Figure 54:
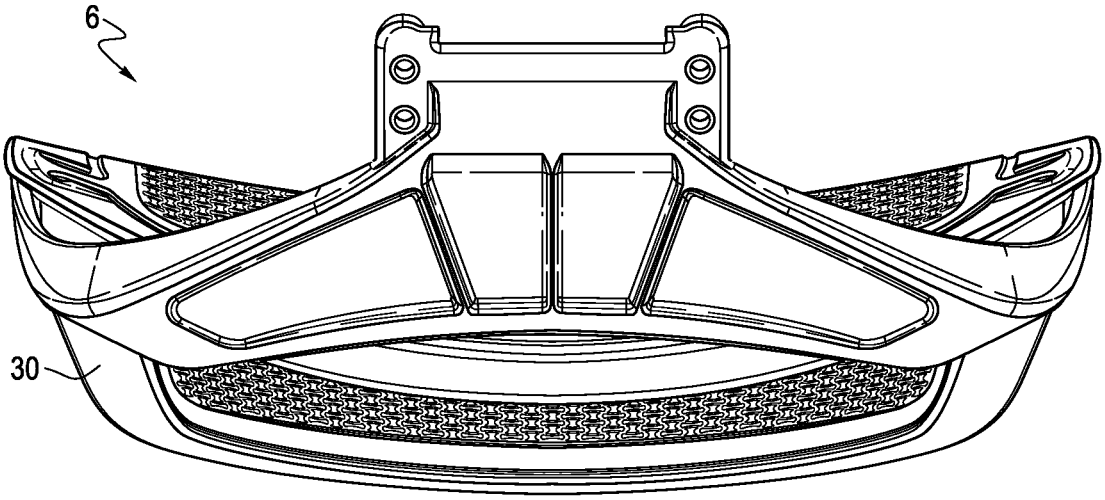
FIG. 54 is a bottom plan view thereof.
Figure 55:
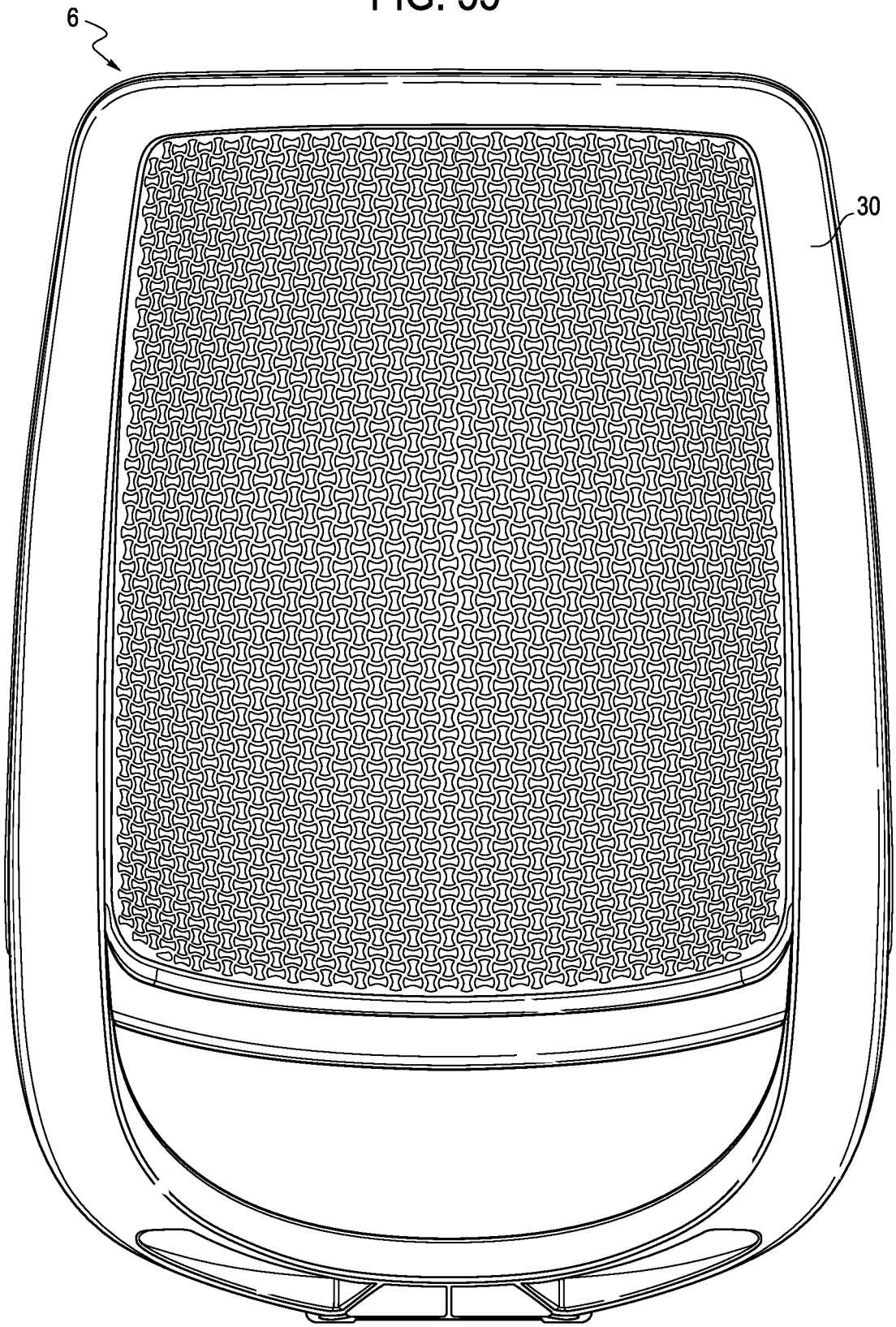
FIG. 55 is a rear elevation view thereof.
Figure 56:
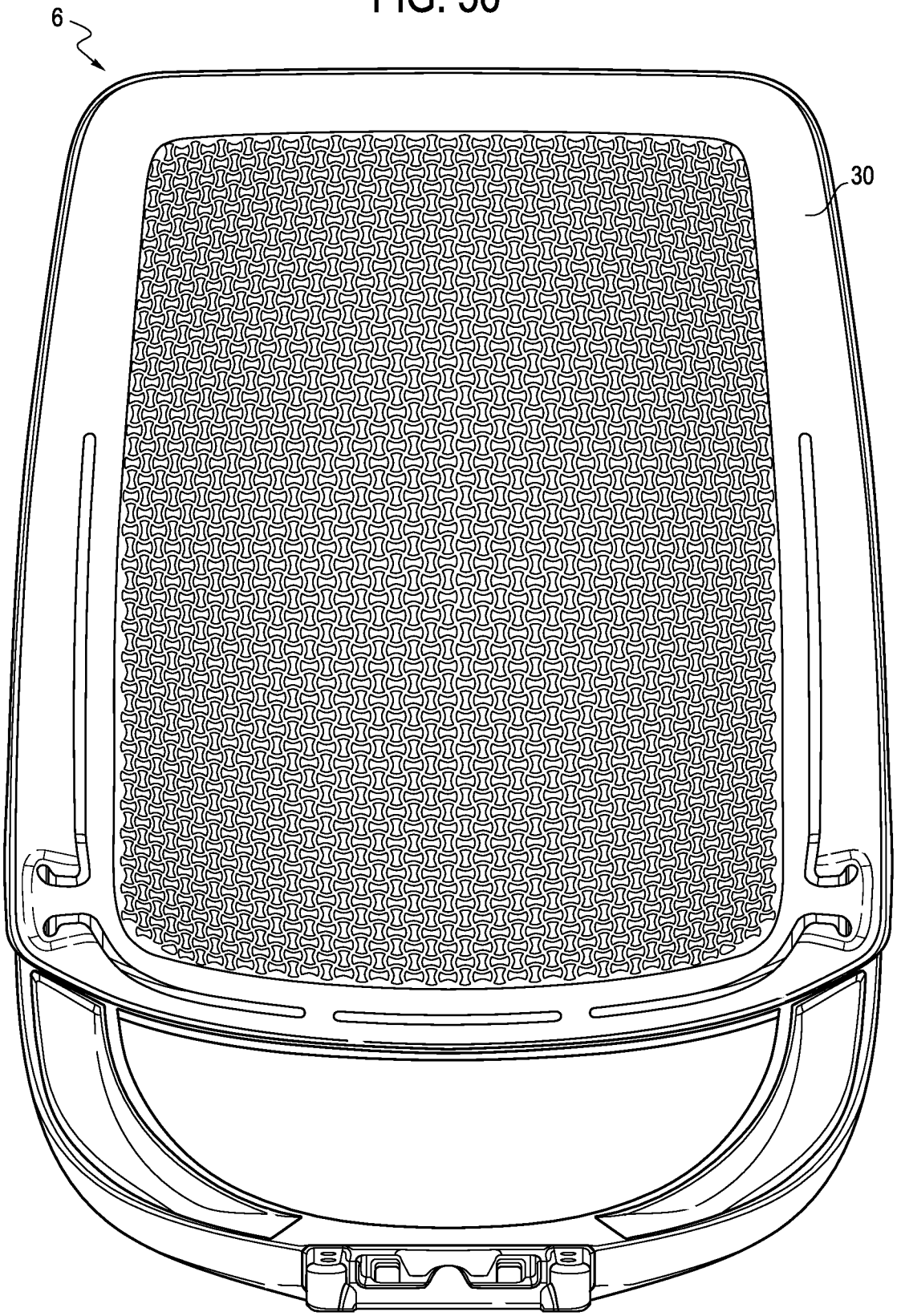
FIG. 56 is a front elevation view thereof.
Figure 57:
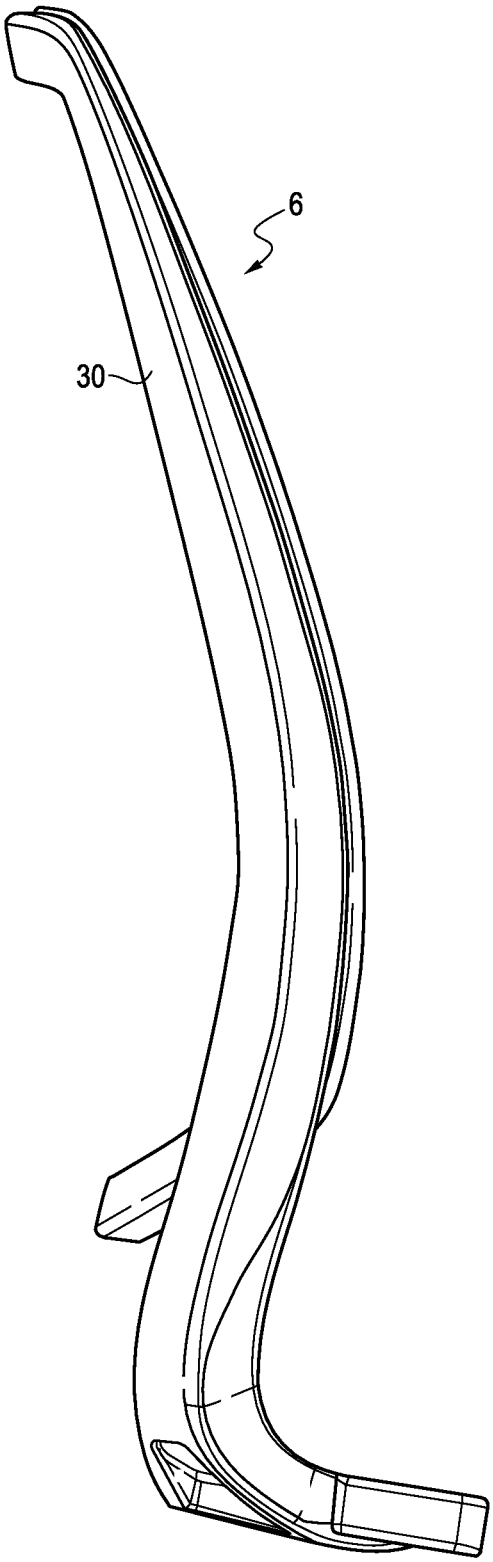
FIG. 57 is a right side elevation view thereof.
Figure 58:
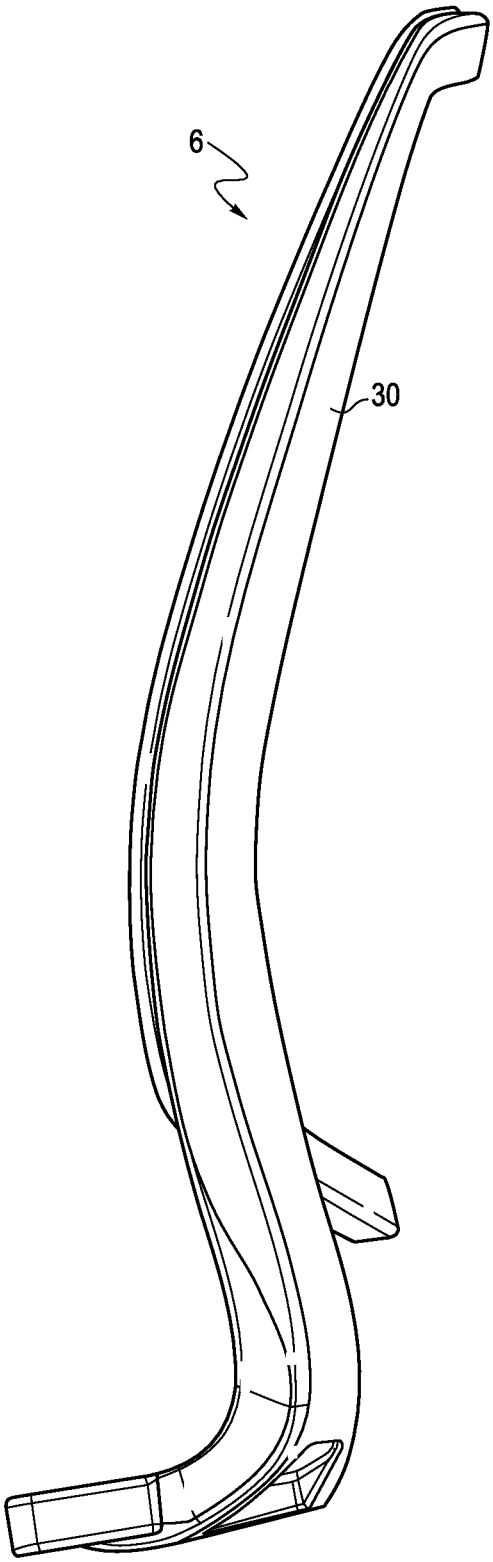
FIG. 58 is a left side elevation view thereof.
Figure 59:
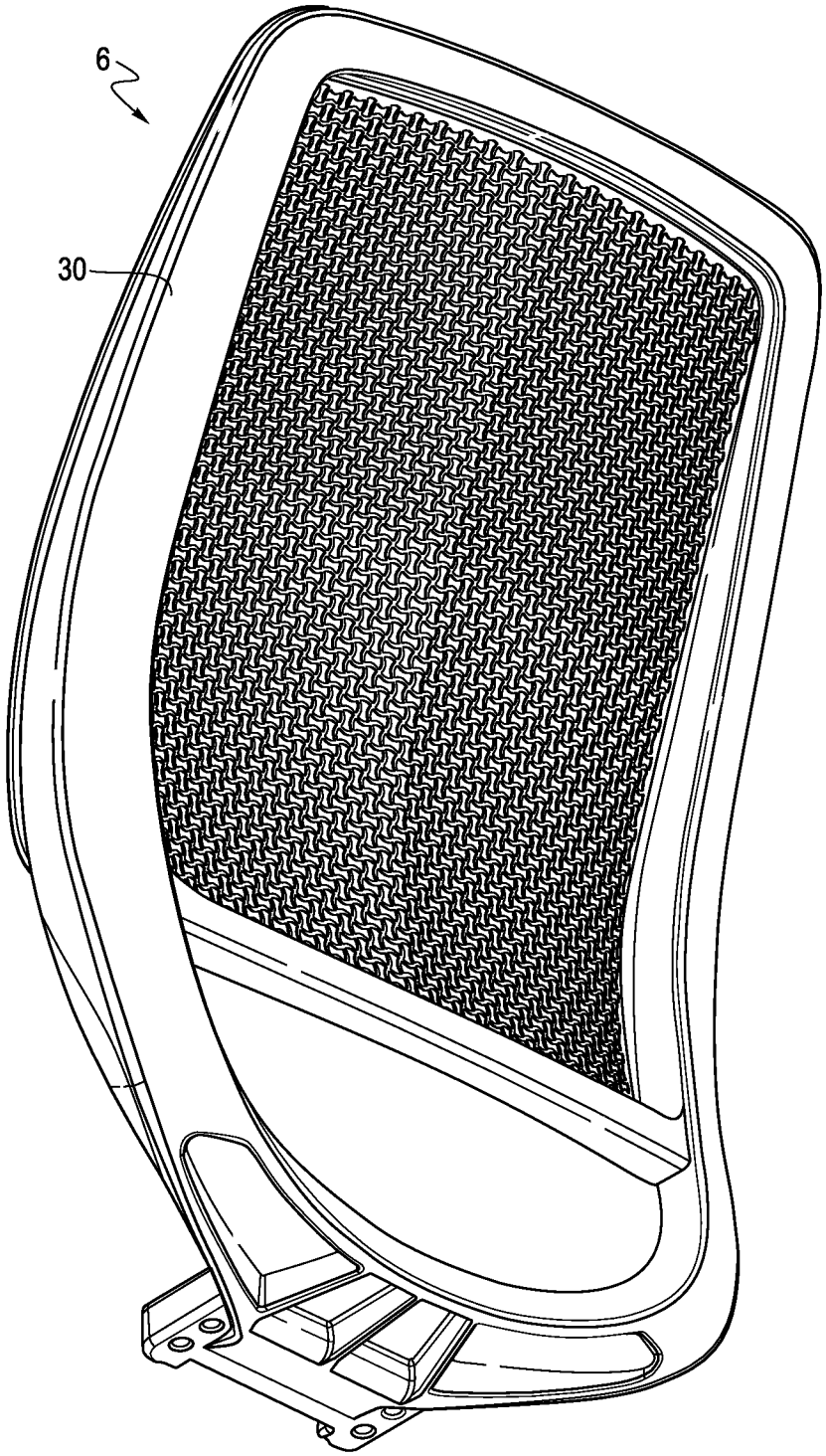
FIG. 59 is a rear lower perspective view thereof.
Figure 60:
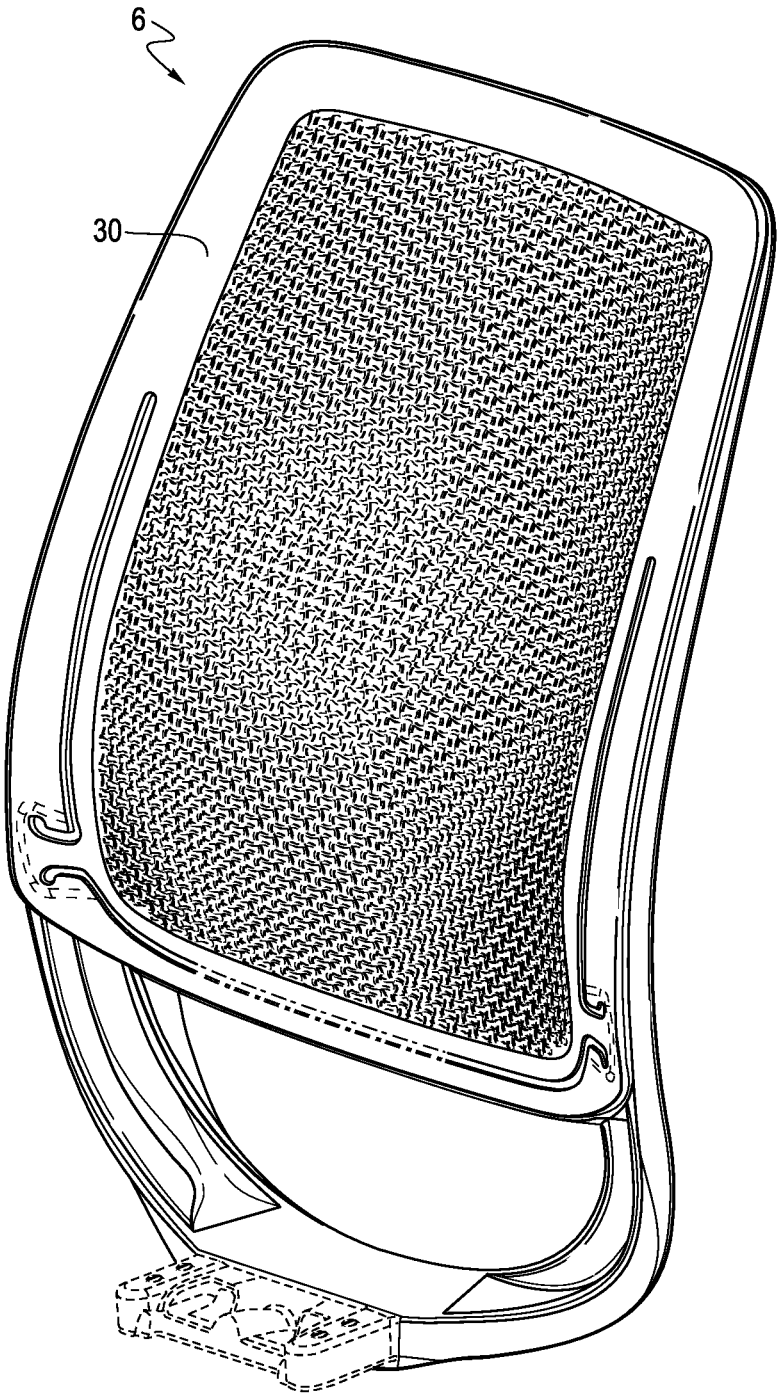
FIG. 60 is a top upper perspective view of yet another backrest, displaying its ornamental design features.
Figure 61:
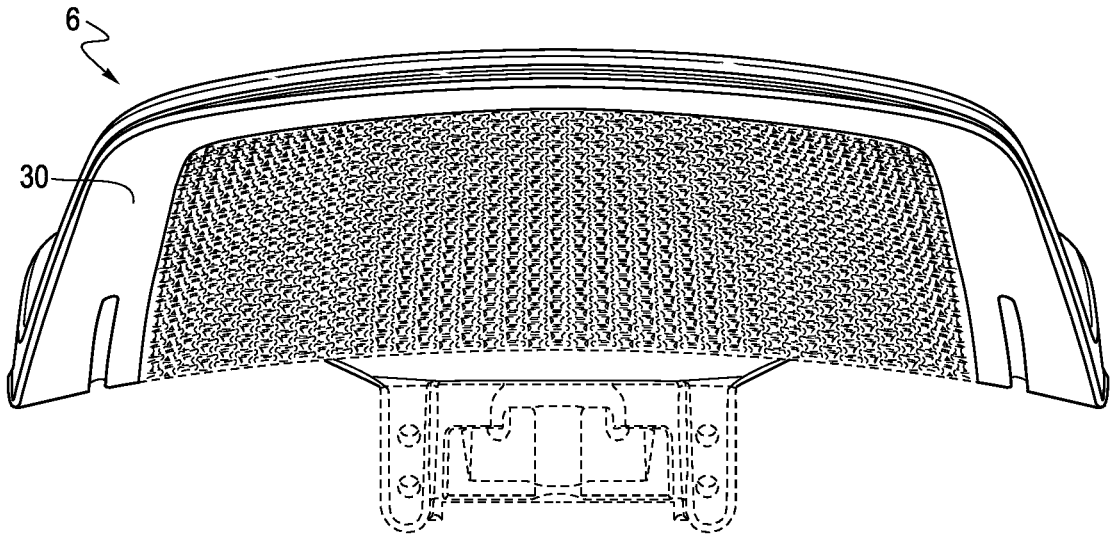
FIG. 61 is a top plan view thereof.
Figure 62:
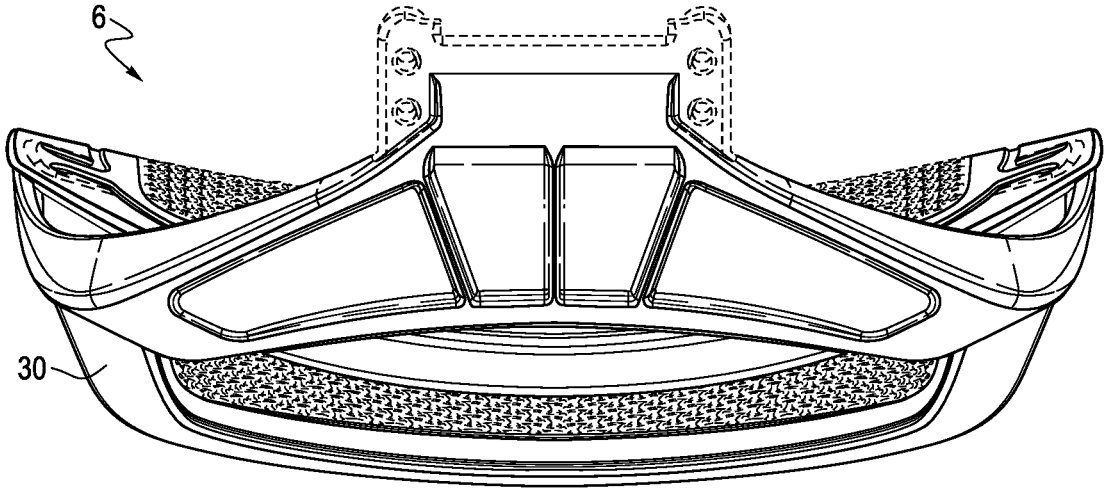
FIG. 62 is a bottom plan view thereof.
Figure 63:
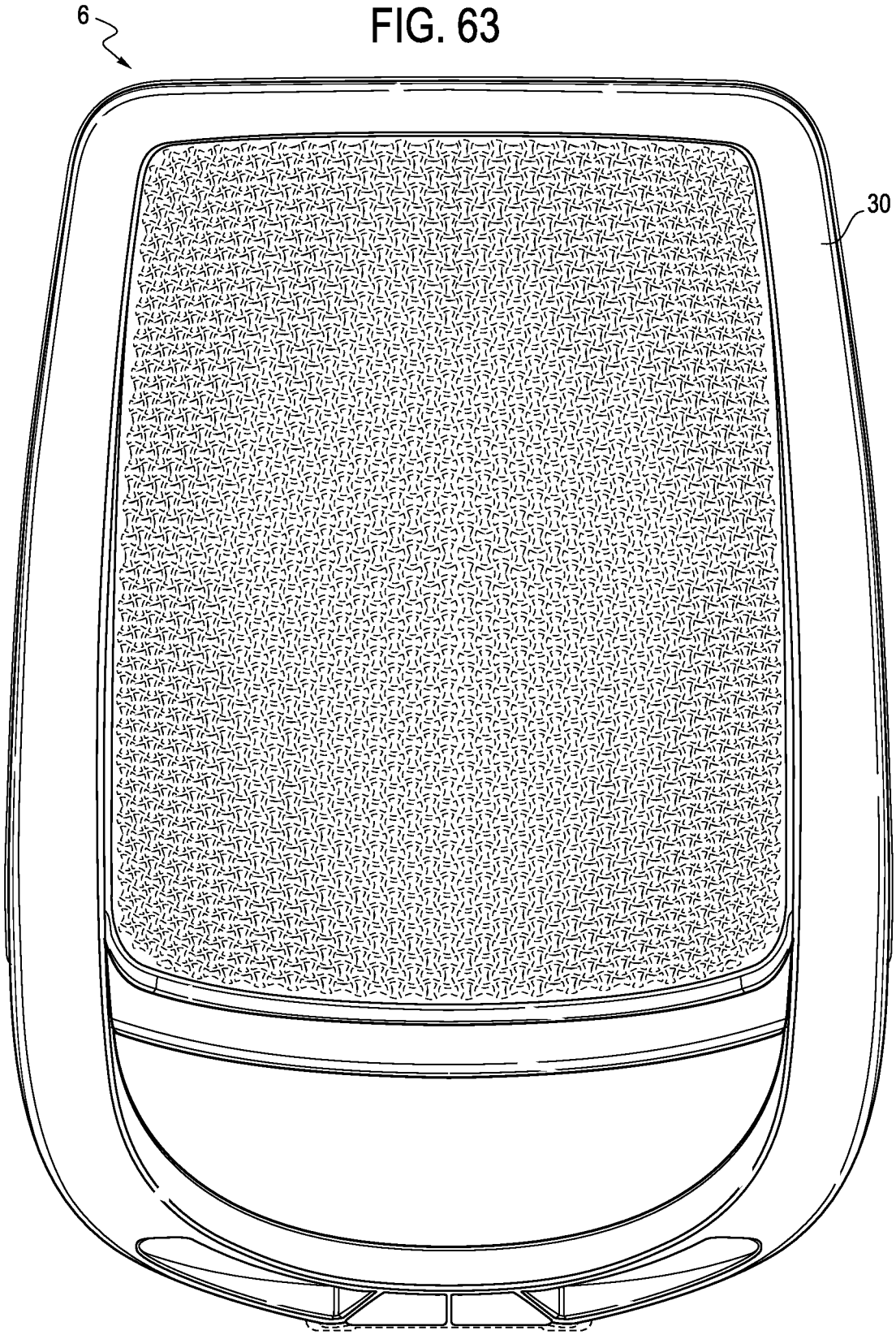
FIG. 63 is a rear elevation view thereof.
Figure 64:
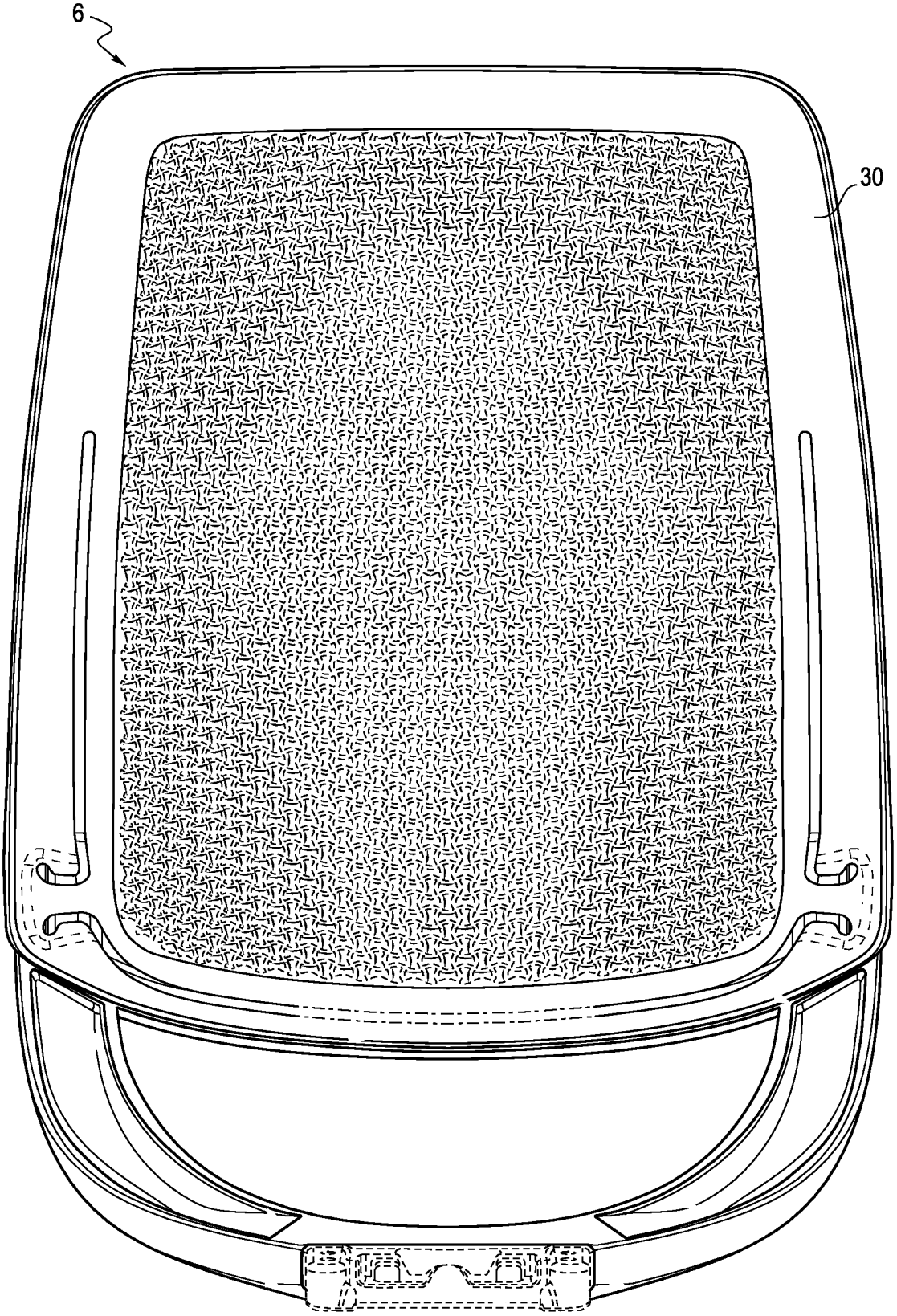
FIG. 64 is a front elevation view thereof.
Figure 65:
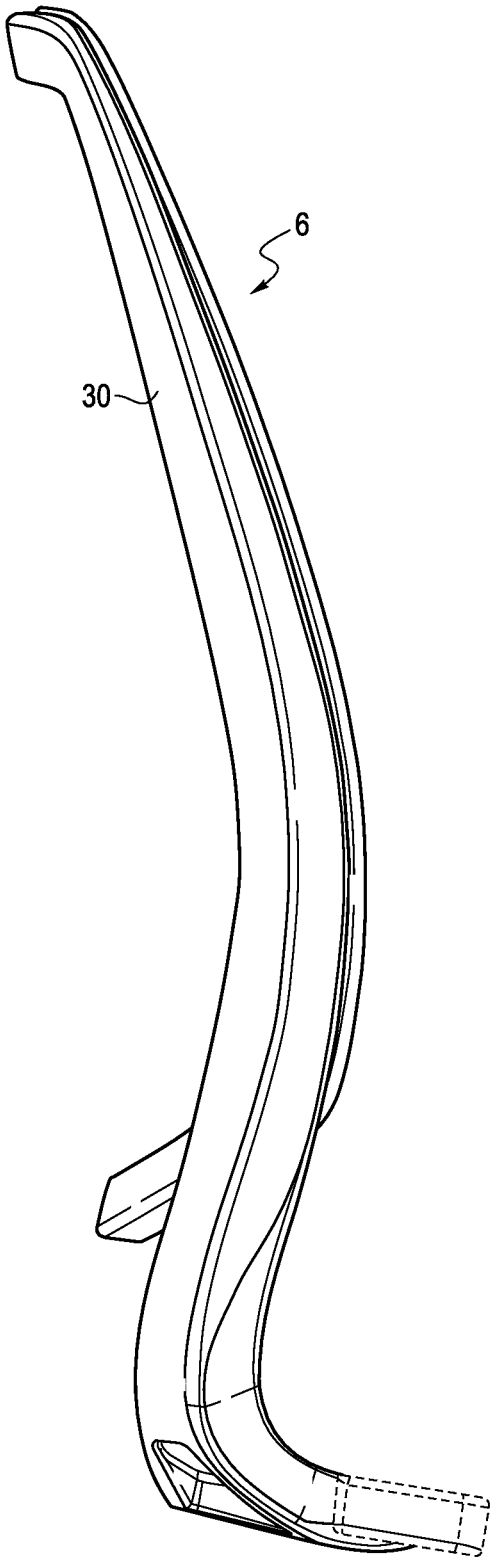
FIG. 65 is a right side elevation view thereof.
Figure 66:
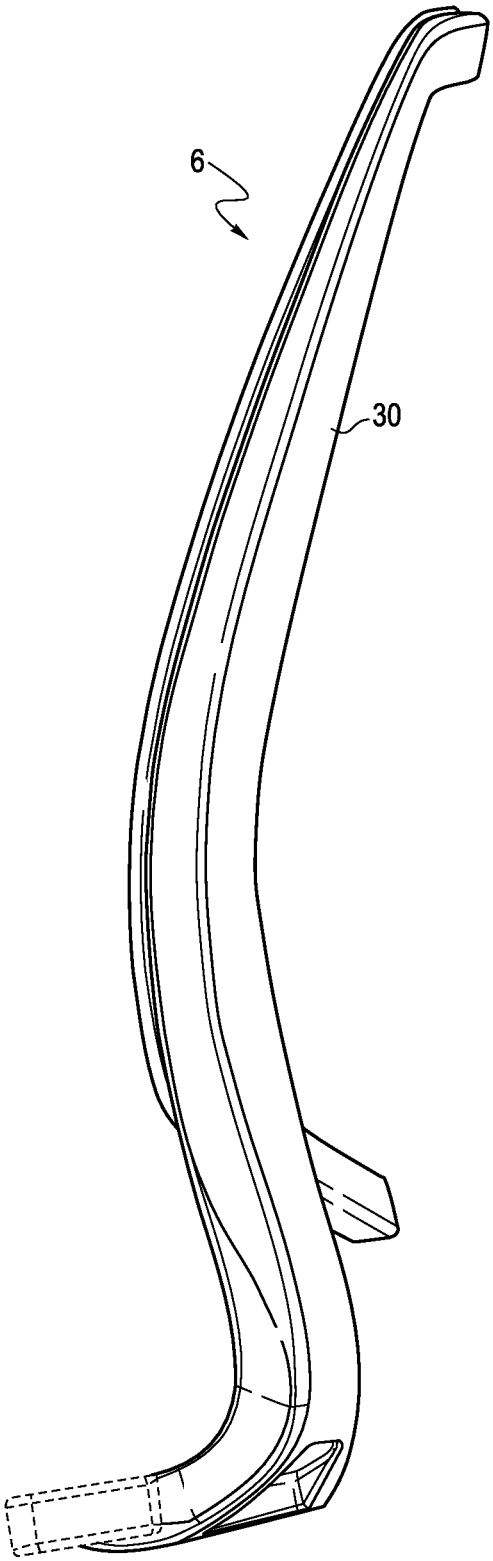
FIG. 66 is a left side elevation view thereof.
Figure 67:
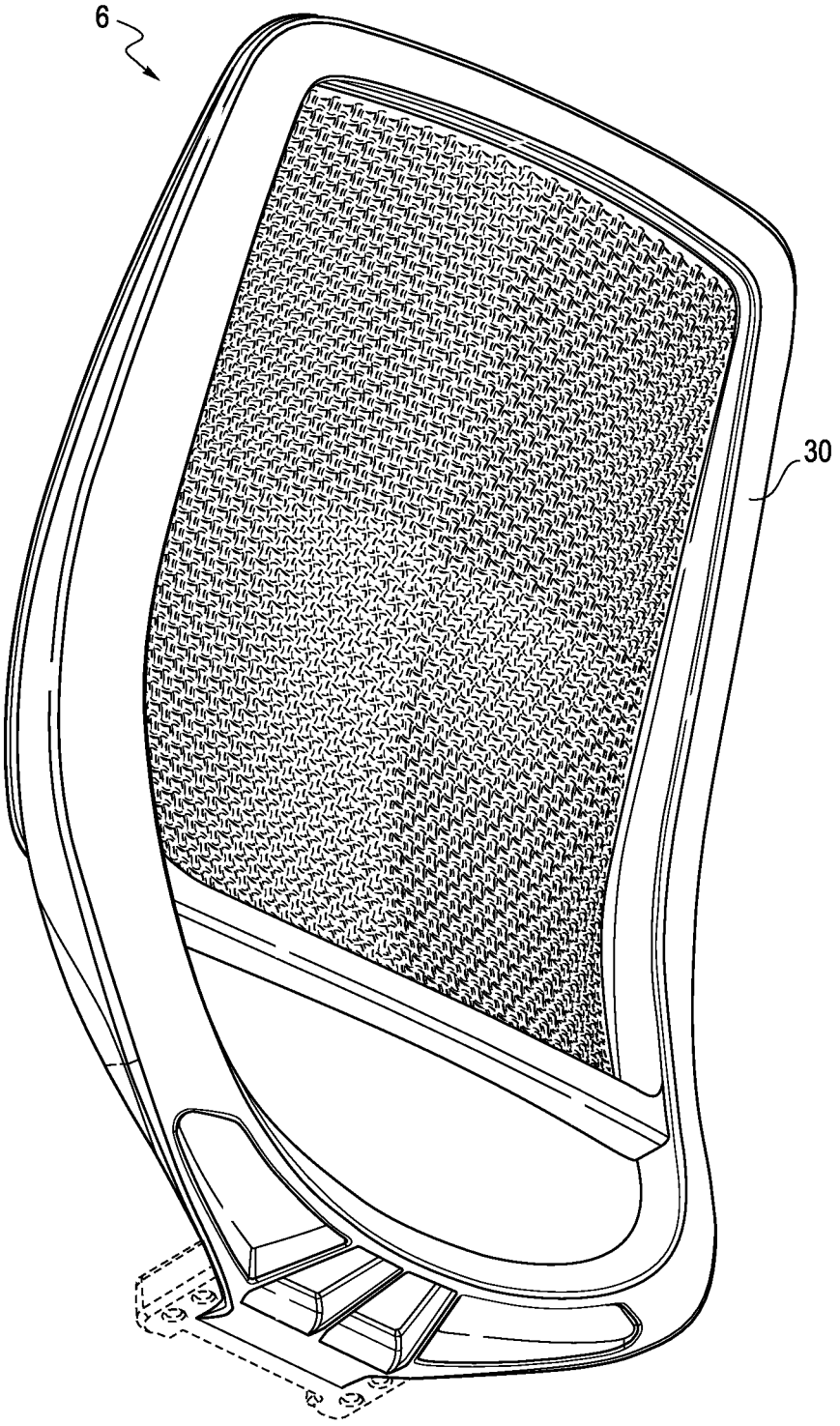
FIG. 67 is a rear lower perspective view thereof.

A cover or upholstery member 204, such as a fabric cover, extends over and covers the auxiliary support member and front body facing surface of the shell. The cover 204 is secured to the shell 100 over the body support member as shown in FIGS. 13 and 27. In one embodiment, shown in FIG. 27, a plurality of plastic strips 206 are sewn to the edges of the cover (e.g., fabric), for example along the opposite sides and upper and lower portions thereof. The cover is wrapped around the edges of the shell, and the strips 206 are connected to the side portions 106 and upper and lower portions 110, 108 of the shell, for example with fasteners 215 such as staples, or with adhesive, or combinations thereof. In one embodiment, shown in FIG. 27, a lower strip 209 is configured as a J-strip, or has a J-shaped cross section, which engages a lower edge of the shell flange. The strip has a pair of slits 211 that may be disposed over the tabs 47 to hold the strip 209 in place and help locate the cover 204 relative to the shell. In addition, the strips 206 are disposed on the inside of the ridge 115, which also helps locate the cover 204 relative to the shell, prior to securing the strips to the shell with fasteners.

Figure 17A:
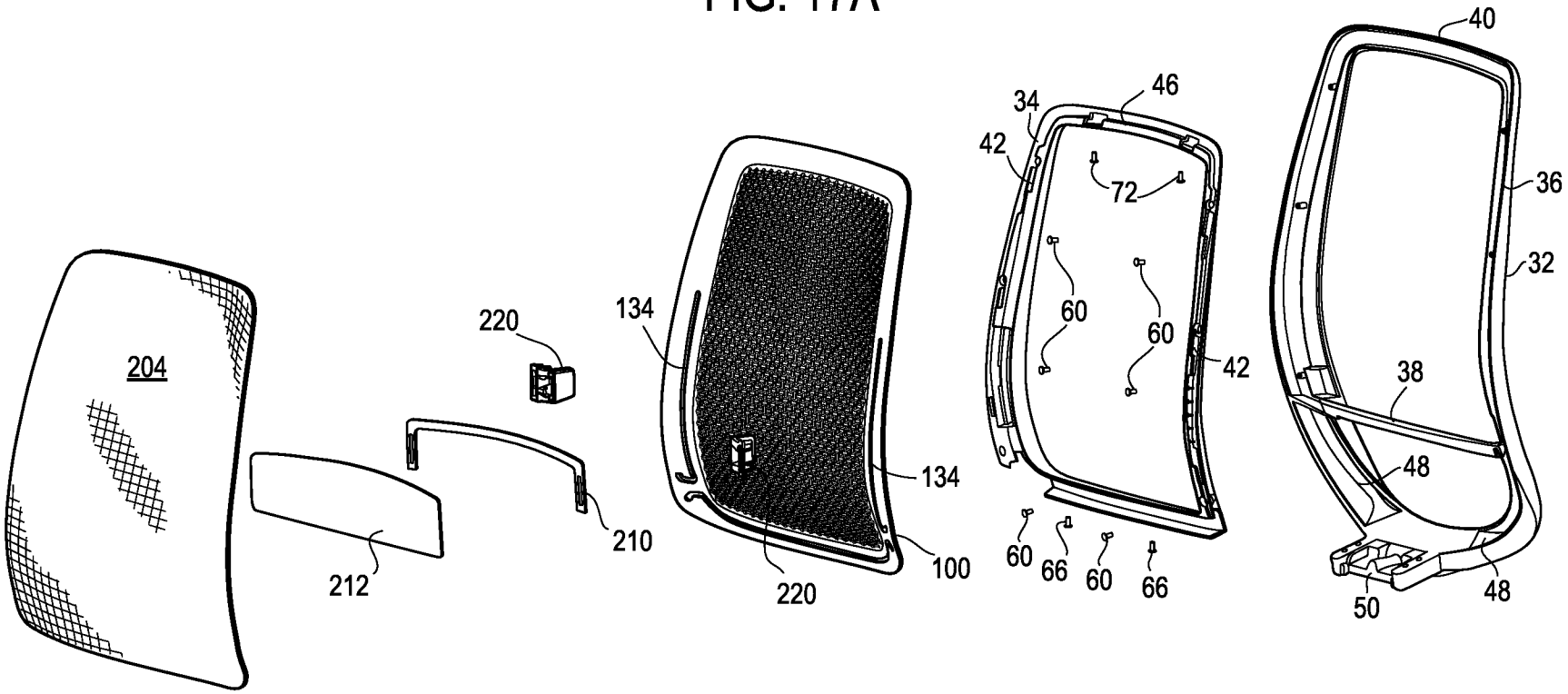
FIGS. 17A and B are exploded front and rear perspective views of one embodiment of a backrest.
Figure 17B:
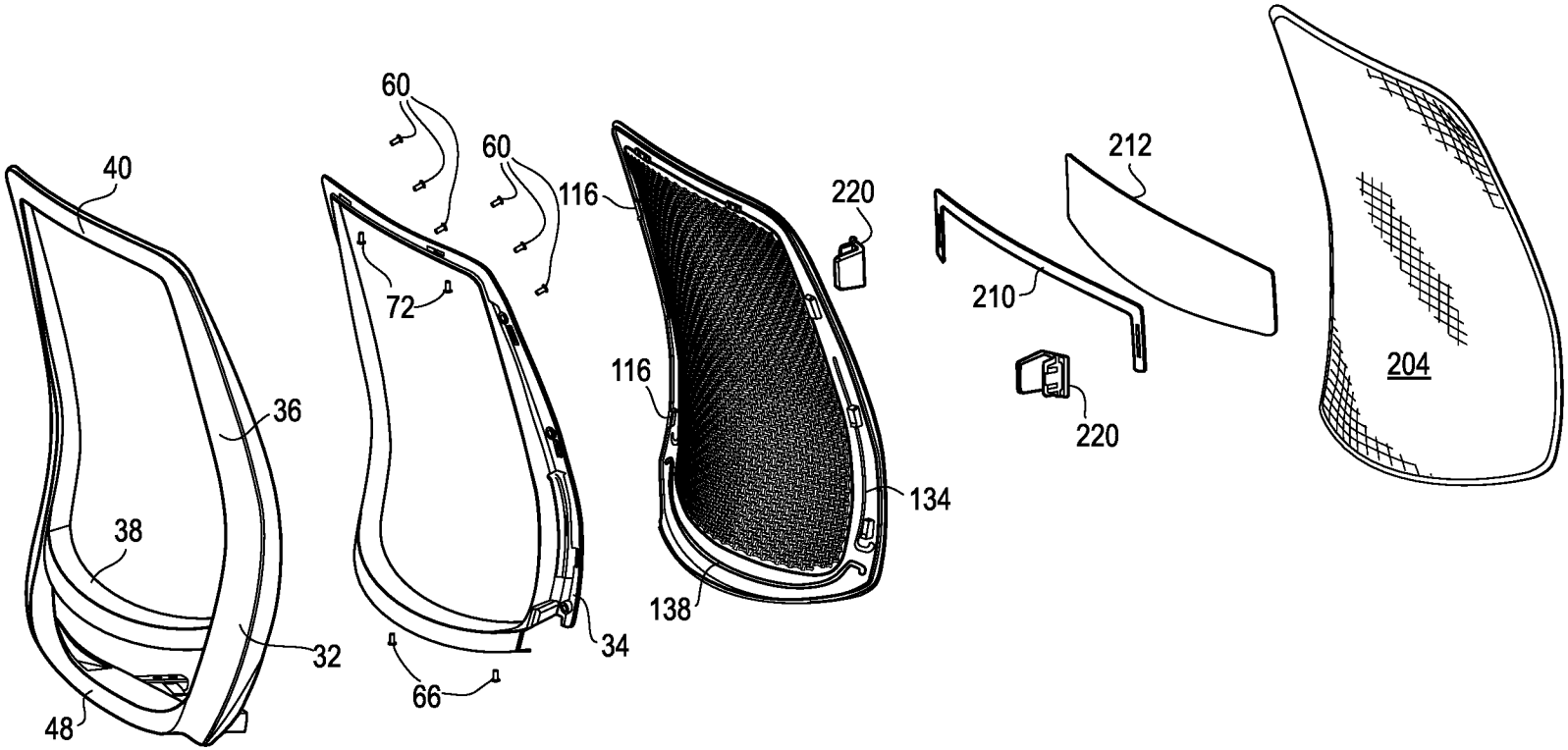
Figure 22:
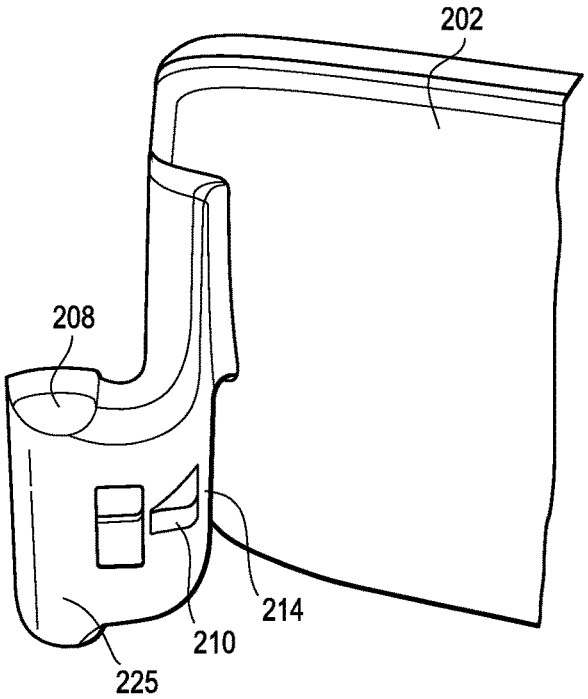
FIG. 22 is a partial, perspective view of an auxiliary body support member.
Figure 23:
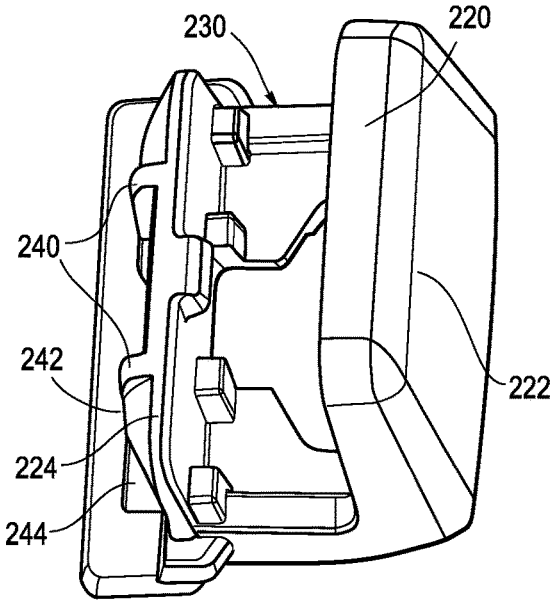
FIG. 23 is a perspective view of a user interface handle.
Figure 24:
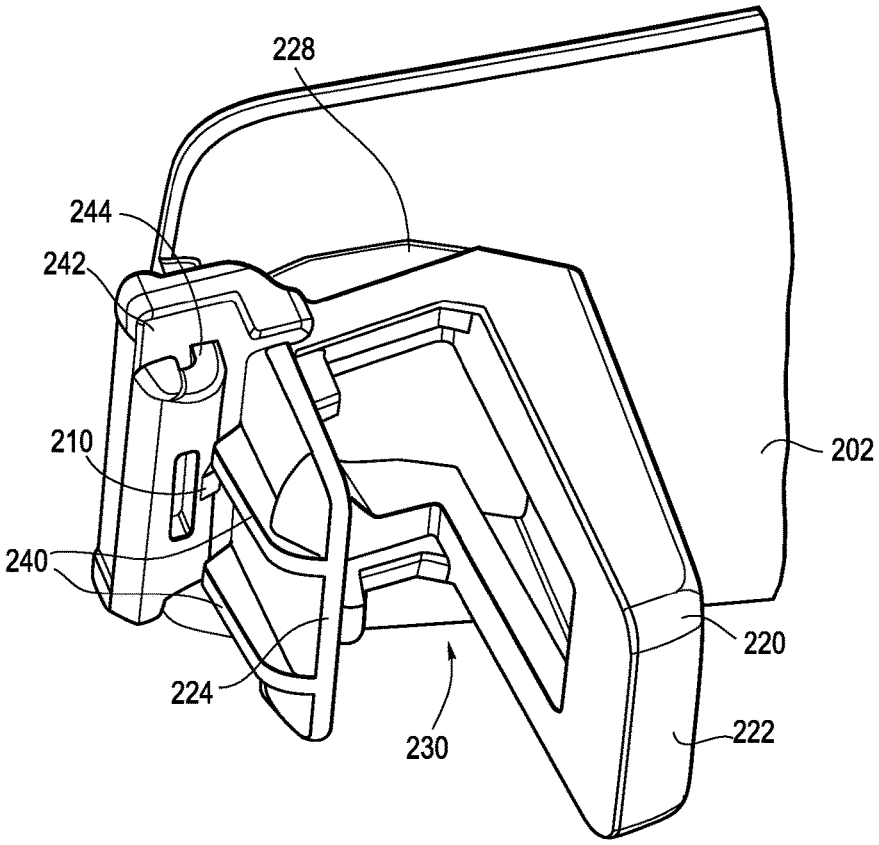
FIG. 24 is a partial perspective view of the user interface coupled to the auxiliary body support member.
Figure 25:
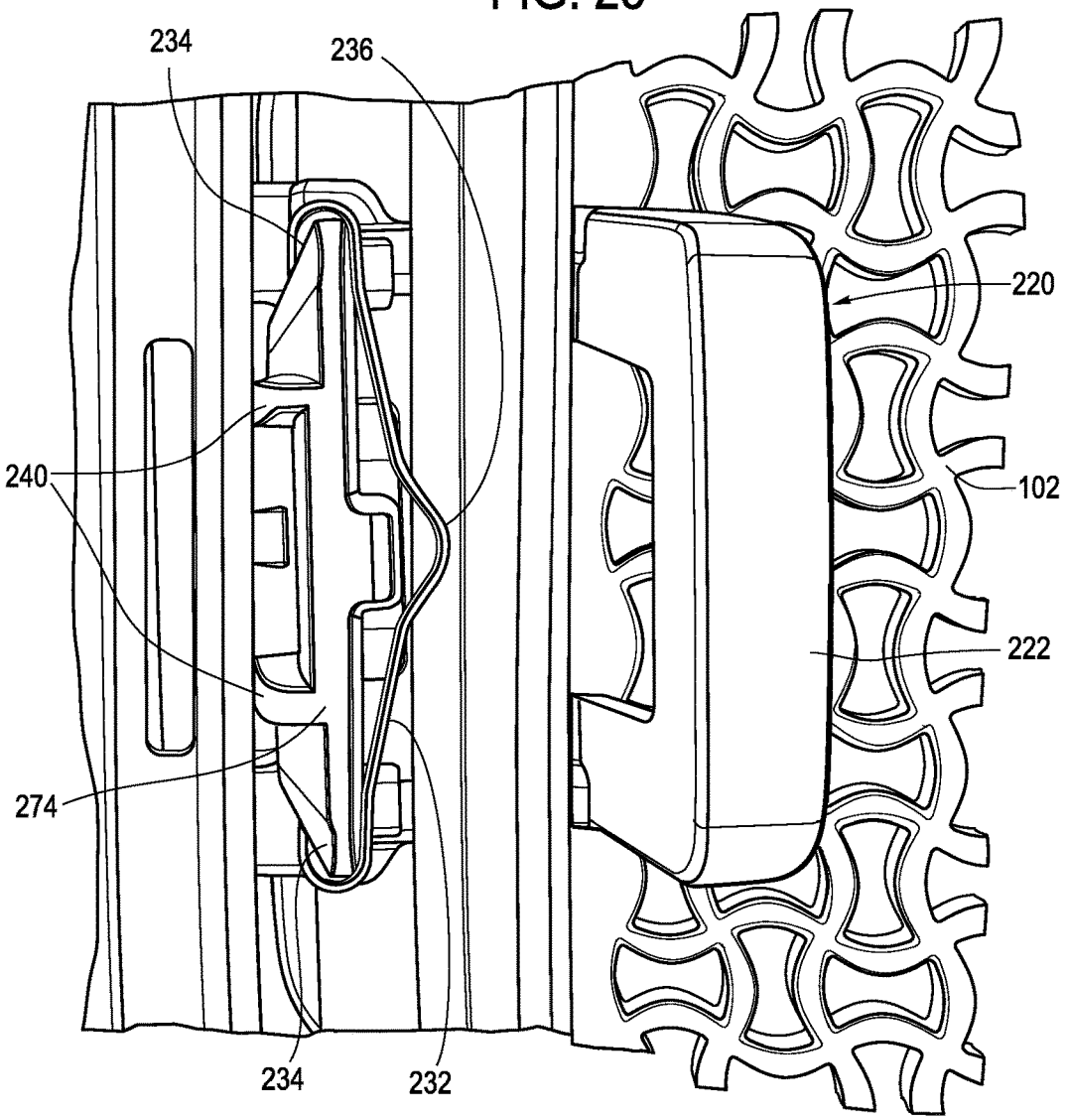
FIG. 25 is a partial rear view of the auxiliary body support member secured to the frame.

In one embodiment, the auxiliary support member includes a carrier frame 210, shown in FIGS. 17A and B as a C-shaped frame. A pad 212, which may be contoured, is coupled to a front, body facing surface of the frame, for example with mechanical fasteners, adhesives, or combinations thereof. In another embodiment, shown in FIG. 22, the belt 202 may include a rearwardly extending tab 214, or insert portion, which in turn has a flange 225 extending laterally from an end of the tab. The flange has ear portions 208 extending from a top and bottom thereof, and a slot formed in middle region. The tabs 214 on opposite sides of the belt are inserted through the slots 134 in the shell.

A handle 220 has a grippable portion, or rearwardly extending block 222 that is disposed and slides along a lateral inboard surface of the secondary frame uprights 42. The block is visible to the user, and includes a front surface 228 that slides along the rear surface 114 of the shell. The handle includes a second rearwardly extending portion 224, or leg/flange, laterally spaced from the block and defining a channel 230 there between. Adjacent flanges of the primary and secondary frame upright portions are disposed in the channel 230, with the flange 224 extending through the slot 88 from front to back. A spring 232, shown as a leaf spring, has end portions 234 coupled to opposite edges of the flange, with a central portion 236 engaging an inner surface of the primary frame upright portion, which is configured with detents 235. The flange 224 has a convex shape, with a pair of runners 240 that slide along a surface of the secondary frame. The handle further includes a laterally extending flange 242 with an opening 244, or slot, formed therein. The tab 214 of the belt extends through the opening 244, with the flange 225 engaging the flange 242. In this way, the belt is coupled to the laterally spaced handles. The handle includes one or more detents, or protuberances, which engage indentations in the frame, or vice versa, to help locate the handle and belt at predetermined vertical locations. In one embodiment, the spring 232, or central portion 236, interfaces with bumps 235 on the frame.

Figure 16:
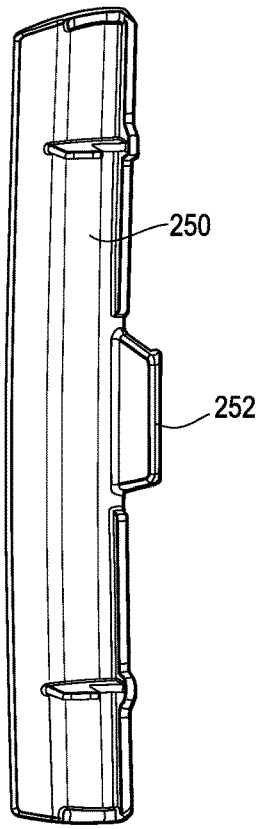
FIG. 16 is a partial rear perspective view of the auxiliary body support assembly.

If the auxiliary body support member is not being used, a cover member 250, shown in FIG. 16, is disposed in and over the cavity 90 of the secondary frame so as to lie flush with the front surface of the secondary frame. The cover includes a tab 252 that is inserted through the slot 94 in the secondary frame and engages the frame. The cover extends over the cavity and provides an aesthetic appearance when the lumbar is not installed on the backrest.

Operation:

The backrest may be configured with or without an auxiliary body support member. If configured without a body support member, the cover member 250 is disposed over the cavity. If configured with a body support member and assembly, the user may grasp the pair of grippable portions 222 of the handle and move the body support member, or belt 202, longitudinally, or vertically up and/or down along the front, body-facing support surface of the shell, to a desired position. Stops (e.g., upper and lower portions of the slot in the secondary frame) provide upper and lower limits for the adjustment of the body support member, while longitudinally spaced indentations/detents interface with the detents/spring and identify predetermined longitudinal positions for the auxiliary body support member.

The user may sit in the chair and lean against the backrest 6. If configured with a tilt control 18, the user may tilt the backrest rearwardly as they apply a force to the backrest. The backrest may be incorporated into static furniture, including fixed back chairs, sofas, and the like, as well as various vehicular seating applications. As the user applies a force to the backrest, the shell 100 may deform from its unloaded three-dimensional configuration to a loaded configuration. In one embodiment, the deformation of the shell includes moving a portion of the shell adjacent and inboard of the first and second slots 134. The deformation may also include moving a portion of the shell adjacent and above the third slot 138. For example, as shown in FIG. 19, the force F applied by the user U may cause the shell to flatten, with a change D in overall height of the center region. The value of D may be attributed to the macro compliance associated with the third slot, or the micro compliance associated with the matrix of openings. With respect to the latter, the first openings 152, due to their shape 160, or orientation, and the non-linear configuration of the strips, may be enlarged in the longitudinal direction 2, thereby expanding the shell across the matrix of openings in the longitudinal direction.

At the same time, as shown in FIG. 21, the backrest may experience a greater concave curvature in response to the load F applied by the user across the width of the central region of the backrest. Again, the change in width ΔW may be attributed to the macro compliance associated with the first and second slots 134, or the micro compliance associated with the matrix of openings. With respect to the latter, the second openings 154, due to their shape 162, or orientation, and the non-linear configuration of the strips, may be enlarged in the lateral direction 4, thereby expanding the shell across the matrix of openings in the lateral direction.

It should be understood that, due to the configuration of the matrix of openings in some of the embodiments (FIG. 15), the micro compliance in the longitudinal and lateral directions are independent, meaning that an expansion in one of the longitudinal and lateral directions 4, 2 does not necessarily correspond to, or create a proportional expansion (or contraction) in the other of the longitudinal or lateral directions. Rather, the matrix of openings allows the lateral and longitudinal expansion and/or contraction to operate independently in response to the load applied by the user. At the same time, the shell provides excellent shear resistance. The central region may be tuned to provide more or less stiffness in different regions thereof, for example by varying the size of the openings or thickness of the shell.

During this operation, the shell may be firmly and fixedly attached to the frame along the sides, top and bottom, for example in a non-rotational relationship, even while the center region above the third slot and inboard of the first and second slots is able to move and rotate.

FIGS. 28-35 show different views of a chair 10 including a backrest 6 that has an upholstered front face as well as an auxiliary support assembly 200 with handles 220, where these views highlight aesthetic design features of the chair with this backrest configuration. FIGS. 36-43 show different views of a backrest 6 that includes an upholstered front face and the auxiliary support assembly 200 with handles 220, where these views highlight aesthetic design features of the chair with this backrest configuration. FIGS. 44-51 show different views of a chair 10 including a backrest 6 that has an exposed web, where these views highlight aesthetic design features of the chair with this backrest configuration. FIGS. 43-59 and 60-67, respectively, show views of two different configurations of a backrest 6 that includes an exposed web, where these views highlight aesthetic design features of the chair with this backrest configuration. It should be appreciated that the backrest embodiments including each of the different embodiments' respective frame assembly 30, auxiliary support assembly 200, and handles 220, as well as other components of the illustrated chair 10 embodiments may be configured with a number of ornamental appearances that differ from those shown herein while still providing the functions claimed herein.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A backrest comprising:

a peripheral frame defining a central opening and comprising a pair of laterally spaced upright members connected with longitudinally spaced upper and lower members; and a flexible shell comprising opposite sides coupled directly to the upright members and upper and lower portions coupled directly to the upper and lower members, wherein the shell comprises a molded component having a three-dimensional shape in a non-loaded configuration, wherein the shell has a forwardly facing convex shape along a vertical centerline and a forwardly facing concave shape along a horizontal centerline in the non-loaded configuration, wherein the shell further comprises a plurality of openings arranged in an area overlying the central opening, and wherein the shell has flush front and rear surfaces in the area overlying the central opening, wherein the plurality of openings comprises a matrix of openings providing independent lateral and longitudinal expansion of the shell relative to the frame.

2. The backrest of claim 1 wherein the shell material has a Young's Modulus E≥100,000 PSI.

3. The backrest of claim 1 wherein the matrix of openings comprises a plurality of first openings having a first shape and a plurality of second openings having a second shape different than the first shape, wherein the first and second openings are arranged in an alternating pattern in both a lateral direction and a longitudinal direction.

4. The backrest of claim 3 wherein the first shape is a laterally oriented dog-bone shape and the second shape is a longitudinally oriented dog-bone shape.

5. The backrest of claim 1 wherein the shell has different thicknesses in different regions of the area defined by the plurality of openings.

6. The backrest of claim 1 wherein the shell is coupled directly to the upright members with a plurality of connectors positioned laterally outboard of the plurality of openings.

7. The backrest of claim 1 wherein the peripheral frame comprises a secondary frame, and further comprising a primary frame coupled to the secondary frame.

8. A backrest comprising:

a peripheral frame defining a central opening and comprising a pair of laterally spaced upright members connected with longitudinally spaced upper and lower members; and a flexible shell comprising opposite sides coupled to the upright members and upper and lower portions coupled to the upper and lower members, wherein the shell comprises a molded component having a three-dimensional shape in a non-loaded configuration, wherein the shell has a forwardly facing convex shape along a vertical centerline and a forwardly facing concave shape along a horizontal centerline in the non-loaded configuration, wherein the shell further comprises a plurality of openings arranged in an area overlying the central opening, and wherein the shell has flush front and rear surfaces in the area overlying the central opening, wherein the plurality of openings comprises a matrix of openings providing independent lateral and longitudinal expansion of the shell relative to the frame, wherein the shell comprises first and second elongated slots extending longitudinally along opposite sides of the shell inboard of locations where the shell is connected to the upright members and one or more third slots extending laterally along the lower portion of the shell above a location where the shell is connected to the lower member.

9. A backrest comprising:

a frame comprising a pair of laterally spaced upright members; and a flexible shell comprising opposite sides coupled to the upright members, wherein the shell comprises:

first and second slots extending longitudinally along opposite sides of the shell inboard of locations where the shell is connected to the upright members, wherein the first slot comprises a first length extending in a longitudinal direction and a first width extending in a lateral direction, wherein the first length is greater than the first width, and wherein the second slot comprises a second length extending in the longitudinal direction and a second width extending in the lateral direction, wherein the second length is greater than the second width; and a plurality of openings arranged between the first and second slots, wherein the plurality of openings comprises a matrix of openings adapted to allow lateral expansion of the shell.

10. The backrest of claim 9 wherein the flexible shell comprises a molded component having a three-dimensional shape in a non-loaded configuration, wherein the shell has a forwardly facing convex shape along a vertical centerline and a forwardly facing concave shape along a horizontal centerline in the non-loaded configuration.

11. The backrest of claim 9 wherein the shell has flush front and rear surfaces in an area defined by the plurality of openings.

12. The backrest of claim 11 wherein the shell has different thicknesses in different regions of the area defined by the plurality of openings.

13. The backrest of claim 9 wherein the peripheral frame further comprises longitudinally spaced upper and lower members connected with the pair of upright members so as to define a central opening therebetween, wherein the flexible shell comprises upper and lower portions coupled to the upper and lower members.

14. The backrest of claim 13 wherein the matrix of openings is adapted to provide longitudinal expansion of the shell.

15. The backrest of claim 9 wherein the plurality of openings comprises a plurality of first openings having a first shape and a plurality of second openings having a second shape different than the first shape, wherein the first and second openings are arranged in an alternating pattern in both a lateral direction and a longitudinal direction.

16. The backrest of claim 15 wherein the first shape is a laterally oriented dog-bone shape and the second shape is a longitudinally oriented dog-bone shape.

17. The backrest of claim 9 wherein the shell comprises a ring-like peripheral edge portion surrounding the plurality of openings.

18. The backrest of claim 9 wherein the shell material has a Young's Modulus E≥100,000 PSI.

19. A backrest comprising:

a frame comprising a pair of laterally spaced upright members; and a flexible shell comprising opposite sides coupled to the upright members, wherein the shell comprises:

first and second slots extending longitudinally along opposite sides of the shell inboard of locations where the shell is connected to the upright members, wherein the first and second slots each have a length greater than ⅓ of an overall length of the shell, and wherein at least ½ of the length of each of the first and second slots is disposed beneath a laterally extending centerline of the shell; and a plurality of openings arranged between the first and second slots, wherein the plurality of openings comprises a matrix of openings adapted to allow lateral expansion of the shell.

20. A backrest comprising:

a frame comprising a pair of laterally spaced upright members; and a flexible shell comprising opposite sides coupled to the upright members, wherein the shell comprises:

first and second slots extending longitudinally along opposite sides of the shell inboard of locations where the shell is connected to the upright members; and a plurality of openings arranged between the first and second slots, wherein the plurality of openings comprises a matrix of openings adapted to allow lateral expansion of the shell; and an auxiliary body support member having end portions engaging the shell, wherein the auxiliary body support member is moveable along a surface of the shell as the end portions are moveable along the first and second slots.

21. The backrest of claim 20 wherein the auxiliary body support member is disposed against and is moveable along a forwardly facing body support surface of the shell.

* * * * *